US012600522B1

(12) United States Patent
Srichai

(10) Patent No.: US 12,600,522 B1
(45) Date of Patent: Apr. 14, 2026

(54) COLLAPSIBLE CRATE AND RELATED METHODS

(71) Applicant: Goodpack IBC (Singapore) Pte. Ltd., Singapore (SG)

(72) Inventor: Uthai Srichai, Bangkok (TH)

(73) Assignee: Goodpack IBC (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 19/301,694

(22) Filed: Aug. 15, 2025

Related U.S. Application Data

(63) Continuation of application No. 19/135,027, filed as application No. PCT/IB2023/063198 on Dec. 22, 2023.

(Continued)

(51) Int. Cl.
*B65D 19/12* (2006.01)
*B65D 19/38* (2006.01)

(52) U.S. Cl.
CPC .. *B65D 19/385* (2013.01); *B65D 2519/00034* (2013.01); *B65D 2519/00059* (2013.01); *B65D 2519/00676* (2013.01)

(58) Field of Classification Search
CPC ..... B65D 19/12; B65D 2519/00024; B65D 2519/00273; B65D 2519/00288; B65D 2519/00293; B65D 2519/00298; B65D 2519/00323; B65D 2519/00333; B65D 2519/00502; B65D 2519/00512; B65D 2519/00611; B65D 2519/00656;

(Continued)

(56) References Cited

U.S. PATENT DOCUMENTS 4,591,065 A 5/1986 Foy
4,798,278 A 1/1989 Cornacchia (Continued)

FOREIGN PATENT DOCUMENTS

BR 112013000883 A2 5/2016
CL 200000636 U1 7/2001

(Continued)

OTHER PUBLICATIONS

Patent Translate, Bibliographic data: JPH06199347, Carying cart, Jul. 19, 1994, 16 pages.*

(Continued)

*Primary Examiner* — Luan K Bui
(74) *Attorney, Agent, or Firm* — Fitch, Even, Tabin & Flannery, LLP

(57) ABSTRACT

A collapsible crate is disclosed including a first side frame and a base. The first side frame has an end portion and an upper portion extending from the end portion. The base includes a supporting surface and a receptacle below the supporting surface for positioning the first side frame. The base including one or more locking recesses positioned below the supporting surface to receive the end portion of the first side frame. The first side frame is movable between a first configuration where the end portion of the first side frame is received in the one or more locking recesses of the base such that at least a portion of the first side frame extends above the supporting surface of the base and a second configuration where at least a portion of the upper portion of the first side frame is within the receptacle of the base.

14 Claims, 60 Drawing Sheets

Related U.S. Application Data

(60) Provisional application No. 63/435,966, filed on Dec. 29, 2022.

(58) Field of Classification Search
CPC .... B65D 2519/00661; B65D 2519/009; B65D 2519/0096; B65D 2519/00975; B65D 2519/00029; B65D 2519/00034; B65D 19/06; B65D 19/10
USPC ..... 206/386, 600; 220/4.28, 4.31–4.34
See application file for complete search history.

(56) References Cited

U.S. PATENT DOCUMENTS

| | | | | |
|---|---|---|---|---|
| 5,056,667 | A * | 10/1991 | Coogan | B65D 19/12 206/600 |
| 5,242,255 | A * | 9/1993 | Gleffe | B65D 19/12 211/195 |
| 5,253,763 | A | 10/1993 | Kirkley | |
| 5,269,414 | A | 12/1993 | D Hollander | |
| 5,415,311 | A * | 5/1995 | Coogan | B65D 19/12 220/23.6 |
| 5,509,257 | A | 4/1996 | Tagliaferri | |
| 5,531,661 | A | 7/1996 | Moncrief | |
| 5,562,581 | A | 10/1996 | Roberto | |
| 5,564,599 | A | 10/1996 | Barber | |
| 5,711,444 | A | 1/1998 | Meacham | |
| 6,347,718 | B1 | 2/2002 | Karpisek | |
| 6,955,273 | B2 | 10/2005 | Hartwall | |
| 7,066,332 | B2 | 6/2006 | Kobayashi | |
| 7,216,592 | B2 | 5/2007 | Krech | |
| 7,281,637 | B2 | 10/2007 | Hadar | |
| 7,350,662 | B2 | 4/2008 | Arnold | |
| 7,819,269 | B2 | 10/2010 | Perkins | |
| 8,228,201 | B2 | 7/2012 | Kennedy | |
| 8,413,831 | B2 | 4/2013 | Nolan | |
| 8,573,427 | B2 | 11/2013 | Lam | |
| 8,844,753 | B2 | 9/2014 | Starnes | |
| 8,955,709 | B2 | 2/2015 | Lorenz | |
| 9,016,474 | B2 | 4/2015 | Ritzberger | |
| 9,802,754 | B2 | 10/2017 | Navalon Simon | |
| 10,065,763 | B2 | 9/2018 | Wilcox | |
| RE47,210 | E * | 1/2019 | Lam | B65D 7/30 |
| 10,577,174 | B2 | 3/2020 | Fenneman | |
| 11,021,320 | B2 | 6/2021 | Lv | |
| 11,591,802 | B1 | 2/2023 | Valore | |
| 2002/0070215 | A1 | 6/2002 | Walsh | |
| 2004/0026296 | A1* | 2/2004 | Nesting | B65D 19/18 206/517 |
| 2004/0059035 | A1 | 3/2004 | Krech | |
| 2004/0149766 | A1 | 8/2004 | Karpisek | |
| 2005/0000834 | A1 | 1/2005 | Clive-Smith | |
| 2005/0139510 | A1* | 6/2005 | Zhang | B65D 88/129 206/600 |
| 2005/0150892 | A1 | 7/2005 | Miller | |
| 2005/0178770 | A1 | 8/2005 | Hase | |
| 2005/0224494 | A1 | 10/2005 | Heinrichs | |
| 2005/0230283 | A1 | 10/2005 | Kobayashi | |
| 2006/0043090 | A1 | 3/2006 | Ferrini | |
| 2006/0104755 | A1 | 5/2006 | Clive-Smith | |
| 2006/0144838 | A1 | 7/2006 | Winn | |
| 2006/0226143 | A1 | 10/2006 | Elstone | |
| 2007/0278223 | A1 | 12/2007 | Ficker | |
| 2008/0011742 | A1 | 1/2008 | Bellehumeur | |
| 2008/0029517 | A1 | 2/2008 | Briers | |
| 2009/0272739 | A1 | 11/2009 | Fredrickson | |
| 2010/0072199 | A1 | 3/2010 | Manuel | |
| 2010/0147842 | A1 | 6/2010 | Reynard | |
| 2011/0049823 | A1 | 3/2011 | Coats | |
| 2012/0012492 | A1 | 1/2012 | Darden | |
| 2013/0112685 | A1 | 5/2013 | Lam | |
| 2014/0042157 | A1 | 2/2014 | Giesbers | |
| 2016/0251153 | A1 | 9/2016 | Navalon Simon | |
| 2016/0272364 | A1 | 9/2016 | Jian | |
| 2017/0349198 | A1 | 12/2017 | Depadro | |
| 2017/0349199 | A1 | 12/2017 | Septimio | |
| 2017/0349324 | A1* | 12/2017 | Golanowski | B65D 7/065 |
| 2020/0079582 | A1 | 3/2020 | Press | |
| 2021/0261075 | A1 | 8/2021 | Pendergrass | |
| 2022/0144540 | A1 | 5/2022 | Argentti | |
| 2023/0322437 | A1* | 10/2023 | Phelps | B65D 19/38 206/600 |
| 2023/0399142 | A1* | 12/2023 | Srichai | B65D 19/06 |

FOREIGN PATENT DOCUMENTS

| | | | |
|---|---|---|---|
| CL | 2007003534 | U1 | 3/2009 |
| CN | 1589214 | A | 3/2005 |
| CN | 201172503 | Y | 12/2008 |
| CN | 201280262 | Y | 7/2009 |
| CN | 201281057 | Y | 7/2009 |
| CN | 101519146 | A | 9/2009 |
| CN | 201808724 | U | 4/2011 |
| CN | 201908924 | U | 7/2011 |
| CN | 103158924 | B | 6/2013 |
| CN | 203652327 | U | 6/2014 |
| CN | 105083698 | A | 11/2015 |
| CN | 102837874 | B | 8/2016 |
| CN | 107074400 | A | 8/2017 |
| CN | 108341124 | A | 7/2018 |
| CN | 207631661 | U | 7/2018 |
| CN | 108657560 | A | 10/2018 |
| CN | 208102617 | U | 11/2018 |
| CN | 109229718 | A | 1/2019 |
| CN | 208377317 | U | 1/2019 |
| CN | 208485096 | U | 2/2019 |
| CN | 208499327 | U | 2/2019 |
| CN | 109533561 | A | 3/2019 |
| CN | 110436014 | A | 11/2019 |
| CN | 209634890 | U | 11/2019 |
| CN | 110641849 | A | 1/2020 |
| CN | 110641850 | A | 1/2020 |
| CN | 110877780 | A | 3/2020 |
| CN | 111155855 | A | 5/2020 |
| CN | 111511663 | A | 8/2020 |
| CN | 111846649 | A | 10/2020 |
| CN | 112027293 | A | 12/2020 |
| CN | 112124741 | A | 12/2020 |
| CN | 112141485 | A | 12/2020 |
| CN | 112141531 | A | 12/2020 |
| CN | 212125891 | U | 12/2020 |
| CN | 212176867 | U | 12/2020 |
| CN | 112550970 | A | 3/2021 |
| CN | 112572949 | A | 3/2021 |
| CN | 212710519 | U | 3/2021 |
| CN | 212767373 | U | 3/2021 |
| CN | 102773618 | B8 | 4/2021 |
| CN | 112830112 | A | 5/2021 |
| CN | 112896827 | A | 6/2021 |
| CN | 213706178 | U | 7/2021 |
| CN | 113291648 | A | 8/2021 |
| CN | 113291649 | A | 8/2021 |
| CN | 214058247 | U | 8/2021 |
| CN | 214190562 | U | 9/2021 |
| CN | 214242101 | U | 9/2021 |
| CN | 113501220 | A | 10/2021 |
| CN | 214341424 | U | 10/2021 |
| CN | 214453818 | U | 10/2021 |
| CN | 109986255 | B | 11/2021 |
| CN | 214608970 | U | 11/2021 |
| CN | 214649733 | U | 11/2021 |
| CN | 214825035 | U | 11/2021 |
| CN | 214876350 | U | 11/2021 |
| CN | 214876351 | U | 11/2021 |
| CN | 214877271 | U | 11/2021 |
| CN | 113751935 | A | 12/2021 |
| CN | 113800079 | A | 12/2021 |
| CN | 113800080 | A | 12/2021 |
| CN | 113830393 | A | 12/2021 |
| CN | 215044727 | U | 12/2021 |
| CN | 215053960 | U | 12/2021 |
| CN | 215156568 | U | 12/2021 |
| CN | 215206473 | U | 12/2021 |

(56) References Cited

FOREIGN PATENT DOCUMENTS

| | | | |
|---|---|---|---|
| CN | 215206475 | U | 12/2021 |
| CN | 215206546 | U | 12/2021 |
| CN | 215206547 | U | 12/2021 |
| CN | 215246236 | U | 12/2021 |
| CN | 215246257 | U | 12/2021 |
| CN | 215324662 | U | 12/2021 |
| CN | 215362933 | U | 12/2021 |
| CN | 113968400 | A | 1/2022 |
| CN | 215400729 | U | 1/2022 |
| CN | 215624175 | U | 1/2022 |
| CN | 215737787 | U | 2/2022 |
| CN | 215754314 | U | 2/2022 |
| CN | 215754342 | U | 2/2022 |
| CN | 105314294 | B | 3/2022 |
| CN | 114142137 | A | 3/2022 |
| CN | 114248993 | A | 3/2022 |
| CN | 215922843 | U | 3/2022 |
| CN | 215944818 | U | 3/2022 |
| CN | 216076045 | U | 3/2022 |
| CN | 216101731 | U | 3/2022 |
| CN | 216103278 | U | 3/2022 |
| CN | 216103904 | U | 3/2022 |
| CN | 216103927 | U | 3/2022 |
| CN | 111940971 | B | 4/2022 |
| CN | 114275388 | A | 4/2022 |
| CN | 114313648 | A | 4/2022 |
| CN | 216195453 | U | 4/2022 |
| CN | 216234098 | U | 4/2022 |
| CN | 216402569 | U | 4/2022 |
| CN | 216467949 | U | 5/2022 |
| CN | 216508449 | U | 5/2022 |
| CN | 216510641 | U | 5/2022 |
| CN | 216510680 | U | 5/2022 |
| CN | 216547258 | U | 5/2022 |
| CN | 216547259 | U | 5/2022 |
| CN | 216547260 | U | 5/2022 |
| CN | 216547816 | U | 5/2022 |
| CN | 216564988 | U | 5/2022 |
| CN | 216564989 | U | 5/2022 |
| CN | 216581582 | U | 5/2022 |
| CN | 216617010 | U | 5/2022 |
| CN | 216637570 | U | 5/2022 |
| CN | 114620360 | A | 6/2022 |
| CN | 216685793 | U | 6/2022 |
| CN | 216709987 | U | 6/2022 |
| CN | 216762522 | U | 6/2022 |
| CN | 216762560 | U | 6/2022 |
| CN | 104909082 | B | 7/2022 |
| CN | 111874474 | B | 7/2022 |
| CN | 112325554 | B | 7/2022 |
| CN | 216888281 | U | 7/2022 |
| CN | 216888324 | U | 7/2022 |
| CN | 216896768 | U | 7/2022 |
| CN | 216944041 | U | 7/2022 |
| CN | 216944538 | U | 7/2022 |
| CN | 216995856 | U | 7/2022 |
| CN | 216995867 | U | 7/2022 |
| CN | 216995916 | U | 7/2022 |
| CN | 217049967 | U | 7/2022 |
| CN | 217049989 | U | 7/2022 |
| CN | 111746958 | B | 8/2022 |
| CN | 114852538 | A | 8/2022 |
| CN | 114940316 | A | 8/2022 |
| CN | 217100212 | U | 8/2022 |
| CN | 217199536 | U | 8/2022 |
| CN | 217202317 | U | 8/2022 |
| CN | 113525601 | B | 9/2022 |
| CN | 115036617 | A | 9/2022 |
| CN | 115043063 | A | 9/2022 |
| CN | 115072125 | A | 9/2022 |
| CN | 115133157 | A | 9/2022 |
| CN | 217372322 | U | 9/2022 |
| CN | 217375300 | U | 9/2022 |
| CN | 217436460 | U | 9/2022 |
| CN | 217436624 | U | 9/2022 |
| CN | 217436670 | U | 9/2022 |
| CN | 217436671 | U | 9/2022 |
| CN | 217444530 | U | 9/2022 |
| CN | 217478103 | U | 9/2022 |
| CN | 217478111 | U | 9/2022 |
| CN | 217492760 | U | 9/2022 |
| CN | 217503325 | U | 9/2022 |
| CN | 112027293 | B | 10/2022 |
| CN | 115199936 | A | 10/2022 |
| CN | 115240760 | A | 10/2022 |
| CN | 217599379 | U | 10/2022 |
| CN | 217599384 | U | 10/2022 |
| CN | 217599385 | U | 10/2022 |
| CN | 217599386 | U | 10/2022 |
| CN | 217624722 | U | 10/2022 |
| CN | 217650043 | U | 10/2022 |
| CN | 217673884 | U | 10/2022 |
| CN | 217673885 | U | 10/2022 |
| CN | 114084536 | B | 11/2022 |
| CN | 115298114 | A | 11/2022 |
| CN | 115303657 | A | 11/2022 |
| CN | 115321038 | A | 11/2022 |
| CN | 115367315 | A | 11/2022 |
| CN | 115410740 | A | 11/2022 |
| CN | 115411428 | A | 11/2022 |
| CN | 217731474 | U | 11/2022 |
| CN | 217755038 | U | 11/2022 |
| CN | 217788757 | U | 11/2022 |
| CN | 217806526 | U | 11/2022 |
| CN | 217918934 | U | 11/2022 |
| CN | 217919500 | U | 11/2022 |
| CN | 217919501 | U | 11/2022 |
| CN | 217919512 | U | 11/2022 |
| CN | 217919543 | U | 11/2022 |
| CN | 217919544 | U | 11/2022 |
| CN | 111619970 | B | 12/2022 |
| CN | 113460518 | B | 12/2022 |
| CN | 217945900 | U | 12/2022 |
| CN | 217945901 | U | 12/2022 |
| CN | 217946320 | U | 12/2022 |
| CN | 217970359 | U | 12/2022 |
| CN | 217999101 | U | 12/2022 |
| CN | 115557119 | A | 1/2023 |
| CN | 115593752 | A | 1/2023 |
| CN | 115610307 | A | 1/2023 |
| CN | 218199402 | U | 1/2023 |
| CN | 218229184 | U | 1/2023 |
| CN | 218229907 | U | 1/2023 |
| CN | 218344012 | U | 1/2023 |
| CN | 218368916 | U | 1/2023 |
| CN | 218390881 | U | 1/2023 |
| CN | 218401979 | U | 1/2023 |
| CN | 218401981 | U | 1/2023 |
| CN | 218401985 | U | 1/2023 |
| CN | 218401994 | U | 1/2023 |
| CN | 218405824 | U | 1/2023 |
| CN | 218406717 | U | 1/2023 |
| CN | 218406723 | U | 1/2023 |
| CN | 218406727 | U | 1/2023 |
| CN | 218409542 | U | 1/2023 |
| CN | 107235253 | B | 2/2023 |
| CN | 115703570 | A | 2/2023 |
| CN | 218513187 | U | 2/2023 |
| CN | 107226298 | B | 3/2023 |
| CN | 107237975 | B | 3/2023 |
| CN | 115725155 | A | 3/2023 |
| CN | 115817972 | A | 3/2023 |
| CN | 115818033 | A | 3/2023 |
| CN | 115818034 | A | 3/2023 |
| CN | 218559579 | U | 3/2023 |
| CN | 218559681 | U | 3/2023 |
| CN | 218704681 | U | 3/2023 |
| CN | 218704687 | U | 3/2023 |
| CN | 218705700 | U | 3/2023 |
| CN | 218752013 | U | 3/2023 |
| CN | 114249033 | B | 4/2023 |
| CN | 115892772 | A | 4/2023 |
| CN | 115892776 | A | 4/2023 |
| CN | 115946987 | A | 4/2023 |

(56) References Cited

FOREIGN PATENT DOCUMENTS

| | | | |
|---|---|---|---|
| CN | 115953726 | A | 4/2023 |
| CN | 115958809 | A | 4/2023 |
| CN | 115973623 | A | 4/2023 |
| CN | 218807287 | U | 4/2023 |
| CN | 218859212 | U | 4/2023 |
| CN | 218876781 | U | 4/2023 |
| CN | 218887366 | U | 4/2023 |
| DE | 4429483 | A1 | 2/1996 |
| DE | 29703167 | U1 | 4/1997 |
| DE | G87152967 | U1 | 1/1998 |
| DE | 102009020599 | A1 | 11/2010 |
| DE | 202018000701 | U1 | 2/2018 |
| EP | 0321859 | A2 | 6/1989 |
| EP | 1136389 | A2 | 9/2001 |
| EP | 1375355 | A2 | 1/2004 |
| EP | 1683727 | A1 | 7/2006 |
| EP | 2192021 | A2 | 6/2010 |
| EP | 2615041 | B1 | 3/2015 |
| EP | 4065911 | B1 | 11/2023 |
| JP | S51104837 | U | 8/1976 |
| JP | H06199347 | A | 7/1994 |
| JP | H07232789 | A | 9/1995 |
| JP | H09012133 | A | 1/1997 |
| JP | H09287879 | A | 11/1997 |
| JP | H10053222 | A | 2/1998 |
| JP | H1080671 | A | 3/1998 |
| JP | 2001278383 | A | 10/2001 |
| JP | 2002308267 | A | 10/2002 |
| JP | 2003237780 | A | 8/2003 |
| JP | 2005081534 | A | 3/2005 |
| JP | 2007161258 | A | 6/2007 |
| JP | 3133715 | U | 7/2007 |
| JP | 2008100698 | A | 5/2008 |
| JP | 2016060532 | A | 4/2016 |
| JP | 2019001526 | A | 1/2019 |
| JP | 2019189354 | A | 10/2019 |
| JP | 6859458 | B2 | 4/2021 |
| KR | 20120006954 | U | 10/2012 |
| KR | 200465521 | Y1 | 2/2013 |
| KR | 101375806 | B1 | 3/2014 |
| KR | 101641906 | B1 | 7/2016 |
| KR | 20170102666 | A | 9/2017 |
| KR | 101824568 | B1 | 3/2018 |
| NL | 1013830 | C2 | 6/2001 |
| TW | 201408550 | A | 3/2014 |
| WO | 9813284 | A1 | 4/1998 |
| WO | 0156898 | A1 | 8/2001 |
| WO | 2007111618 | A1 | 10/2007 |
| WO | 2007129986 | A1 | 11/2007 |
| WO | 2015053437 | A1 | 4/2015 |
| WO | 2017058767 | A1 | 4/2017 |
| WO | 2022096928 | A1 | 5/2022 |

OTHER PUBLICATIONS

Patent Cooperation Treaty, International Search Report and Written Opinion of the International Searching Authority for International Application No. PCT/IB2023/063198 dated Apr. 16, 2024, 17 pages.

* cited by examiner

COLLAPSIBLE CRATE AND RELATED METHODS

CROSS-REFERENCE TO RELATED APPLICATIONS

This application is a continuation of prior application Ser. No. 19/135,027, filed Jun. 2, 2025, which is a U.S. National Phase Application filed under 35 U.S.C. § 371 of International Application Number PCT/IB2023/063198, filed Dec. 22, 2023, designating the United States, which claims benefit of U.S. Provisional Application No. 63/435,966, filed Dec. 29, 2022, which are hereby incorporated herein by reference in their entirety.

FIELD

The present disclosure generally relates to storage and transportation crates and, in particular, to collapsible crates.

BACKGROUND

Crates are used to transport and store goods and merchandise. When a crate is not being used, the crate typically takes up the same amount of space as when it is filled. Thus, when transporting or storing empty crates, the crates take up a lot of space, for example, on a transport vehicle or in a warehouse. Some crates have walls that are removeable from the base. The walls may then be removed and placed on top of the base of the crate or elsewhere for transportation or storage. In another approach, the walls of the crate may be folded inward and positioned on top of the base of the crate.

In the prior art approaches, however, the walls remain vulnerable to impact and damage. Further, the walls may still take up additional space beyond the general dimensions of the base of the crate. Moreover, many crates are transported using forklifts and similar tools. To accommodate such tools, crates must be configured with bases that accept the lifting and transporting structure. When bases are configured in this manner, it can be especially difficult to configure a crate that permits one or more walls to collapse onto the base.

Pallets are also used to transport and store goods and merchandise. Pallets are generally not able to be stacked without an upper pallet resting on the items of the lower pallet, which may damage the goods of the lower pallet. Furthermore, the stack of pallets may be relatively unstable limiting how high the pallets may be stacked. Pallet racks are often used to stack pallets vertically to conserve space. Where such pallet racking is not available, however, the pallets may not be able to be stacked vertically and thus take up space on the floor of a storage location or transport vehicle.

A need exists for a crate that can be collapsed to reduce its size while still preventing the walls from becoming bent, dented, or disassociated from the rest of the crate.

DETAILED DESCRIPTION

Figure 1:
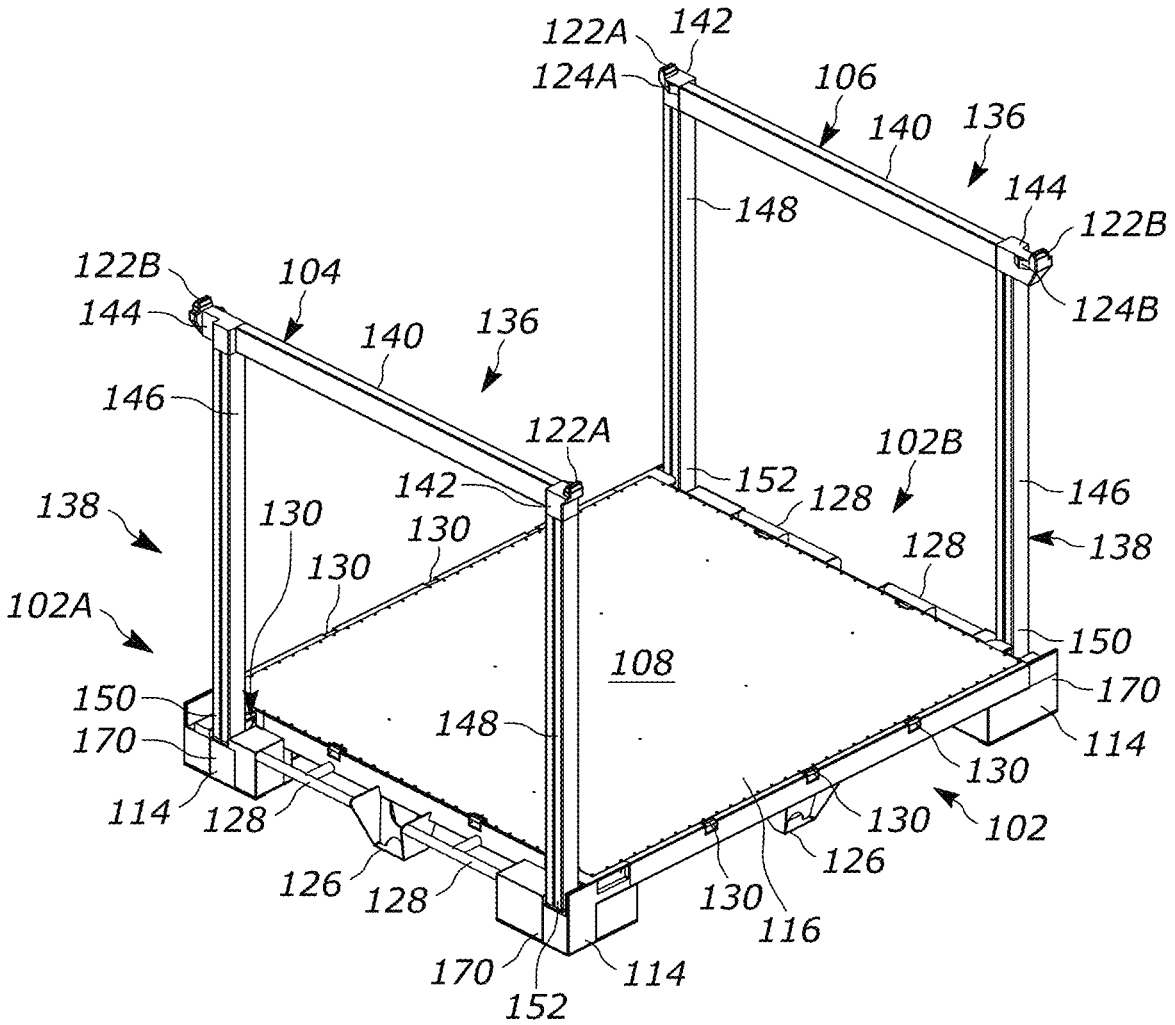
FIG. 1 is a top perspective view of a collapsible crate having a base and side frames in an assembled configuration.
Figure 2:
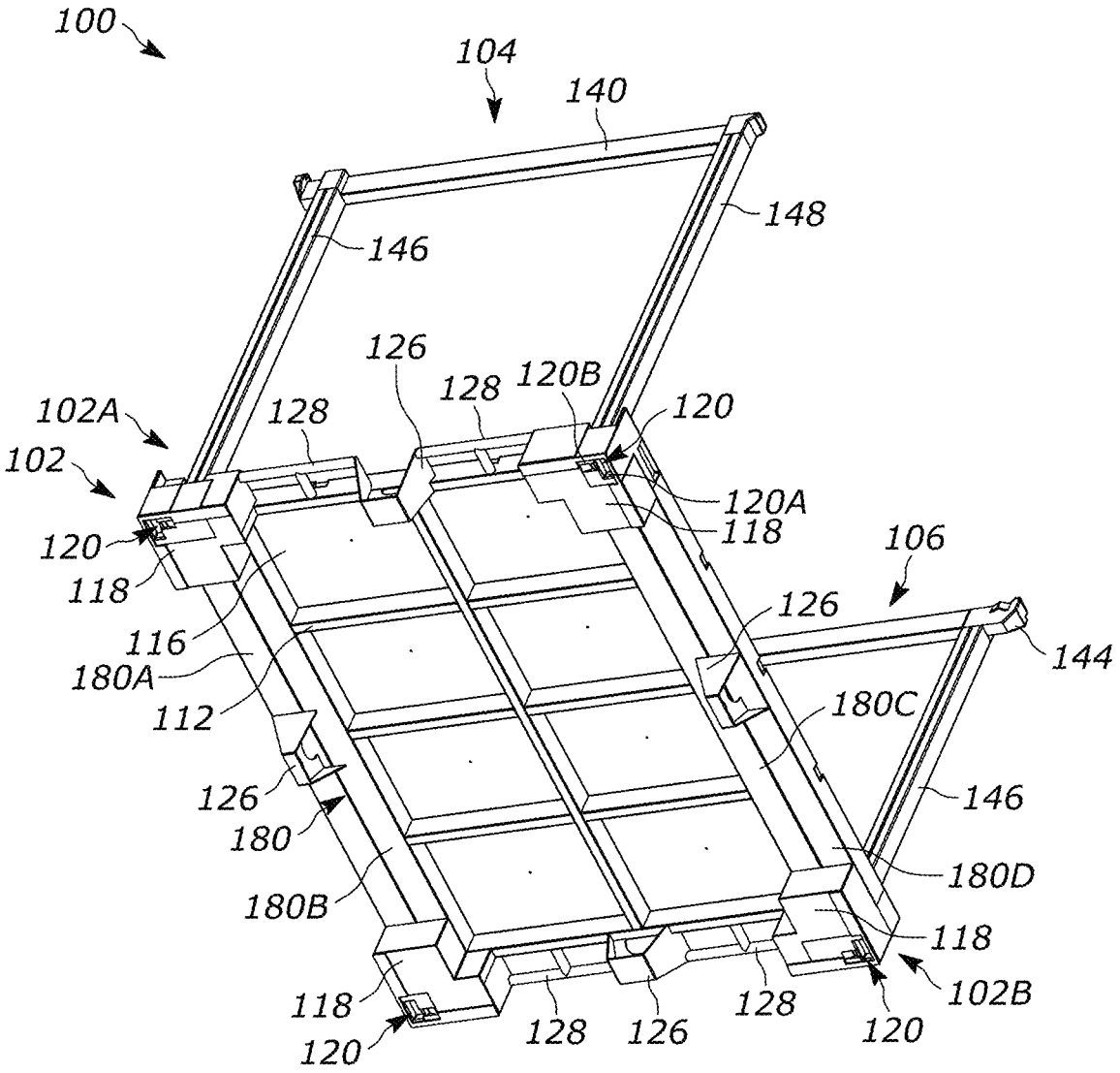
FIG. 2 is a bottom perspective view of the collapsible crate of FIG. 1.

With respect to FIGS. 1-2, a stackable transport structure such as a stackable pallet or collapsible crate 100 is provided having a base 102 and side frames 104, 106. The base 102 has a supporting surface 108 and a receptacle 110 below the supporting surface 108. In FIGS. 1-2, the crate 100 is in a crate form or an assembled configuration where the side frames 104, 106 are secured to the base 102 and extend upright from the supporting surface 108. The first side frame 104 extends upward from a first end portion 102A of the base 102 and the second side frame 104 extends upward from a second end portion 120B of the base 102. As discussed in further detail below, the base 102 may include locking recesses 132 (see, e.g., FIGS. 10A-10B, 12A-12B) configured to receive the lower ends of the side frames 104, 106 to hold the side frames 104, 106 upright with respect to the supporting surface 108. One or more items (e.g., goods, merchandise) may be stacked on the supporting surface 108 of the base 102 for transport and/or storage. The side frames 104, 106 extend upward above the supporting surface 108 to permit another pallet or crate 100 to be stacked on the crate 100 and above the items on the supporting surface 108 as discussed in further detail below.

The receptacle 110 of the base 102 includes tracks 180 (see also FIGS. 9B-9C) along which the side frames 104, 106 may slide when the crate 100 is moved between the crate form/assembled configuration and a pallet form or collapsed configuration (see FIG. 8A) as discussed in further detail below. The side frames 104, 106 may be stowed in the receptacle 110, for example, to reduce the size of the collapsible crate 100 when the crate 100 is not being used or when the crate 100 is used to transport items similar to a conventional pallet and/or is not being stacked with other crates 100. The crate 100 may thus be a hybrid between a traditional crate and traditional pallet. The side frames 104, 106 enable the crate 100 to be stably stacked without resting on the goods of the lower crate 100 and may be stored in the base 102 to use or store the crate 100 similar to a traditional pallet.

The base 102 includes a support frame 112 and corner portions 170 having foot members 114 coupled to and extending from the support frame 112. The support frame 112 is formed of a grid of support members. A support wall 116 including the supporting surface 108 may be mounted to an upper side of the support frame 112. The support wall 116 may be formed of a sheet metal to provide a flat surface that is strong and durable. In other embodiments, the support wall 116 is a plurality of slats or a mesh or grid, such that it is not a solid surface. In other forms, the support wall 116 may be formed of other materials, such as wood, polymers, etc., and combinations thereof.

The foot members 114 space the support frame 112 from the surface on which the base 102 of the crate 100 rests, for example, a floor or another crate 100. The foot members 114 may provide sufficient space below the support frame 112, for example, for the forks of a lifting device (e.g., a forklift and/or pallet jack) to be inserted between the foot members below the support frame 112. The forks may engage the bottom side of the support frame 112 to lift the crate 100 for transport. The bottom side 118 of the foot members 114 may include recesses 120 sized and shaped to receiving a stacking protrusion 122A, 122B and/or a nesting protrusion 124A, 124B of the side frame 104, 106 of another crate 100. For example, the recesses 120 of the base 102 may be aligned with and lowered onto the protrusions 122A, 122B of another crate 100 that is in the assembled configuration to stack the crates 100. The recesses 120 permit the protrusions 122A, 122B of a crate 100 to interlock with the recesses 120 of the base 102 of the crate 100 to inhibit the crates 100 from moving laterally relative to one another. The recesses 120 of the base 102 may similarly be aligned and lowered onto protrusions 124A, 124B of another crate 100 that is in the collapsed configuration to stack the crates 100.

The base 102 may include support members 126 along the sides of the base 102 between foot members 114. The support members 126 may be positioned at a midpoint between foot members 114 along a side. Positioning the support members 126 at the midpoint may permit the forks of a lifting device to be positioned about or straddle the support member 126. The support members 126 may aid to support the support frame 112 from the surface on which the base 102 rests. The support members 126 may aid in inhibiting the support frame 112 from bending or flexing under the weight of the items on the supporting surface 108.

The base 102 may include protector bars 128 extending from the foot members 114 to the support members 126. The protector bars 128 may be positioned beneath crossmember 140 of the side frames 104, 106 when the side frames 104, 106 are stowed in the receptacle 110 of the base 102 (see FIG. 8A). The protector bars 128 may protect the side frames 104, 106 from damage by making the side frames 104, 106 less vulnerable to contact and thus less vulnerable to damage. For example, the forks of a lifting device inserted beneath the support frame 112 will contact the protector bars 128 rather than the side frames 104, 106 which may inhibit the forks from damaging the side frames 104, 106, for example, when the side frames 104, 106 are stowed in the base 102. Protecting the side frames 104, 106 from damage (e.g., bending) is important because the side frames 104 may need to bear significant loads when used to support one or more other crates 100 when stacking multiple crates 100.

The base 102 may include one or more loops 130 to which a strap may be connected or passed through. The straps may be used to secure the items on the supporting surface 108 to the crate 100, for example, by connecting the straps to the loops 130.

The length and width dimensions of the base 102 vary according to each application. The base 102 may have length and width dimensions that correspond to standard pallet sizes, for example, standard pallet sizes commonly used in North America, Australia, Europe, and Asia. As examples, the width by length dimensions (in millimeters) of the pallet may be: 1,016×1,219; 1,000×1,200; 1,165×1,165; 1,067×1,067; 1,100×1,100; or 800×1,200.

The base 102 may be formed of rigid materials including, as examples, metal (e.g., steel) and/or plastic.

Figure 3:
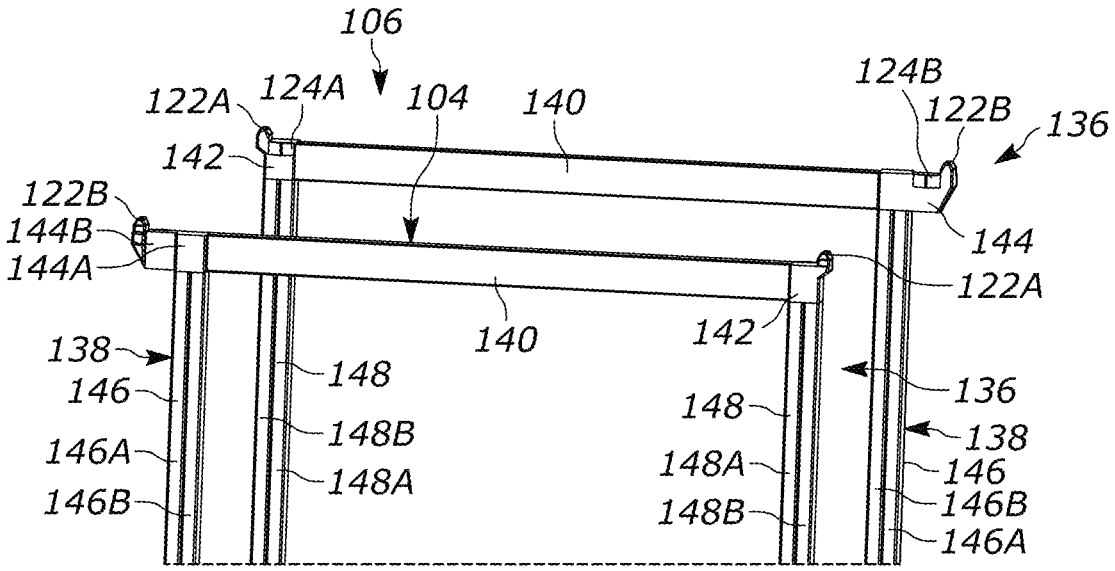
FIG. 3 is a perspective view of an upper portion of side frames of the collapsible crate of FIG. 1.

With respect to FIGS. 1-3, the side frame 104 includes an upper portion 136 and a lower portion 138. The side frame 104 may be formed of a metal (e.g., steel), plastics, and/or other rigid materials. The upper portion 136 includes a crossmember 140, a coupler 142, and an extension coupler 144. The lower portion 138 includes a first side portion, such as a first leg 146, and a second side portion, such as second leg 148. The first leg 146 is connected to and extends from the extension coupler 144 to the base 102. The second leg 148 is connected to and extends from the coupler 142 to the base 102. The lower end portions 150, 152 of the first and second legs 146, 148 may be inserted into the locking recesses 132 of the base 102 when the crate 100 is in the assembled configuration to secure the side frame 104 in the upright position relative to the base 102. The legs 146, 128 may each include a guide pin 154 mounted thereto (see FIG. 11) that extend laterally outward from the legs 146, 148. The guide pin 154 engages a guide slot 172 to guide the lower end portions 150, 152 of the legs 146, 148 as the side frame 104, 106 is moved between the assembled and collapsed configurations as discussed in further detail below.

The legs 146, 128 may rest on track support surfaces 182 of the receptacle 110 of the base 102 when in the collapsed configuration. The crossmember 140 extends between the first and second legs 146, 148 from the coupler 142 to the extension coupler 144. In the form shown, the first leg 146 is formed of two tubes 146A, 146B welded together and the second leg 148 is formed of two tubes 148A, 148B welded together. The tubes 146A, 146B and tubes 148A, 148B may have a rectangular cross-section and be coupled along the length of the rectangular cross-section of the tubes (see FIG. 9C). Forming the legs 146, 148 from two tubes 146A, 146B or 148A, 148B may increase the strength of the legs 146, 148 and increase the load the side frame 104 is able to support. The tubes of the legs 146, 146 may be hollow to reduce the weight of the legs. In other forms, the legs 146, 148 are solid to provide increased strength and rigidity. In some forms, the legs 146, 148 may be formed of a single tube rather than two tubes attached together. The tube may have any cross-sectional shape including, as example, rectangular, square, circular, or triangular. In some forms, the legs 146, 148 are not tubular but be structural members of other cross-sectional shapes such as an I-shaped or L-shaped cross-section.

Figure 4:
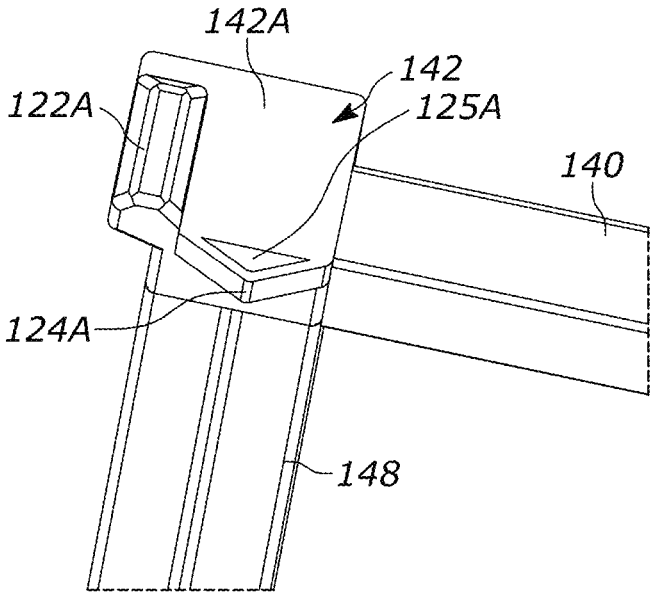
FIG. 4 is a top perspective view of a coupler of a side frame of the collapsible crate of FIG. 1 having a stacking protrusion and nesting protrusion.

With respect to FIG. 4, the coupler 142 includes a stacking protrusion 122A and the nesting protrusion 124A. The coupler 142 may be formed of a metal (e.g., steel), plastics, and/or other rigid materials. The stacking protrusion 122A extends upward from a body 142A of the coupler 142 in the direction of the second leg 148. Thus, when the side frame 104 is in the assembled configuration, the stacking protrusion 122A extends upward from the base 102. The stacking protrusion 122A is configured to be inserted into a recess 120 in the bottom side of another crate 100 when the crates 100 are stacked on one another in the assembled configurations as discussed below with respect to FIGS. 16-17B. The stacking protrusion 122A may be elongate and/or have a shape corresponding to a shape of the recess 120 of the base 102 the stacking protrusion 122A is inserted into to inhibit the crate 100 from rotating or pivoting about the protrusion 122A. The sides of the stacking protrusion 122A may slope inward as the stacking protrusion extends from the body 142A of the coupler 142 to aid in guiding the stacking protrusion 122A into the recess 120 to aid in aligning the crates 100 when stacked upon one another.

Figure 8A:
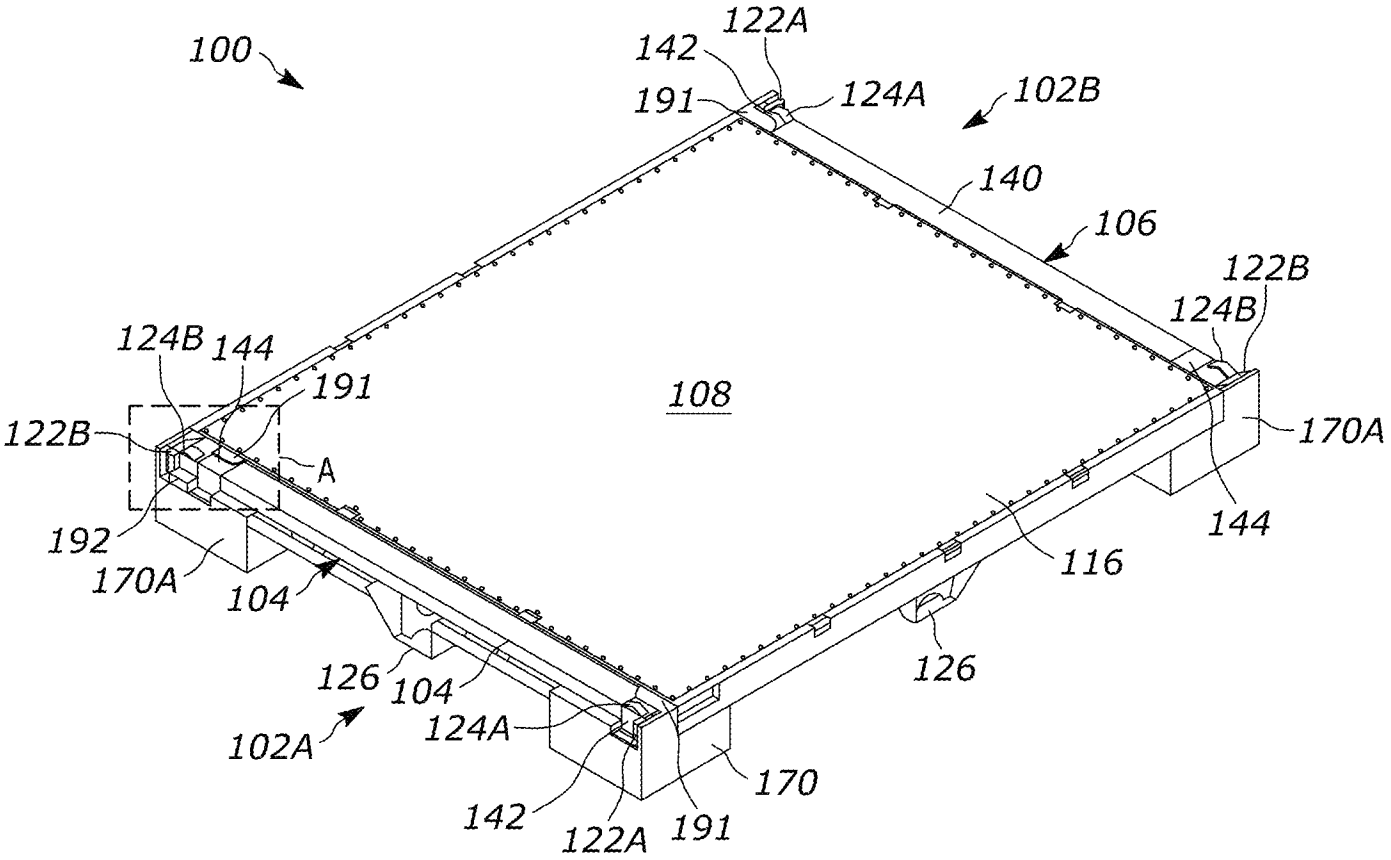
FIG. 8A is a top perspective view of the collapsible crate of FIG. 1 in a collapsed configuration.

The nesting protrusion 124A extends substantially perpendicular to the stacking protrusion 122A such that the nesting protrusion 124A extends upward from the base 102 when the crate 100 is in the collapsed configuration with the side frame 104 stowed in the base 102 (see FIG. 8A). The nesting protrusion 124A may be an angled strip secured to and protruding from the body 142A of the coupler 142 such that the nesting protrusion 124A has a triangular profile. The nesting protrusion 124A may define an opening 125A between the nesting protrusion 124A and the body 142A of the coupler 142 which may be used to secure the extension member 200 to the crate 100 as described below. The nesting protrusions 124A may be formed of a bent strip of metal welded to the body 142A of the coupler 142. The nesting protrusion 124A is configured to be inserted into the recess 120 in the bottom side of another crate 100 when the crates 100 are stacked on one another in the collapsed configurations as discussed below with respect to FIGS. 18-19B. The nesting protrusion 124A may be elongate and/or have a shape corresponding to a shape of the recess 120 of the base 102 the that the nesting protrusion 124A is inserted into to inhibit the crate 100 from rotating or pivoting about the protrusion 124A. The nesting protrusion 124A may slope inward as the stacking protrusion extends from the body 142A of the coupler 142 to aid in guiding the nesting protrusion 124A into the recess 120 to aid in aligning the crates 100 when stacked upon one another.

Figure 5:
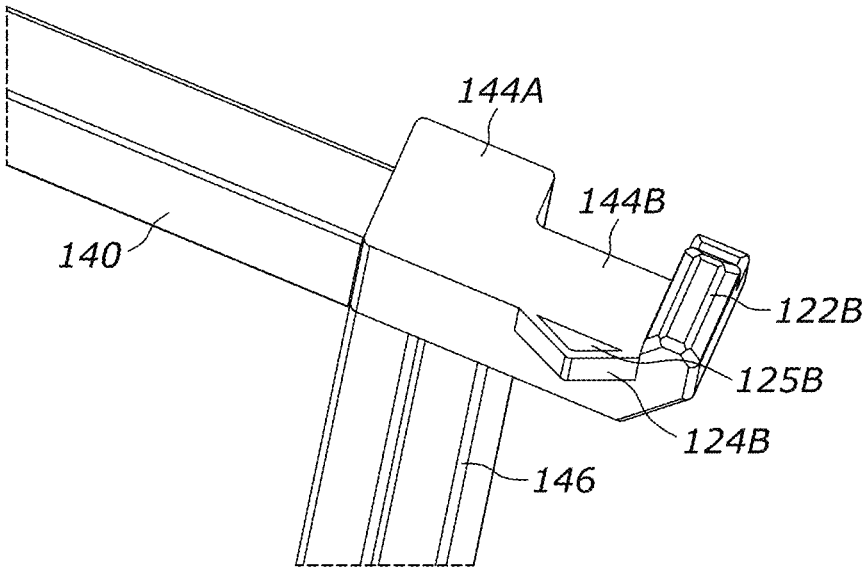
FIG. 5 is a top perspective view of an extension coupler of the side frame of the collapsible crate of FIG. 1 having a stacking protrusion and nesting protrusion supported by an extension.

With respect to FIG. 5, the extension coupler 144 is similar to the coupler 142 of FIG. 4 with the primary difference being that in the extension coupler 144, a body 144A of the extension coupler 144 has an extension portion 144B that extends laterally from the leg 146 of the side frame to which the extension coupler 144 is mounted. The extension coupler 144 includes a stacking protrusion 122B and a nesting protrusion 124B that may be similar to the stacking and nesting protrusions 122A, 124A of the coupler 142 of FIG. 4. The extension coupler 144 may be formed of a metal (e.g., steel), plastics, and/or other rigid materials. The nesting protrusion 124B may define an opening 125B which may be used to secure the extension member 200 to the crate 100. The stacking and nesting protrusions 122B, 124B are mounted to the extension portion 144B such that the stacking and nesting protrusions 122B, 124B are supported laterally from the leg of the side frame.

With reference again to FIGS. 1-3, the second side frame 106 is similar to the first side frame 104 such that the same reference numerals used with respect to side frame 104 are used for similar features of side frame 106. The second side frame 106 includes an upper portion 136 which includes a crossmember 140, a coupler 142, and an extension coupler 144 and a lower portion 138 including a first side portion, such as a first leg 146, and a second side portion, such as second leg 148. The second side frame 106 may be identical to the first side frame 104 and attached to the second end portion 102B of the crate 100.

Figure 6:
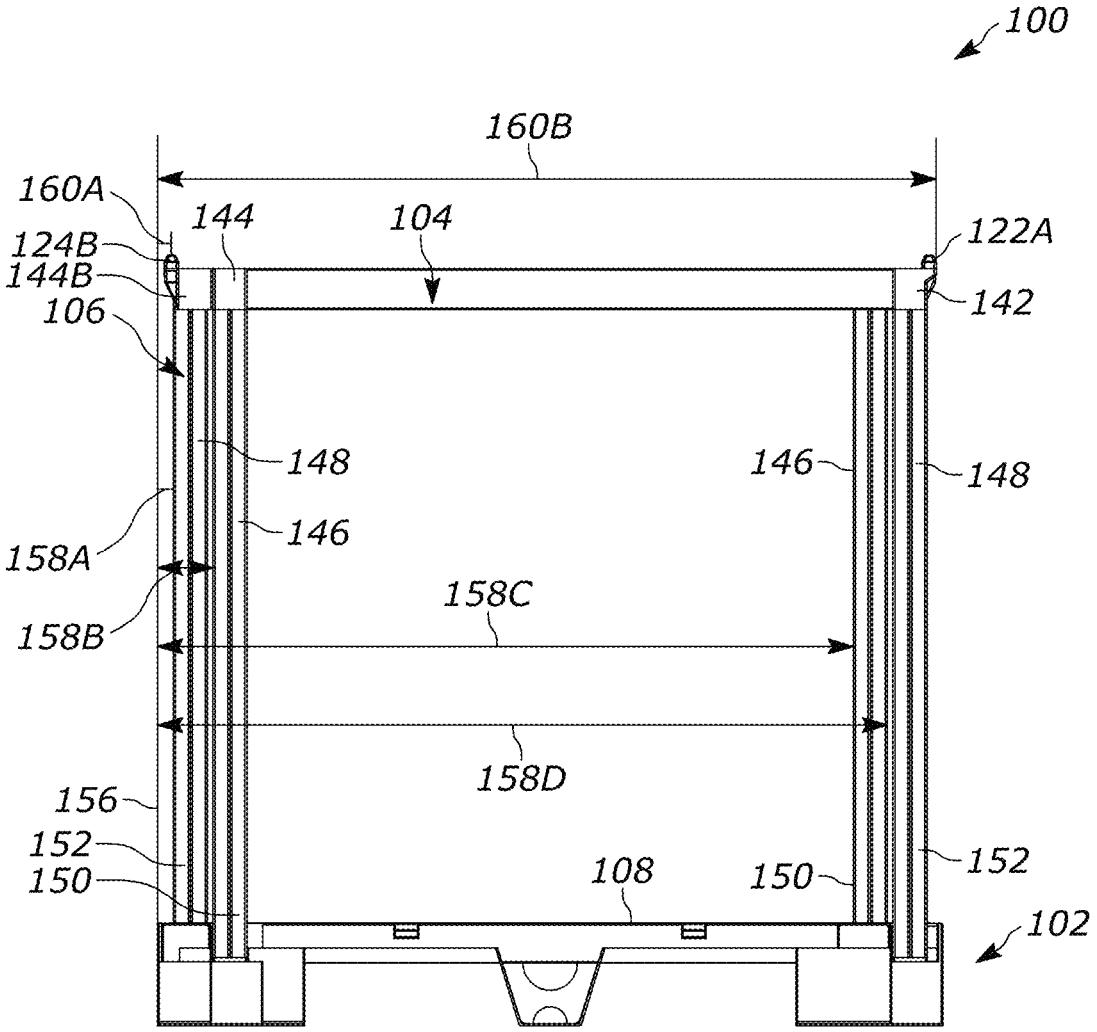
FIG. 6 is a side elevation view of the collapsible crate of FIG. 1.

With respect to FIG. 6, a front elevation view of the crate 100 is provided showing that the legs 146, 148 of the first and second side frames 104, 106 are misaligned while the stacking protrusions 122A, 122B of the first and second side frames 104, 106 are aligned with one another when viewed from the front side of the crate 100. Specifically, each of the legs 146, 148 of the side frames 104, 106 are each a different distance 158A, 158B, 158C, 158D from an outer edge or left side plane 156 extending upwardly from the left side of the base 102. With reference also to FIG. 3, the first side frame 104 (at the front of the crate 100) includes an extension coupler 144 on the left side while the second side frame 106 (at the rear of the crate 100) includes a coupler 142. The extension coupler 144 of the first side frame 104 supports the stacking protrusion 122B laterally from the leg 146 such that the stacking protrusion 122B is substantially the same distance 160A from the left side plane 156 as the stacking protrusion 122A of the second side frame 106 and thus aligned. Similarly, the right side of the second side frame 104 includes an extension coupler 144 while the first side frame 104 includes a coupler 142. The extension coupler 144 of the second side frame 106 supports the stacking protrusion 122B laterally from the leg 146 of the second side frame 106 such that the stacking protrusion 122B is substantially the same distance 160B from the left side plane 156 as the stacking protrusion 122A of the first side frame 104 and thus aligned. The nesting protrusions 124A, 124B of the first side frame 104 similarly are aligned with the nesting protrusions 124A, 124B of the second side frame 106 because the extension coupler 144 of the first and second side frames 104, 106 support the nesting protrusion 124B laterally from the associated leg. Each of the legs 146, 148 of the side frames 104, 106 are similarly each a different distance from a right side plane extending upwardly from the right side of the base while the protrusions are aligned as described above.

Staggering the legs of the side frames as described above permits the legs of the side frames 104, 106 to be stowed in the base 102 of the crate 100 in substantially the same vertical plane thereby reducing the height of the base 102 needed to stow the first and second side frames 104, 106. More specifically, as discussed in further detail below, the receptacle 110 of the crate 100 has four tracks 180 for receiving each of the legs of the first and second side frames 104, 106. The tracks 180 extend parallel to one another along substantially the same plane.

Figure 7:
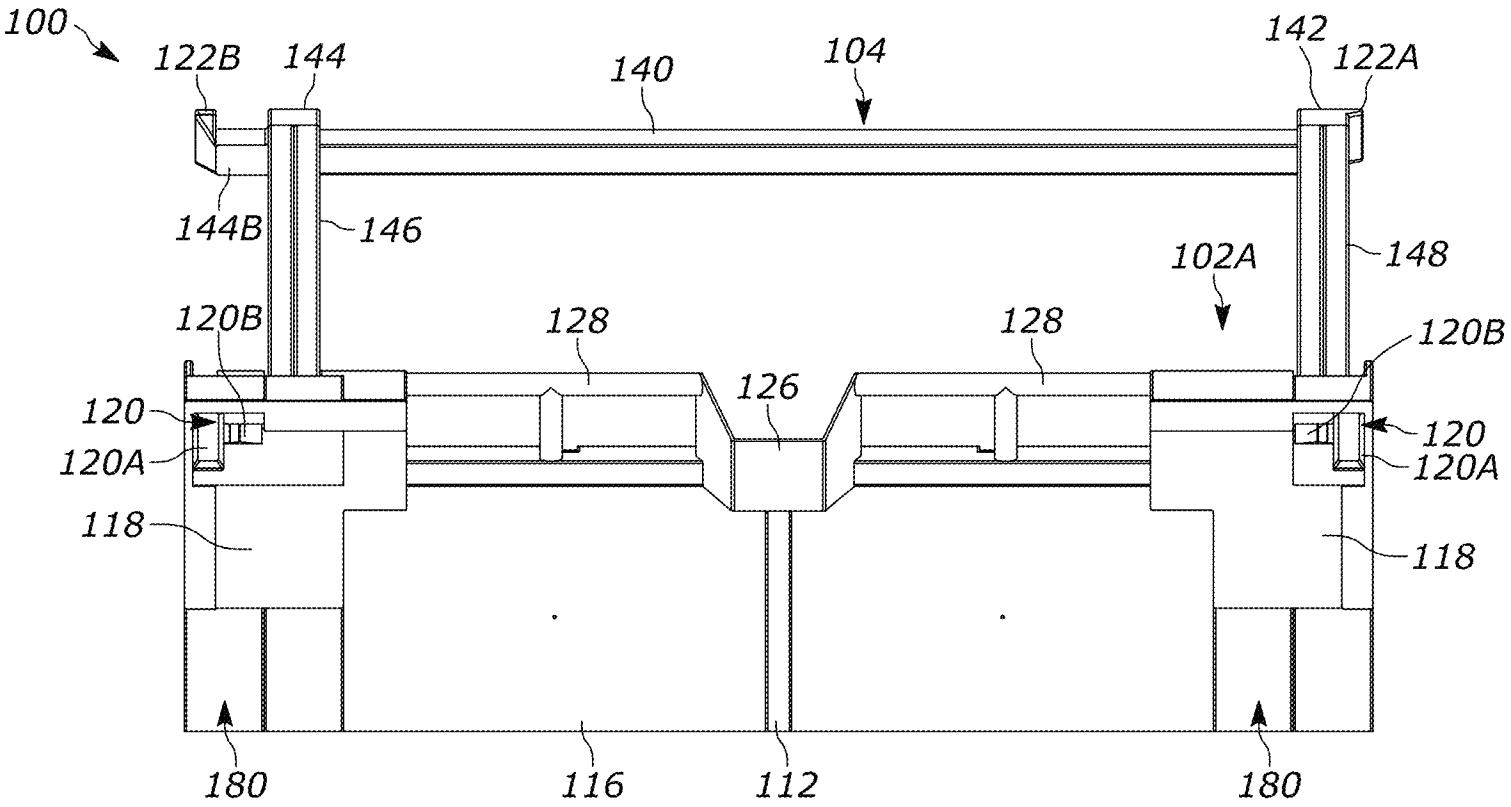
FIG. 7 is a bottom perspective view of an end portion of the collapsible crate of FIG. 1.

Moreover, use of the extension couplers 144 enables the stacking protrusions 122A, 122B and nesting protrusions 124A, 124B of the first and second side frames 104, 106 to remain aligned with one another despite the legs 146, 148 being staggered. The position of the protrusions 122A, 122B, 124A, 124B are thus symmetric about the crate 100 which permits the crates 100 to be easily stacked. For example, the front side of one crate 100 may be aligned with either a front side or a rear side of another crate 100 when stacking. As shown in FIG. 7, the stacking protrusions 122A, 122B of the side frame 104 are aligned with the recesses 120 on bottoms of the foot members 114 of the base 102. The recesses 120 include a first recess portion 120A for receiving the stacking protrusion 122A, 122B of another crate 100. This enables another crate 100 to be stacked on the crate 100 with the stacking protrusions 122A, 122B aligned with and inserted into the recess portion 120A of the other crate 100. The nesting protrusions 124A, 124B of the side frame 104 are similarly aligned with the recesses 120 on the bottoms of the foot members 114 of the base 102. The recesses 120 further include a second recess portion 120B for receiving the nesting protrusions 124A, 124B of another crate 100. This enables another crate 100 to be stacked on the crate 100 with the nesting protrusions 124A, 124B aligned with and inserted into the recess portion 120B of the other crate 100. The protrusions 122A, 122B, 124A, 124B of the second side frame 106 are similarly aligned with the recesses 120 on the second end portion 102B of the base 102.

With respect to FIGS. 8A-9A, the crate 100 is shown in the collapsed configuration with the side frames 104, 106 received into the receptacle 110 of the base 102. In the collapsed configuration, the crate 100 may be used similar to a conventional pallet, for example, the crate 100 is able to be picked up and moved with forks of lifting equipment and used with a palletizer to load item(s) on the supporting surface 108.

Figure 8B:
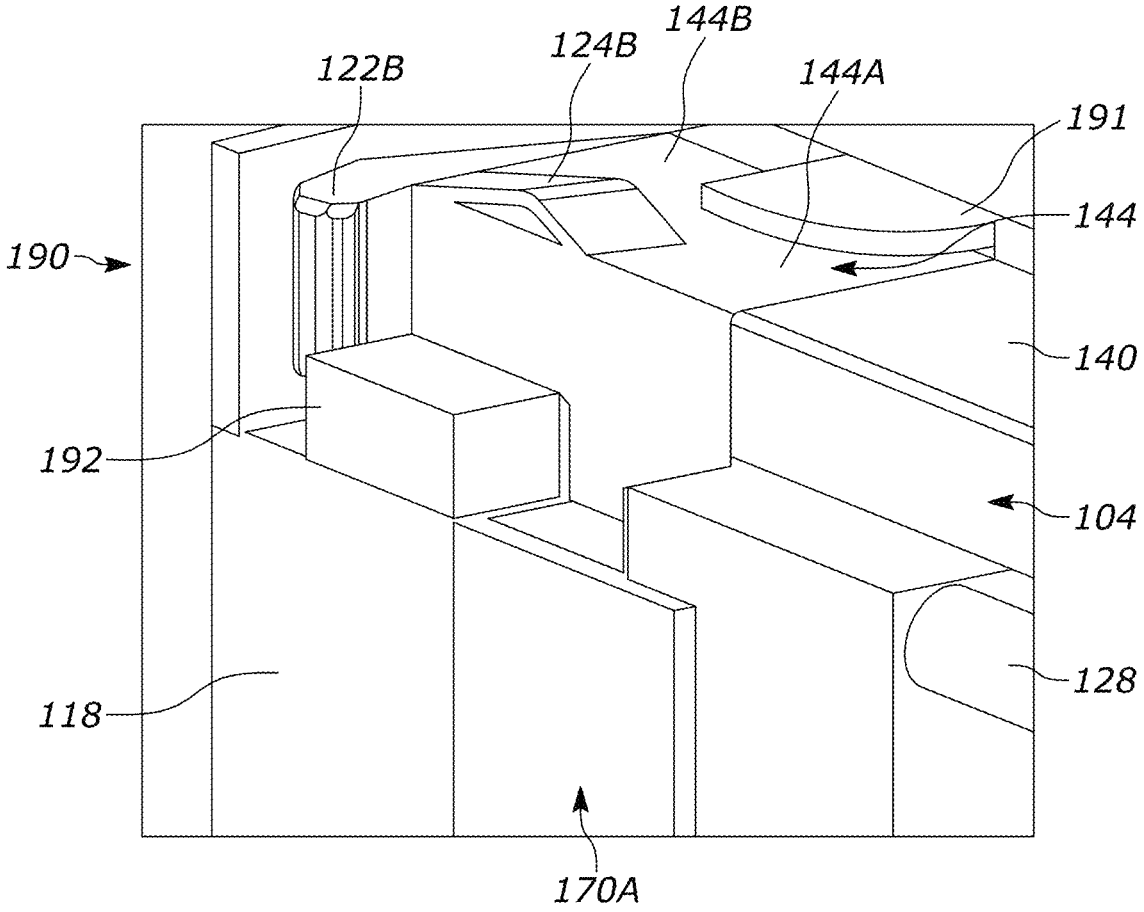
FIG. 8B is a closeup view of portion A of FIG. 8A showing a stop member of the base of the collapsible crate inhibiting the side frame from sliding relative to the base in the collapsed configuration.

With respect to FIG. 8A-8B, corner portions 170A of the base 102 may include a locking mechanism 190 to retain the first and second side frames 104, 106 in the receptacle 110 of the base 102 when the side frames 104, 106 are stowed in the base 102. While the following discussion references the locking mechanism 190 of the corner portion 170A on the first end portion 102A of the base 102, the corner portion 170A of the second end portion 102B of the base 102 similarly may be used to retain the second side frame 106. With respect to FIG. 8B, the corner portion 170A may include a stop protrusion 192. The stop protrusion 192 may be positioned within the pathway of the side frame 104 to inhibit the side frame 104 from sliding outward from the receptacle 110. In the embodiment shown, the stop protrusion 192 engages the extension portion 144B of the extension coupler 144 to limit movement of the side frame 104. To withdraw the side frame 104, the upper portion 136 of the side frame 104 is lifted upward (pivoting the side frame 104 about the end portions 150, 152) until the extension coupler 144 is above the stop protrusion 192 and able to be drawn outward and over the protrusion 192. In some embodiments, the stop protrusion 192 is positioned to engage the crossmember 140 of the side frame 104. To withdraw the side frame 104, the side frame 104 is lifted upward until the crossmember 140 is above the stop protrusion 192 and thus able to be drawn outward and over the protrusion 192.

The locking mechanism 190 of the base 102 may further include flanges 191 at each corner of the base 102. The flanges 191 extend outward and over a portion of the coupler 142, extension coupler 144, and/or crossmembers 140 of the side frames 104, 106 when in the collapsed configuration. The flanges 191 limit the how far the upper portion 136 of the side frames 104, 106 are able to pivot upward which may aid to prevent the side frames 104, 106 from unintentionally passing over the stop protrusions 192, for example, as the crate 100 is subjected to bouncing and vibrations during transport and/or palletizing. The flange 191 thus aid in retaining the side frames 104, 106 in the receptacle 110 of the base 102. The flanges 191 may also contact the end portions 150, 152 of the first and second side frames 104, 106 when in the assembled configurations to inhibit the side frames 104, 106 from pivoting relative to the base 102 and make the side frames 104, 106 more rigid.

Figure 9A:
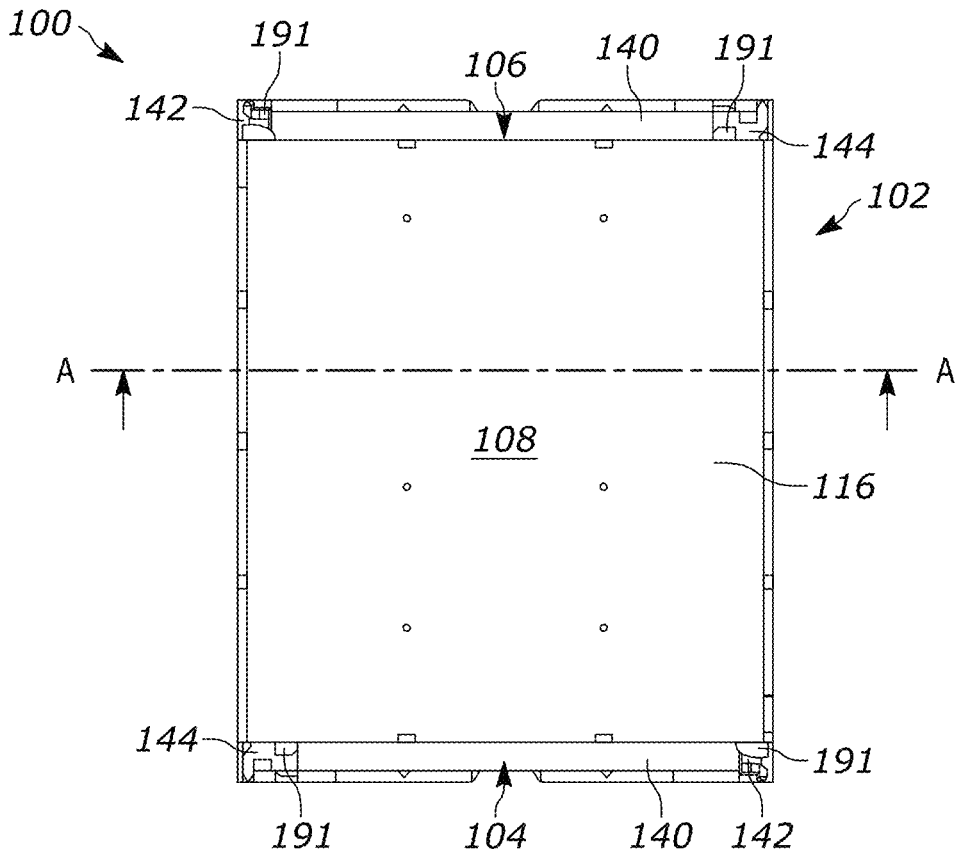
FIG. 9A is a top plan view of the collapsible crate of FIG. 1 in the collapsed configuration of FIG. 8A.
Figure 9B:
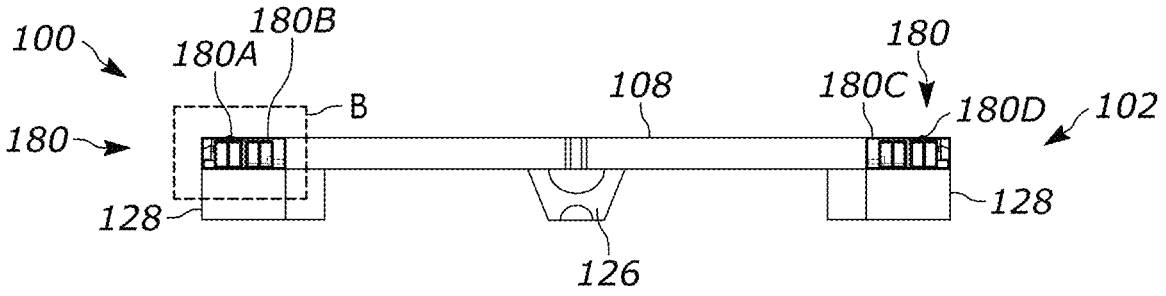
FIG. 9B is a cross-sectional view of the collapsible crate of FIG. 1 taken across line A-A of FIG. 9A.

With reference to FIG. 9B, the receptacle 110 of the base 102 includes four tracks 180 that each receive one leg of the first and second side frames 104, 106 when the crate 100 is in the collapsed configuration. The base 102 includes two tracks 180A, 180B on the left side of the crate 100 and two tracks 180C, 180D on the right side of the crate 100. Tracks 180A, 180C receive the legs 146, 148 of the second side frame 106 and tracks 180B, 180D receive the legs 146, 148 of the first side frame 104. The tracks 180 extend substantially parallel to one another and are in substantially the same vertical plane which is advantageous in reducing the size (e.g., the height) of the base 102 of the crate 100 while permitting the base 102 to receive forks of lifting equipment.

Figure 9C:
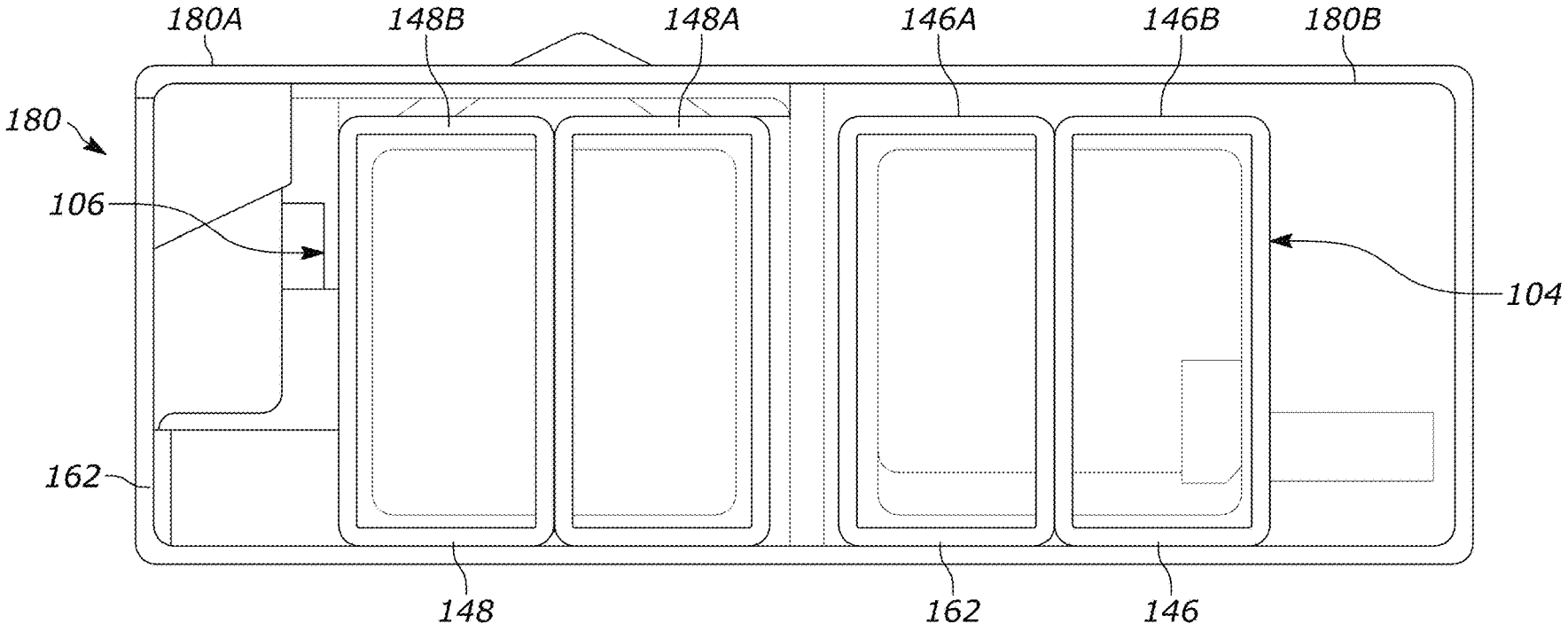
FIG. 9C is a closeup view of portion B of FIG. 9B.

FIG. 9C shows a detail view of portion B of FIG. 9B showing a cross-section of the tracks 180 on the left side of the base 102. The tracks 180 on the right side of the base 102 are similar to those on the left side of the base 102. The tracks 180 each include a track support surface 182 on which the legs of the side frames 104, 106 slide when transitioning between the collapsed and assembled configurations. The legs of the side frames 104, 106 further rest on the track support surface 182 when the side frames 104, 106 are inserted into the receptacle 110 in the collapsed configuration. The tracks 180 may each include left and right sidewalls 184, 186 to guide the legs 146, 148 as they slide along the tracks and to keep the legs 146, 148 aligned with the track. In the form shown, the tracks 180 each include a separate tube 162 having a rectangular cross-section defining an opening larger than the cross-section of the legs 146, 148 of the first and second side frame 104, 106. In other forms, the tracks 180 may include adjacent U-shaped channels that form slots for receiving the associated leg 146, 148 of the side frames 104, 106.

Figure 10A:
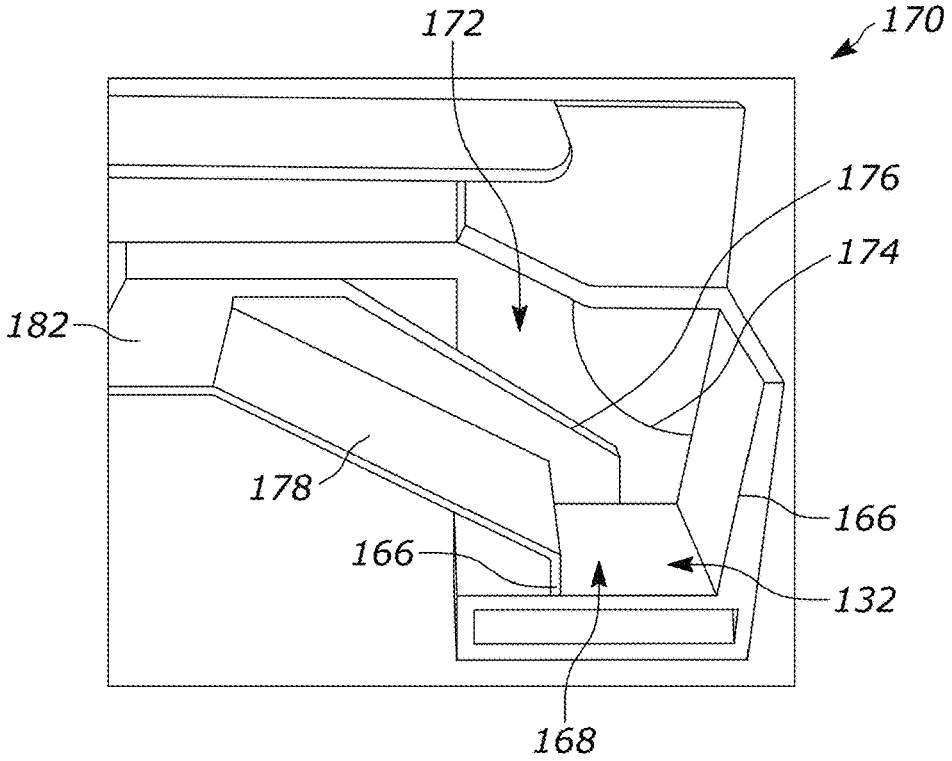
FIG. 10A is a side perspective view of a corner portion of the base of the collapsible crate of FIG. 1 having a guide slot that facilitates movement of the side frame between the locking recess and a track support surface of the base as the collapsible crate moves between the assembled and collapsed configurations.
Figure 10B:
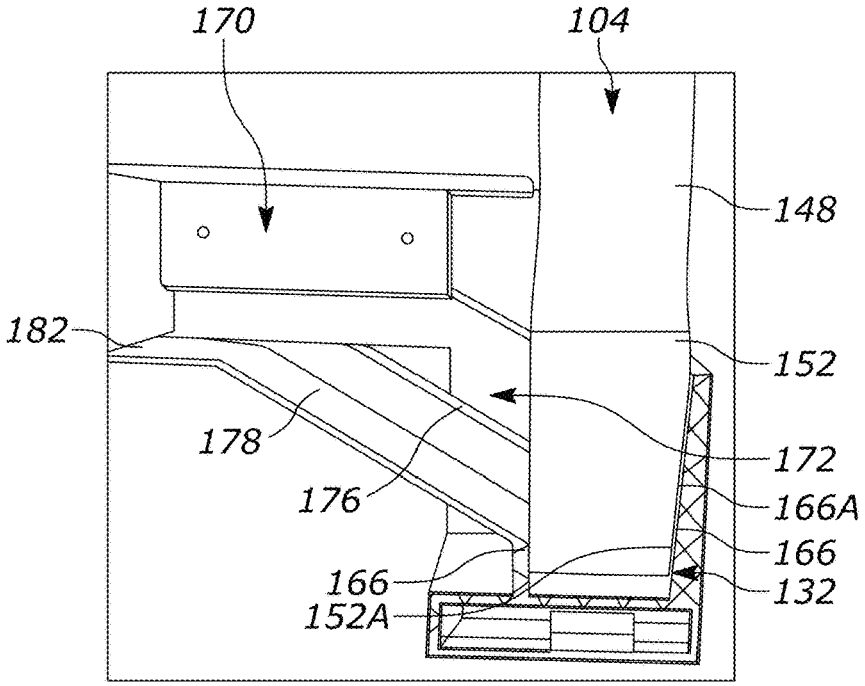
FIG. 10B is a side view of a leg of a side frame inserted into the locking recess of the corner portion of the base of FIG. 10A.
Figure 10C:
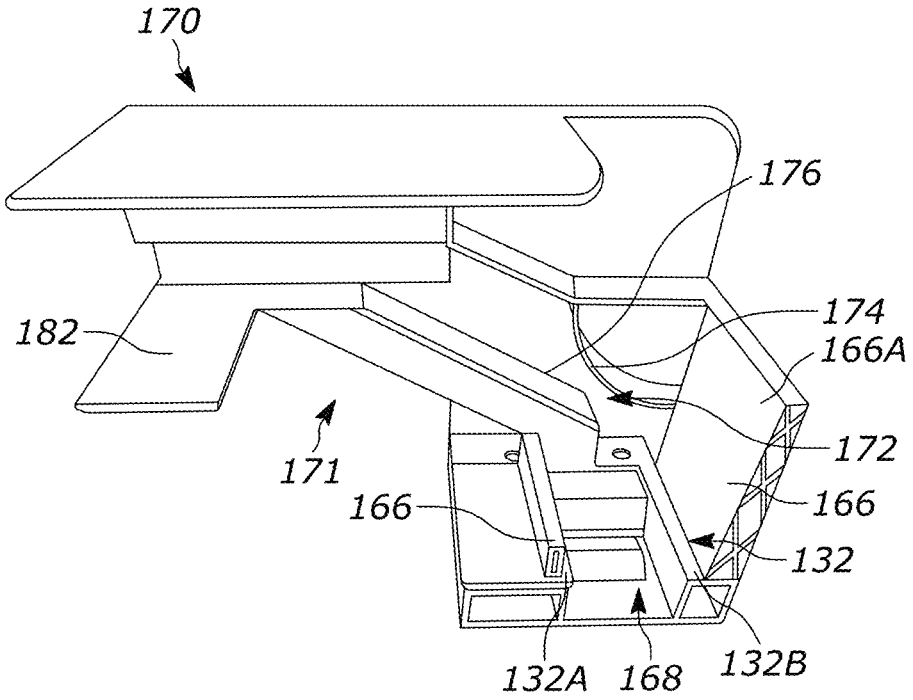
FIG. 10C is a top perspective view of a corner portion of the base of the collapsible crate of FIG. 1 according to another embodiment.
Figure 10D:
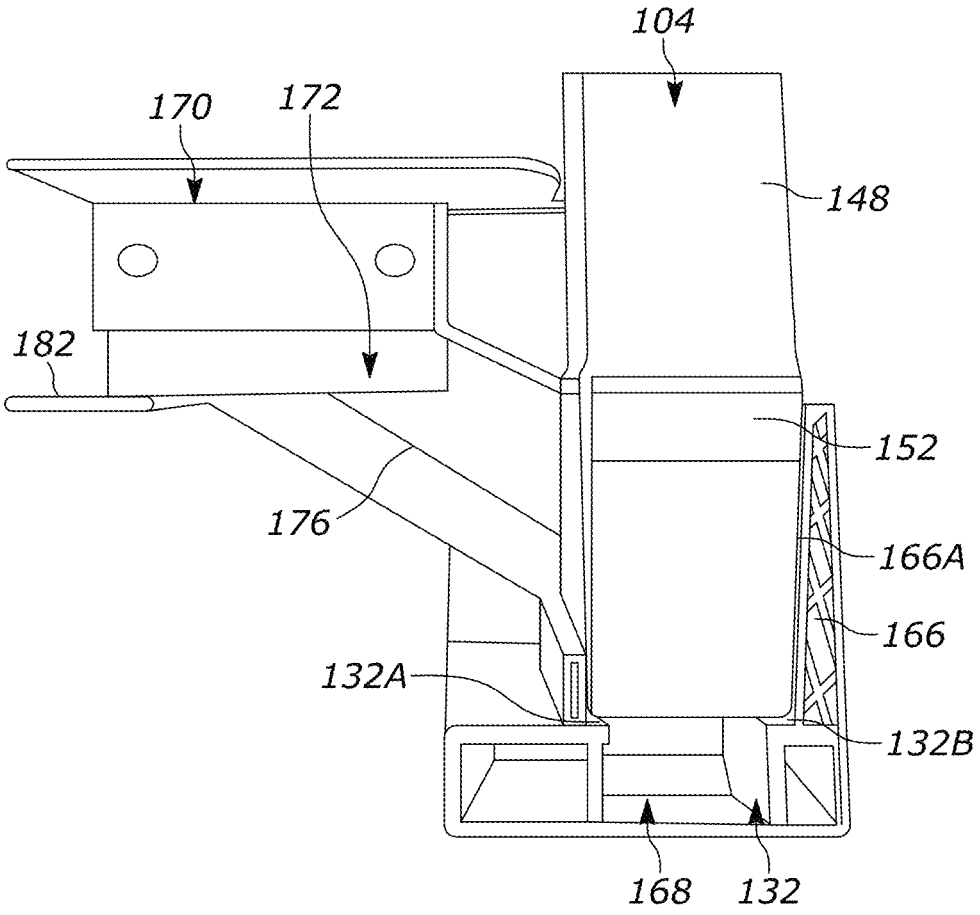
FIG. 10D is a side elevation view of a leg of the side frame inserted into a locking recess of the corner portion of the base of FIG. 10C.
Figure 11:
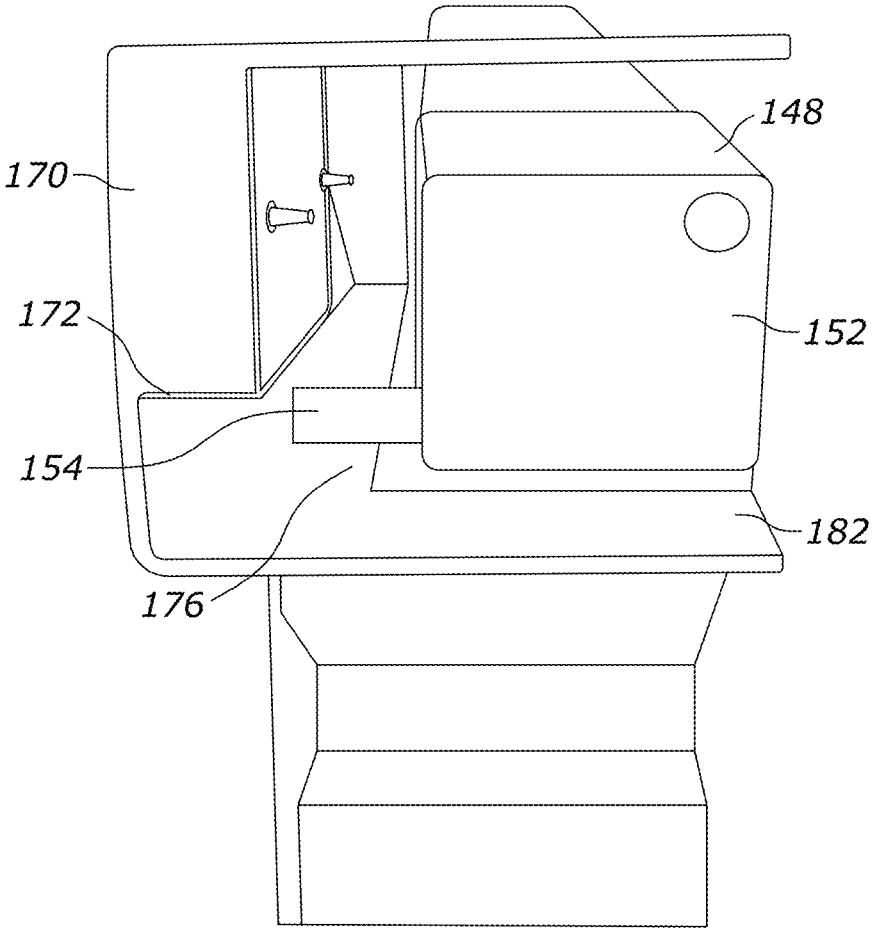
FIG. 11 is a rear elevation view of the corner portion of the base of FIG. 10A showing a pin of a leg of a side frame of the crate of FIG. 1 engaging the guide slot.

With respect to FIGS. 10A-11, side views of a corner portion 170 of the base 102 are shown. Each corner of the base 102 may include a similar corner portion 170 such that the following discussion may similarly apply to the corner portions 170 of all of the corners of the base 102. The corner portion 170 includes a locking recess 132, track support surface 182, and a guide slot 172 extending from the locking recess 132 to the track support surface 182. The locking recess 132 includes support walls 166 that define a cavity 168 for receiving the end portion 150, 152 of a leg 146, 148 of the side frame 104, 106. When the end portion 150, 152 of the leg is inserted into the cavity 168, the support walls 166 engage the side of the leg 146, 148 to lock or inhibit the leg 146, 148 from pivoting relative to the base 102. The inner and/or outer support walls 166 may be tapered to aid in guiding and aligning the end portions 150, 152 of the side frames 104, 106 as they are inserted into the locking recesses 132. For example, as shown in FIGS. 10A-10B, the inner surface 166A of the outer support wall 166 is tapered. The outer surface 152A of the end portion 152 also has a taper corresponding to that of the inner surface 166A of the outer support wall 166. The tapered configuration of the end portion 152 and locking recess 132 aids to guide the end portion 152 into the locking recess 132 and serves as a wedge to increase the frictional engagement of the locking recess 132 with the end portion 152. The tapered configuration thus aids to secure the leg 148 into the locking recess 132 and may inhibit the leg 148 from wobbling or becoming unintentionally withdrawn once inserted therein. The end portion 150 of the leg 146 may similarly be tapered and inserted into the locking recess 132 on the other side of the crate 100. The locking recesses 132 need not include a locking mechanism to physically secure the legs 146, 148 in the locking recess 132, but the locking recesses 132 may instead lock the legs 146, 148 from pivoting and by a frictional engagement therebetween.

The guide slot 172 receives the guide pin 154 (see FIG. 11) extending laterally from an end portion 150, 152 of the leg 146, 148 of the side frame 104, 106. The guide slot 172 guides the pin 154 of the leg 146, 148 as the side frame 104, 106 transitions between the collapsed and assembled configurations. With reference to FIG. 10A, the guide slot 172 includes an upper cam surface 174 that the pin 154 of the leg engages when the side frame 104, 106 is lifted upward out of the locking recess 132. In other words, the upper cam surface 174 limits how far the side frame 104, 106 is able to be lifted out of the locking recesses 132 and thus may prevent the side frame 104, 106 from being removed from the base 102. In the form shown, the upper cam surface 174 includes a curved portion such that the upper cam surface 174 directs the pin 154 of the leg 146, 148 toward the track support surface 182 of the receptacle 110. For example, when the leg 146, 148 is lifted out of the cavity 168 of the locking recess 132, the leg 146, 148 may be pivoted outward from the base 102 of the crate 100 with the pin 154 of the leg 146, 148 sliding along the curved portion of the upper cam surface 174 of the guide slot 172. The side frame 104, 106 may be slide inward and into the receptacle 110 of the base 102 to stow the side frame 104, 106. The curved portion of the upper cam surface 174 may similarly limit how far the side frame 104, 106 is able to be withdrawn from the base 102 when withdrawing the side frame 104, 106 from the base 102. For example, the pin 154 of the leg 146, 148 may engage the curved portion of the upper cam surface 174 which limits how far the side frame 104, 106 is able to be withdrawn from the base 102. The pin 154 may be slid along the upper cam surface 174 to the locking recess 132 (e.g., as the side frame 104, 106 is pivoted upward) to secure the side frame 104, 106 in the locking recess 132.

The guide slot 172 further includes a lower cam surface 176. The pin 154 of the leg 146, 148 may engage the lower cam surface 176 as the side frame 104, 106 is slid inward into the receptacle 110. The lower cam surface 176 slopes upward from the locking recess 132 to the track support surface 182 such that the lower cam surface 176 directs the end portion 150, 152 of the leg 146, 148 upward to the track support surface 182 of the track as the side frame 104, 106 is inserted into the base 102. Conversely, the lower cam surface 176 may direct the end portion 150, 152 of the leg 146, 148 downward toward the locking recess 132 as the side frame 104, 106 is withdrawn from the base 102.

The corner portion 170 of the base 102 may include a ramped surface 178 that extends from an inner support wall 166 of the locking recess 132 to the track support surface 182. The ramped surface 178 may provide clearance for the end portion of the leg 146, 148 as the leg is pivoted about the pin 154 and slid between the track support surface 182 and locking recess 132. The ramped surface 178 provides a sloped surface that the end portion 150, 152 of the leg 146, 148 slides along as the side frame 104, 106 is moved between the assembled and collapsed configurations to guide the leg 146, 148 between the locking recess 132 and the track support surface 182. Use of the ramped surface 178 to guide the leg 146, 148 may be as an alternative to or in addition to use of the guide slot 172 and pin 154.

In other embodiments, such as that shown in FIGS. 10C-10D, the corner portion 170 does not include the ramped surfaces 178 but instead there is an opening 171 extending from the support wall 166 to the track support surface 182. Removing the ramped surface 178 may aid in reducing the weight of the crate 100. Moreover, the cavity 168 of the locking recess 132 may extend all the way to the bottom side of the crate 100. The locking recess 132 may include ledges 132A, 132B that the end portion 150, 152 of the legs of the side frames 104, 106 contact when fully inserted to limit how far the end portion 150, 152 can be inserted and to support the legs of the side frame 104, 106. Use of ledges 132A, 132B instead of a bottom wall may reduce the material required to form the corner portion 170 and reduce the overall weight of the crate 100. Moreover, having the cavity 168 of the locking recess 132 extend below the ledges 132A, 132B provides space for debris to fall into and collect such that the debris does not inhibit the side frame 104, 106 from being fully inserted into the locking recesses 132.

Figure 12A:
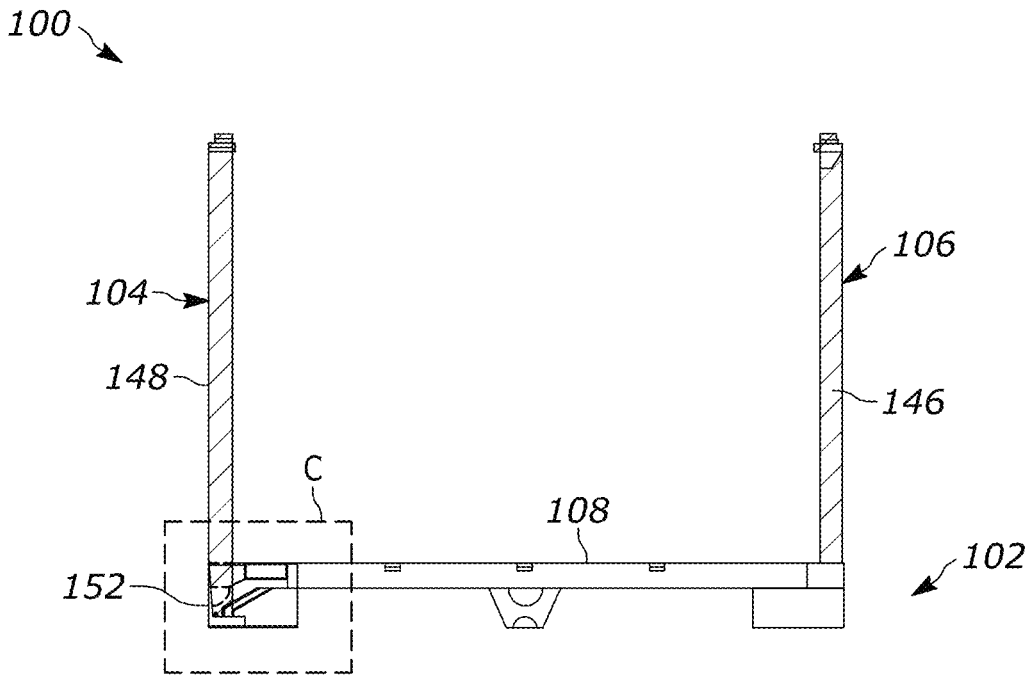
FIG. 12A is a partial cutaway side elevation view of the collapsible crate of FIG. 1 shown in the assembled configuration.
Figure 12B:
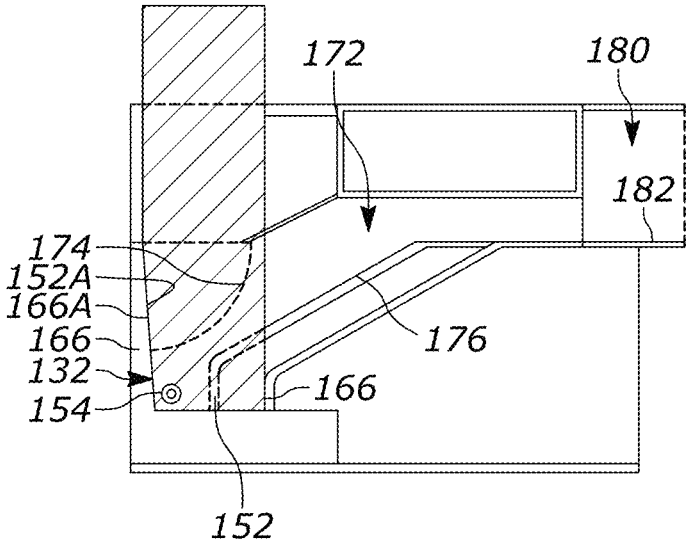
FIG. 12B is a closeup view of portion C of FIG. 12A.

With reference to FIGS. 12A-15C, the process for transitioning the crate 100 between the assembled and collapsed configurations is described. FIG. 12A illustrates a side schematic view of the crate 100 in the assembled configuration with the side frames 104, 106 extending upright relative to the supporting surface 108 of the base 102. FIG. 12B is a detail view of portion C of FIG. 12A illustrating the end portion 152 of the leg of the side frame 104 inserted into the locking recesses 132 of the base 102. As shown, the pin 154 is within the portion of the guide slot 172 extending into the locking recess 132. The support walls 166 of the locking recess 132 inhibit the leg of the side frame 104 from pivoting relative to the base 102.

Figure 13A:
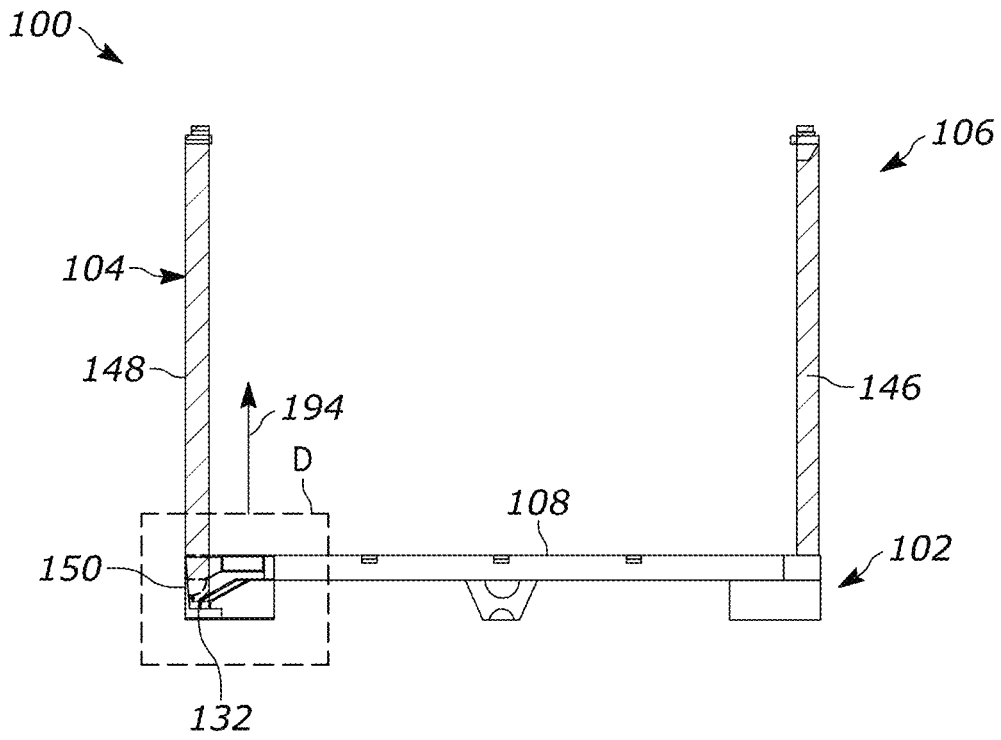
FIG. 13A is a partial cutaway side elevation view of the collapsible crate of FIG. 1 illustrating a side frame partially withdrawn from a locking recess of the base.
Figure 13B:
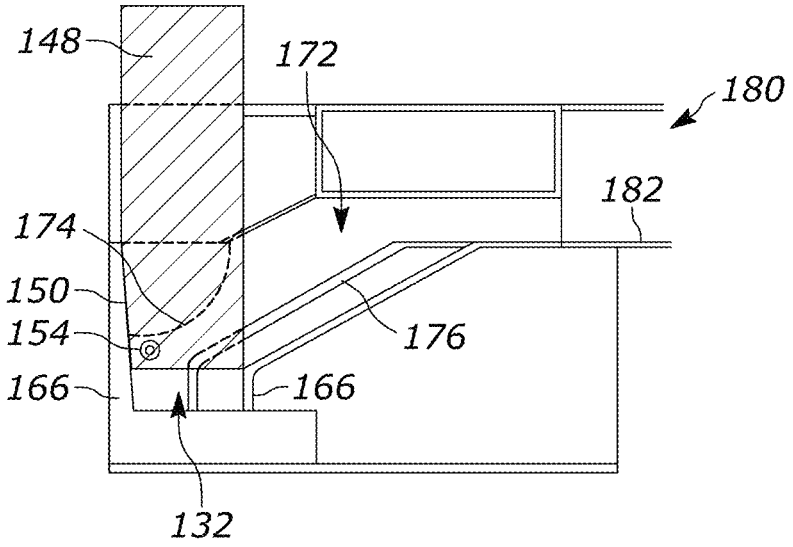
FIG. 13B is a closeup view of portion D of FIG. 13A.
Figure 14A:
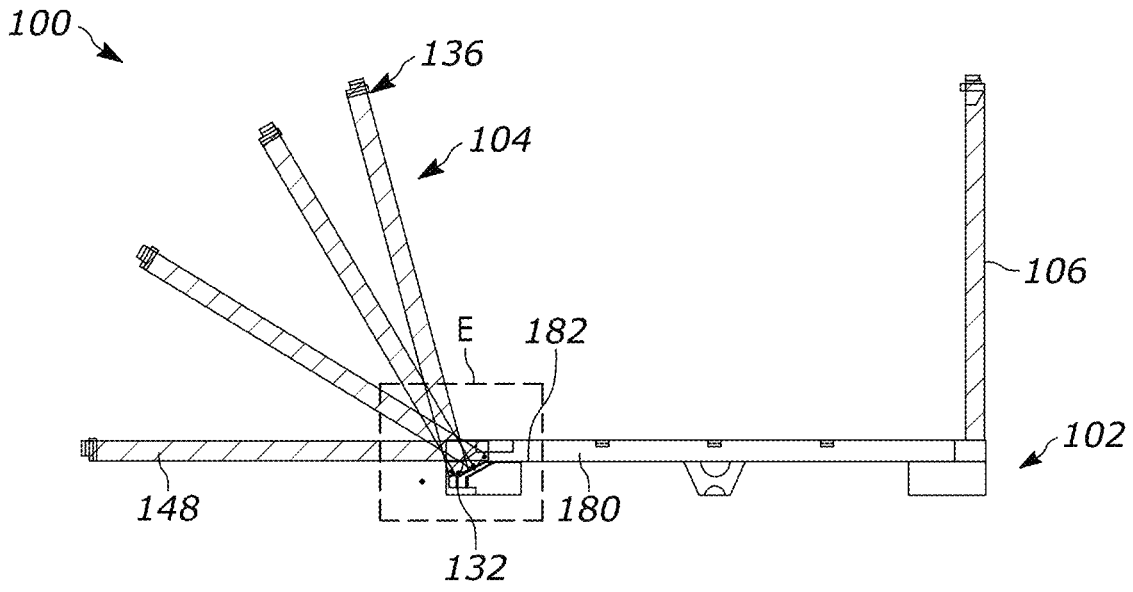
FIG. 14A is a partial cutaway side elevation view of the collapsible crate of FIG. 1 illustrating the side frame being pivoted relative to the base.
Figure 14B:
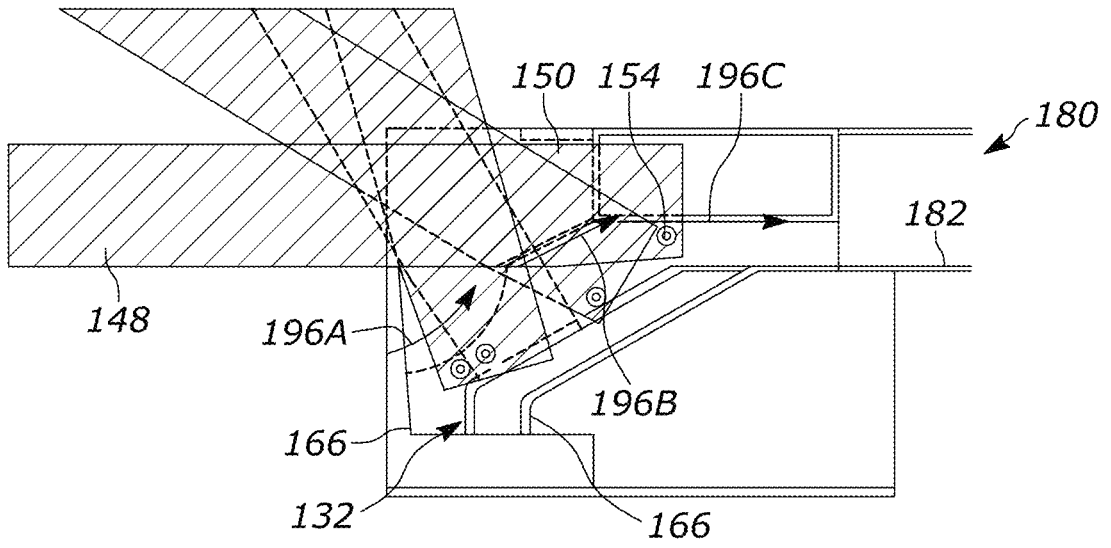
FIG. 14B is a closeup view of portion E of FIG. 14A.

With reference to FIG. 13A, the side frame 104 may be lifted upward in direction 194 to withdraw the end portion 152 of the leg of the side frame 104 from the locking recess 132 and above the inner support wall 166. For example, a user may grasp the legs 146, 148 and/or crossmember 140 of the side frame 104 and lift the side frame 104 in direction 194 to remove the side frame 104 from the locking recesses 132. FIG. 13B is a detail view of portion D of FIG. 13A showing the end portion 152 of the side frame 104 lifted out of the locking recess 132. As the side frame 104 is lifted, the guide pin 154 may be brought into contact with the upper cam surface 174 of the guide slot 172 to limit how far the side frame 104 is able to be moved in direction 194. With reference to FIG. 14A, once the side frame 104 is lifted out of the locking recesses 132, the upper portion 136 of the side frame 104 may be pivoted outward and downward to align the legs 146, 148 of the side frame 104 with the tracks 180 of the base 102. FIG. 14B is a detail view of portion E of FIG. 14A showing movement of the end portion 152 of the side frame 104 as the upper portion 136 of the side frame 104 is lowered. As shown, the guide pin 154 of the side frame 104 slides within the guide slot 172 as indicated by the arrows 196A, 196B, 196C from the locking recess 132 toward the track support surface 182. The guide pin 154 may contact the upper cam surface 174 and/or lower cam surface 176 of the guide slot 172 as the side frame 104 is pivoted which may direct the end portion of the side frame 104 along the guide slot 172 toward the track support surface 182.

Figure 15A:
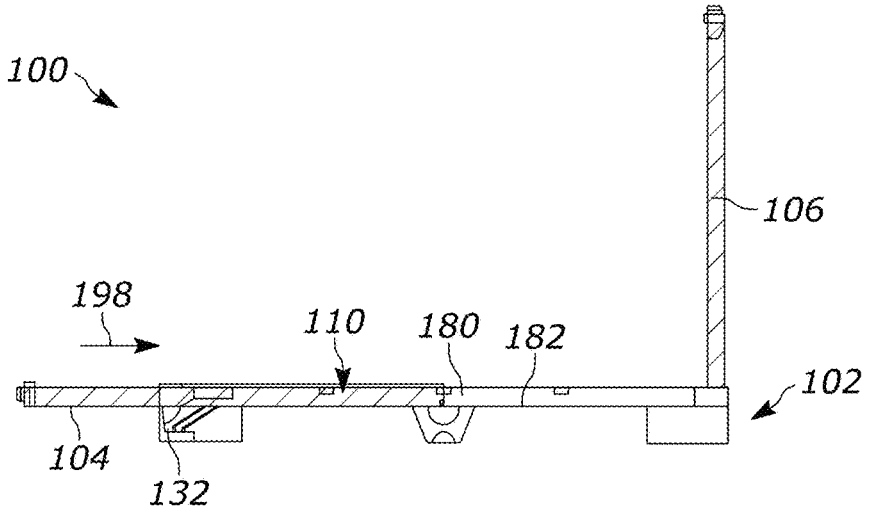
FIGS. 15A and 15B are partial cutaway side elevation views of the collapsible crate of FIG. 1 illustrating the side frame being inserted into a receptacle of the base.
Figure 15B:
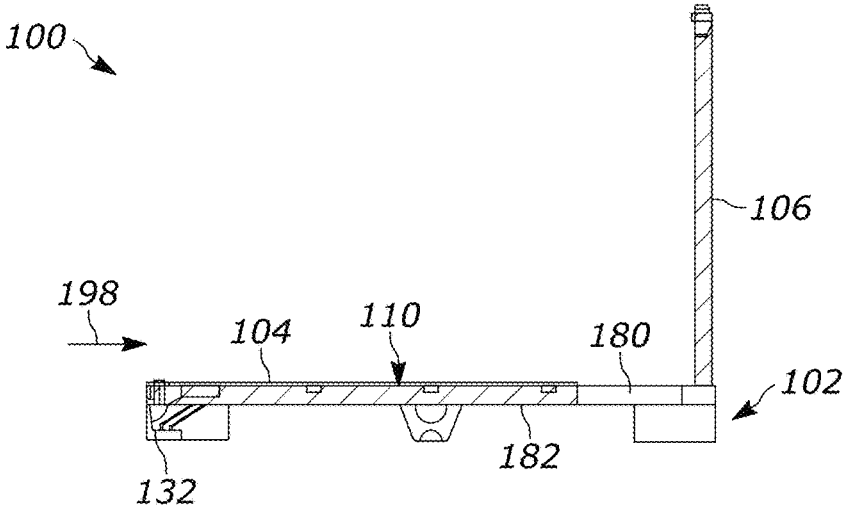
Figure 15C:
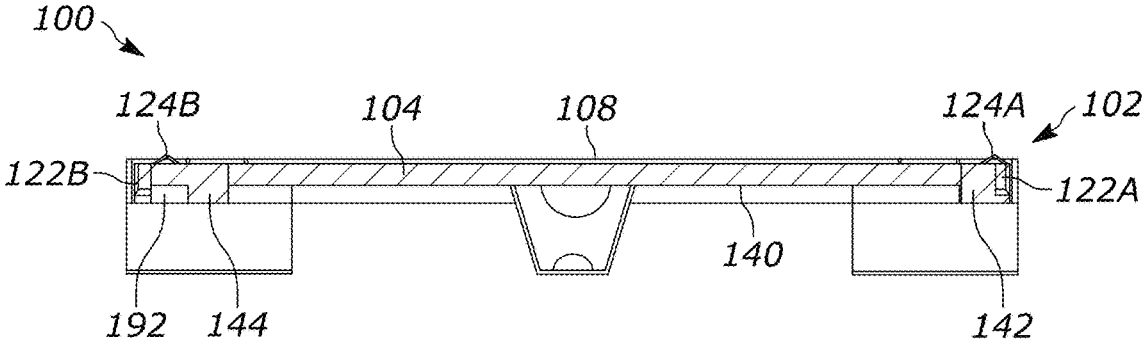
FIG. 15C is a front side view of the collapsible crate of FIG. 1 in the collapsed configuration.

With respect to FIGS. 15A-15B, once the side frame 104 has been pivoted outward until the legs 146, 148 are substantially parallel with the tracks 180, the side frame 104 may be slid inward in direction 198 along the tracks 180 of the receptacle 110 of the base 102. The side frame 104 may be slid along direction 198 until the extension coupler 144 and/or crossmember 140 of the side frame 104 have passed over the stop protrusion 192 as shown in FIGS. 15B-15C. The side frame 104 may be lowered to rest on the tracks 180 with the stop protrusion 192 inhibiting the side frame 104 from sliding out of the receptacle 110 of the base 102.

The second side frame 106 may be inserted into the receptacle 110 of the base 102 similar to the first side frame 104 described above to place the crate 100 in the collapsed configuration. The crate 100 may be moved from the collapsed configuration to the assembled configuration by reversing the steps described above with respect to FIGS. 12A-15C.

Figure 16:
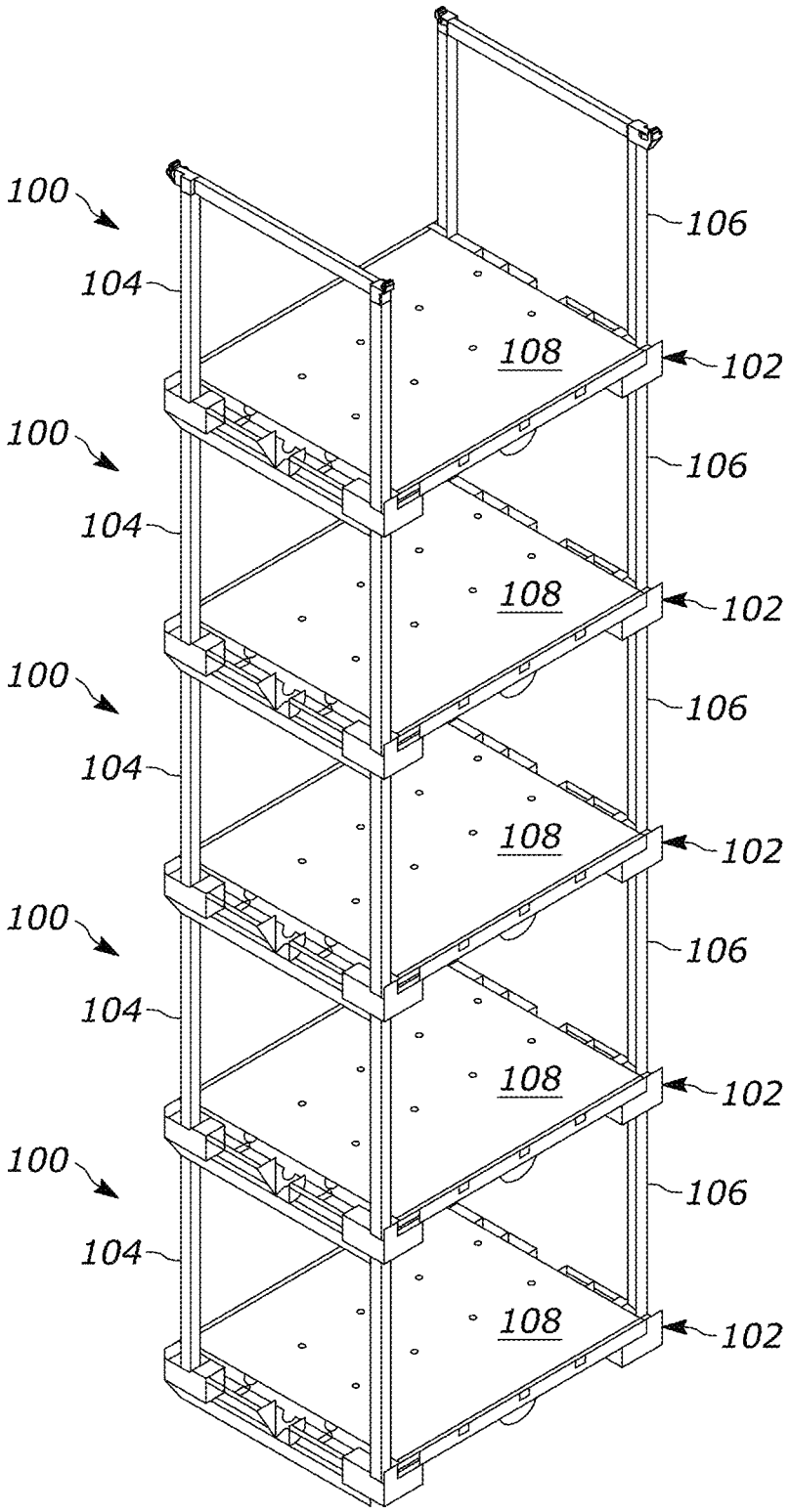
FIG. 16 illustrates stacking of the collapsible crates of FIG. 1 when in the assembled configuration.

With respect to FIG. 16, the crates 100 may stacked on one another when in the assembled configuration. As shown, five crates 100 are stacked vertically, however, any number of crates 100 could be stacked. Stacking the assembled crates 100 may be advantageous to conserve space when transporting or storing items on the crates 100. For example, stacking the crates 100 reduces the amount of square footage needed for each crate, for example, in a warehouse or on a transportation vehicle. When stacked, items may be stored on the supporting surfaces 108 of the crates 100 with the side frames 104, 106 providing clearance for the items by spacing the crates 100. The crates 100 thus are supported by the rigid side frames 104, 106 of the immediately lower crate 100 and need not rest on the items of the lower crate 100.

Figure 17A:
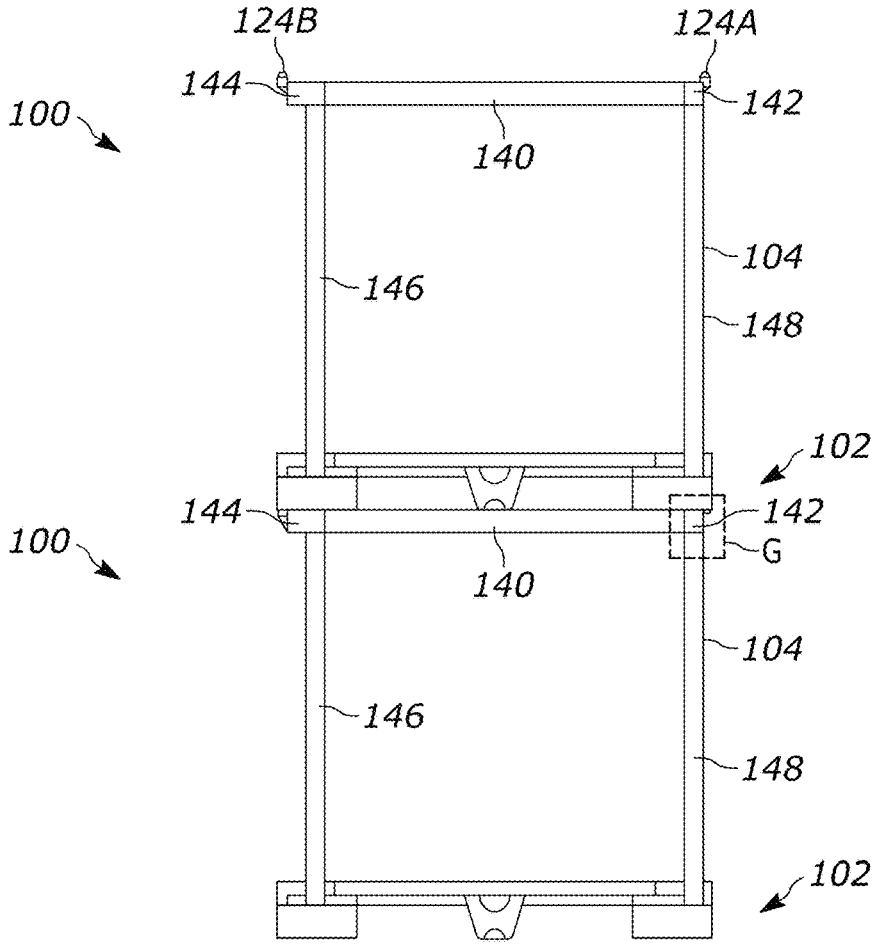
FIG. 17A is a front elevation view of the first collapsible crate of FIG. 1 stacked on a second collapsible crate in the assembled configuration.
Figure 17B:
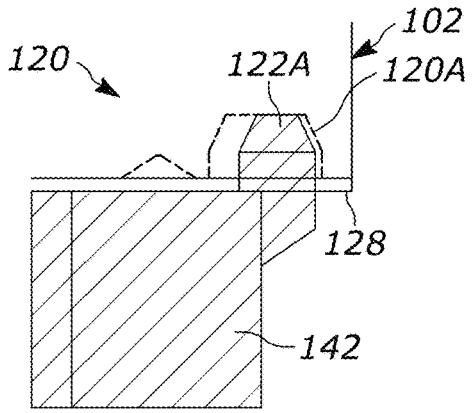
FIG. 17B is a partial cutaway view of portion G of FIG. 17A illustrating the stacking protrusion of a side frame of the second collapsible crate received into a recess of the base of the first collapsible crate.

With respect to FIG. 17A, the couplers 142 and extension couplers 144 may be used to couple two crates 100 together when stacked in the assembled configuration. Specifically, the stacking protrusions 122A, 122B of the first and second side frames 104, 106 of the lower crate 100 may be inserted into the recesses 120A on the base 102 of the upper crate 100. With respect to FIG. 17B, a schematic diagram is provided illustrating one stacking protrusion 122A of the side frame 104 inserted into the recess 120A of the base 102 of the upper crate 100. The other stacking protrusions 122A, 122B may similarly be inserted into the recesses 120A of a base 102 of a crate 100. The stacking protrusion 122A extends upward into the base 102 which limits the lateral movement of the crates 100, especially when all four stacking protrusions 122A, 122B are similarly inserted into the corresponding recesses 120A of the upper crate 100. The stacking protrusions 122A, 122B may have sloped sides that aid to align the recesses 120A of the base 102 to receive all four stacking protrusions 122A, 122B as the base 102 is lowered onto the lower crate 100. The recesses 120A may also have sloped sidewalls defining the recess 120A that aid in aligning the recesses 120 with the stacking protrusions 122A, 122B.

Figure 18:
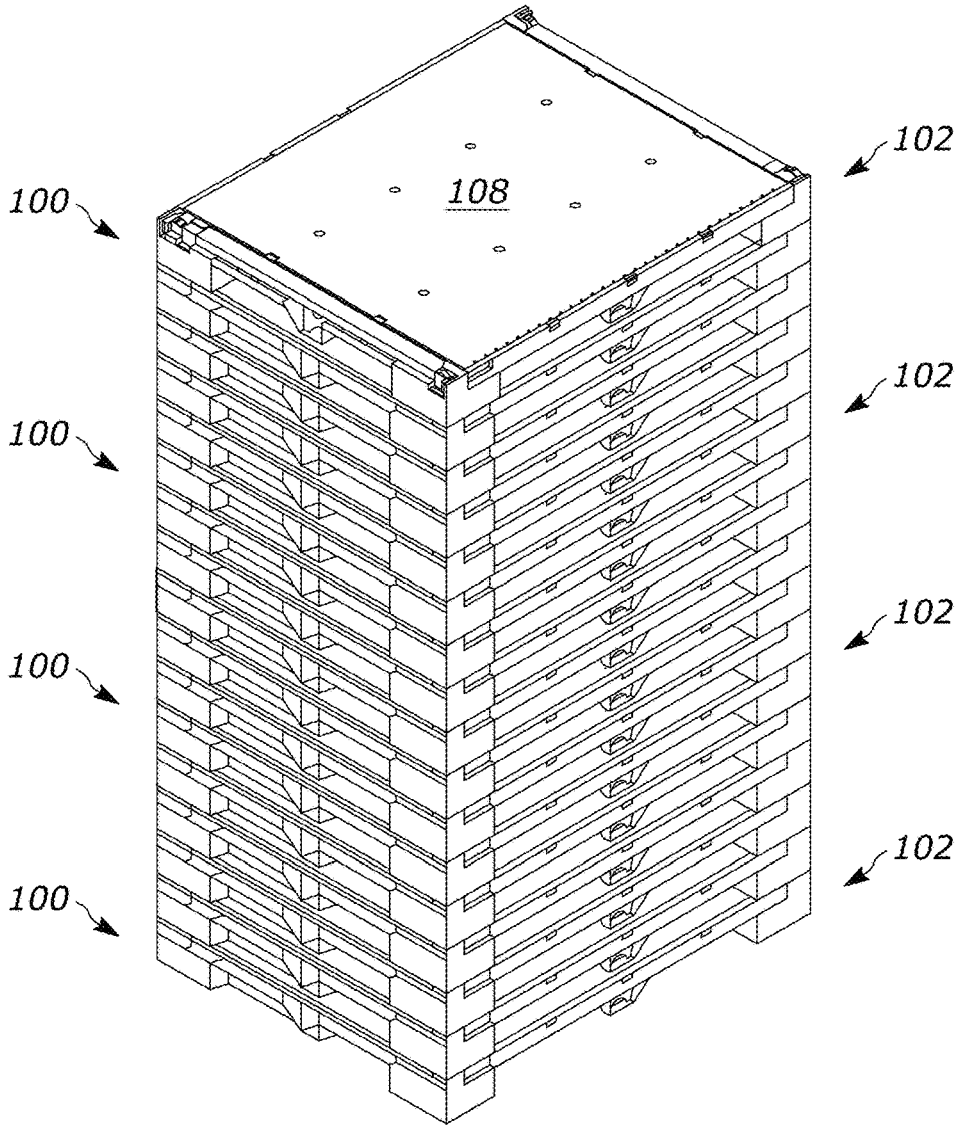
FIG. 18 illustrates stacking of the collapsible crates of FIG. 1 when in the collapsed configuration.

With respect to FIG. 18, the crates 100 may also be stacked on one another when in the collapsed configuration. As shown, seventeen crates 100 are stacked vertically on one another (e.g., to load into a high cube sea container), however, any number of crates 100 could be stacked when collapsed. Stacking the collapsed crates 100 may be advantageous to conserve space when transporting or storing the crates 100 when they are not being used to transport or store items. For example, stacking the crates 100 reduces the amount of square footage needed for each crate, for example, in a warehouse or on a transportation vehicle. Not only are the crates 100 stacked, but the crates 100 are coupled together by the couplers 142 and extension couplers 144 to inhibit the crates 100 from sliding relative to one another thus create a more stable stack of crates 100.

Figure 19A:
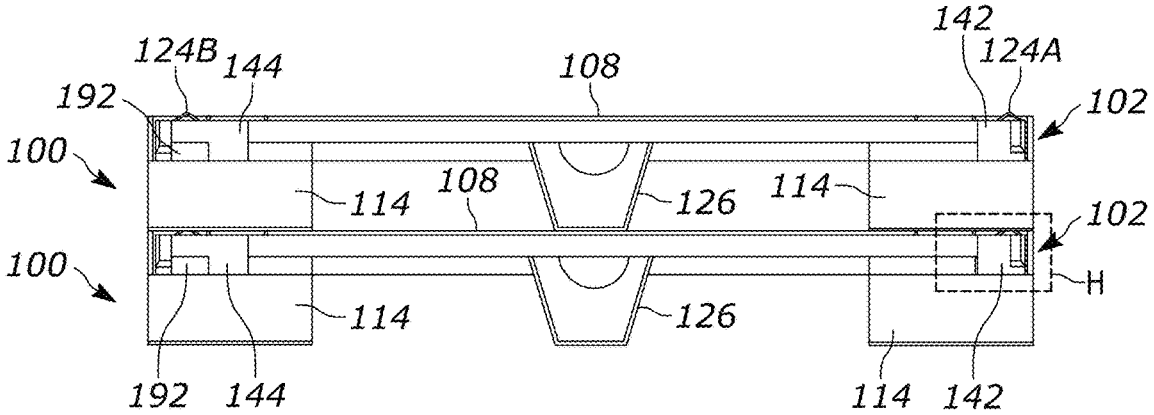
FIG. 19A is a front elevation view of the first collapsible crate of FIG. 1 stacked on a second collapsible crate in the collapsed configuration.
Figure 19B:
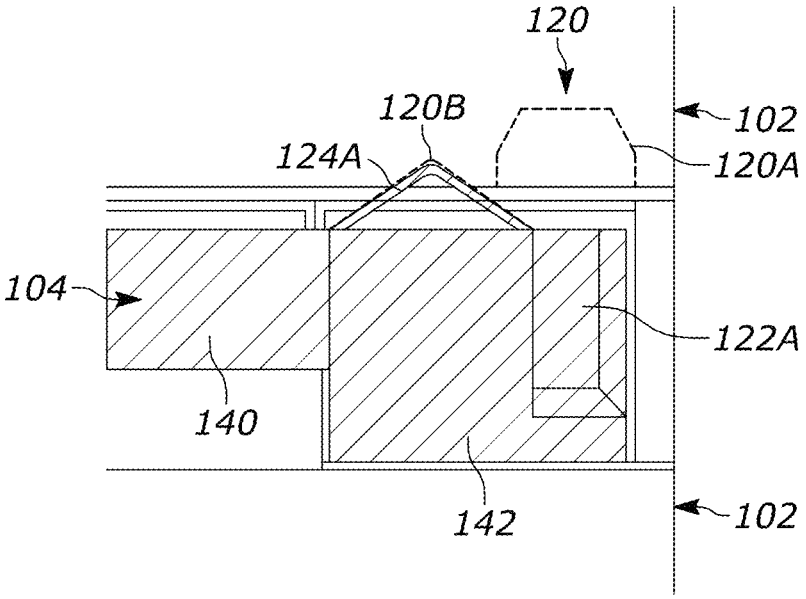
FIG. 19B is a partial cutaway view of portion H of FIG. 19A illustrating the nesting protrusion of a side frame of the second collapsible crate received into a recess of the base of the first collapsible crate.

With respect to FIG. 19A, the couplers 142 and extension couplers 144 may be used to couple two crates 100 together when stacked in the collapsed configuration. Specifically, the nesting protrusions 124A, 124B of the first and second side frames 104, 106 of the lower crate 100 may be inserted into the recesses 120B on the base 102 of the upper crate 100. With respect to FIG. 19B, a schematic view is provided illustrating one nesting protrusion 124A of the side frame 104 inserted into the recess 120B of the base 102 of the upper crate 100. The other stacking protrusions 124A, 124B may similarly be inserted into the recesses 120B of a base 102 of a crate 100. The nesting protrusion 122A extends upward into the base 102 which limits the lateral movement of the crates 100, especially when all four stacking protrusions 122A, 122B are similarly inserted into the corresponding recesses 120B of the upper crate 100. The stacking protrusions 124A, 124B may have a sloped sides that aid to align the recesses 120 of the base 102 to receive all four nesting protrusions 124A, 124B as the base 102 is lowered onto the lower crate 100. The nesting protrusion 124A may be an angled strip that has a triangular profile to aid to align the nesting protrusions 124A, 124B with the recesses 120B. The recesses 120B may also have sloped sidewalls defining the recess 120B that aid in aligning the recesses 120 with the nesting protrusions 124A, 124B.

Figure 20:
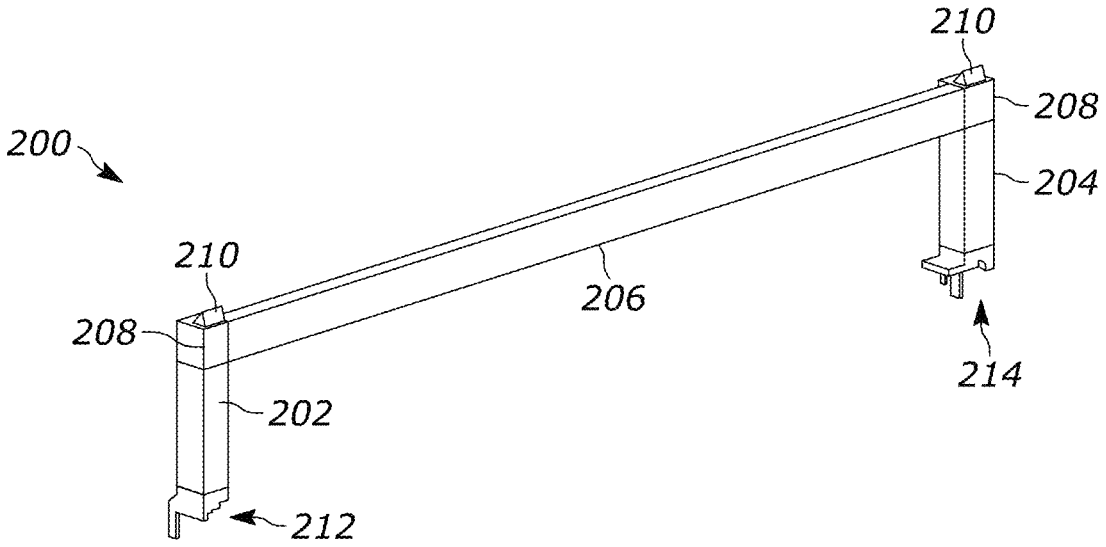
FIG. 20 is a perspective view of a height extension member.

With reference to FIG. 20, an extension member 200 is provided that may be used with the crates 100 described above to extend the height of the crate 100. With respect to FIG. 21, the crate 100 is shown with two extension members 200 attached across the side frames 104, 106 to extend the height of the crate 100. Two extension members 200 may be placed on the first and second side frames 104, 106 of a crate 100 to extend the height of the crate 100. The extension members 200 may extend from the first side frame 104 to the second side frame 106 of the crate 100 with one extending along the left side of the crate 100 and the other extending along the right side of the crate 100. In other forms, each extension member 200 extends upward from one of the side frames 104, 106 rather than spanning the two side frames 104, 106. The extension members 200 may be used, for example, where the height of the items stored on the supporting surface 108 of the crate 100 exceeds the height of the side frames 104, 106. Extension members 200 may be placed on top of the crate 100 to permit another crate 100 to be stacked on the crate 100 without damaging such items.

Referring again to FIG. 20, the extension member 200 includes a first side member 202, a second side member 204, and a crossmember 206 extending from the first side member 202 to the second side member 204. The first side member 202 and second side member 204 may each be connected to the crossmember 206 by a coupler 208. For example, each side member 202, 204 may be connected to the ends of the crossmember 206. The first side member 202, second side member 204, crossmember 206, and couplers 208 may be formed of a metal (e.g., steel), plastics, and/or other rigid materials.

Figure 22:
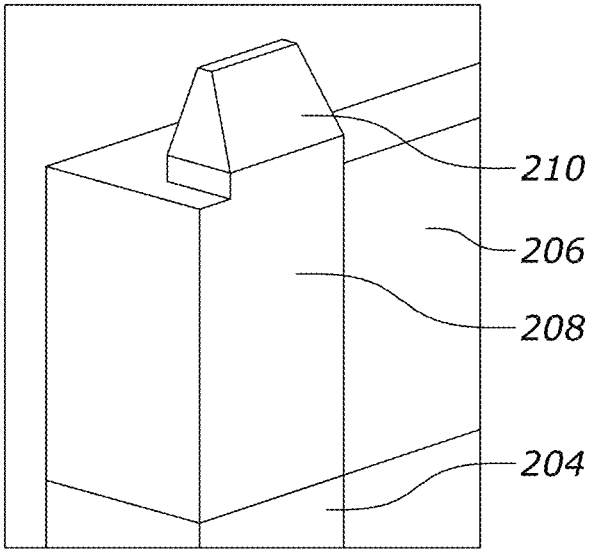
FIG. 22 is a closeup view of a coupler of the height extension member of FIG. 21 having a stacking protrusion.

With respect to FIG. 22, the couplers 208 include a stacking protrusion 210 that is similar to the stacking protrusions 122A, 122B discussed above. The stacking protrusions 210 may be inserted into recesses 120 on the base 102 of a crate 100 to support and secure another crate 100 on the extension member 200.

Figure 23:
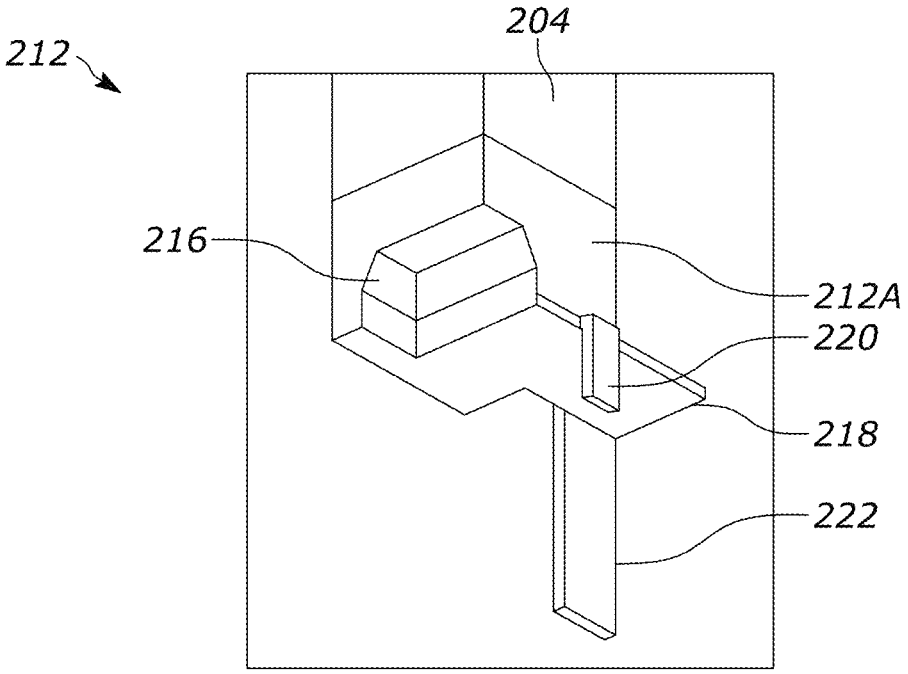
FIG. 23 is a closeup view of a connection portion of the height extension member of FIG. 20 configured to connect to an upper portion of the side frame of the collapsible crate of FIG. 1.

With reference again to FIG. 20, the first side member 202 extends from the crossmember 206 to a first connection portion 212 configured to connect to a coupler 142 and/or extension coupler 144 of the crate 100. The second side member 204 extends from the crossmember 206 to a second connection portion 214 configured to connect to a coupler 142 and/or extension coupler 144 of the crate 100. With respect to FIG. 23, the first connection portion 212 includes a body 212A having recess 216, a support flange 218 extending from the body 212A, a locking pin such as inner pin 220 extending from the body 212A, and a guide pin such as outer pin 222 extending from the support flange 218. The second connection portion 214 is similar to the first connection portion 212 such that the discussion of the first connection portion 212 similarly applies to the second connection portion 214 and will not be repeated. The recess 216 is sized to receive the stacking protrusion 122A, 122B of the side frame 104, 106 when the extension member 200 is placed on the crate 100. In the form shown, the recess 216 extends is exposed on the bottom and side of the body 212A, however, in other embodiments, the body 212A may surround the recess 216 such that the recess 216 is accessible only from the bottom side of the body 212A.

Figure 24A:
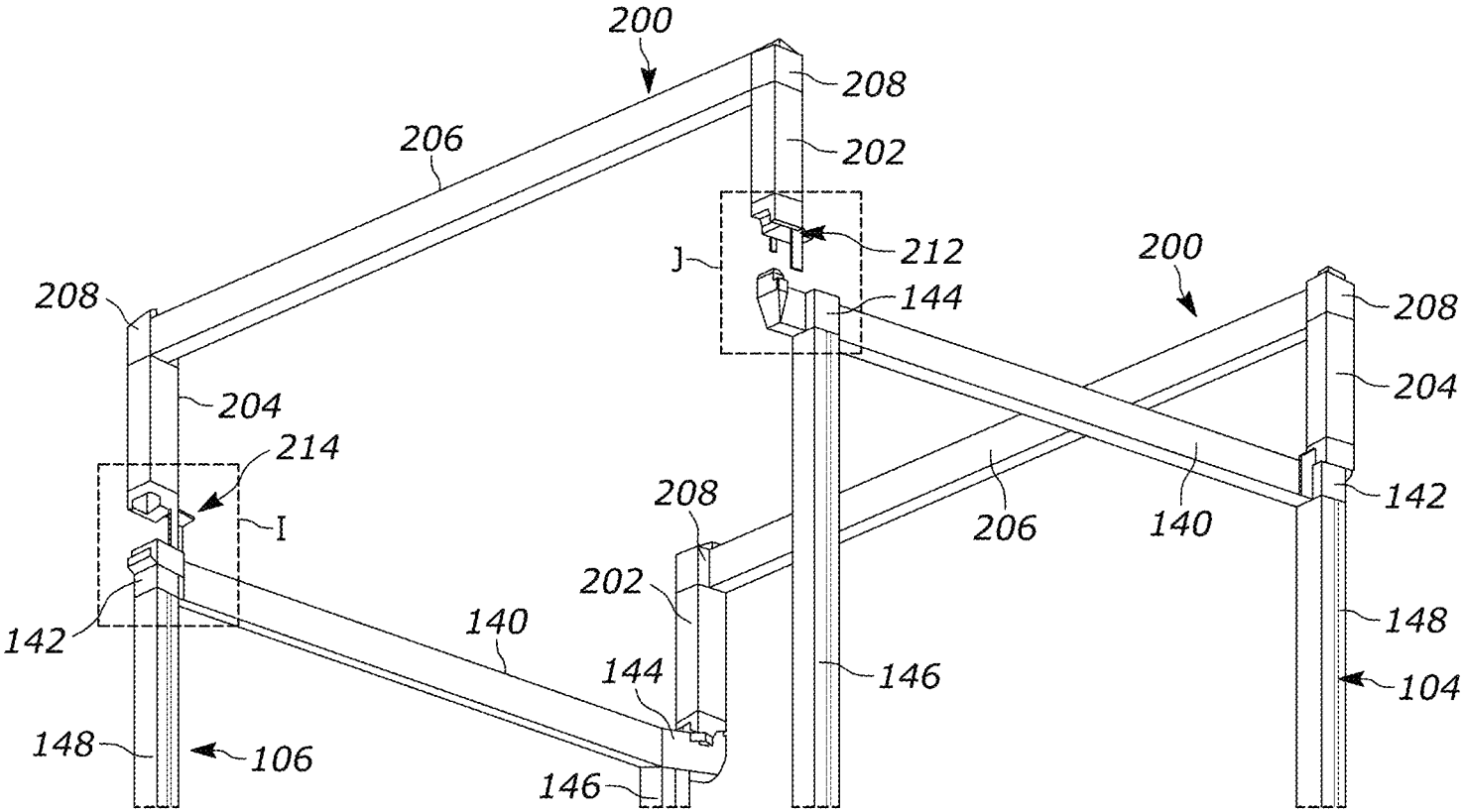
FIG. 24A illustrates the height extension member of FIG. 20 aligned for attachment to the side frames of the collapsible crate of FIG. 1.
Figure 24B:
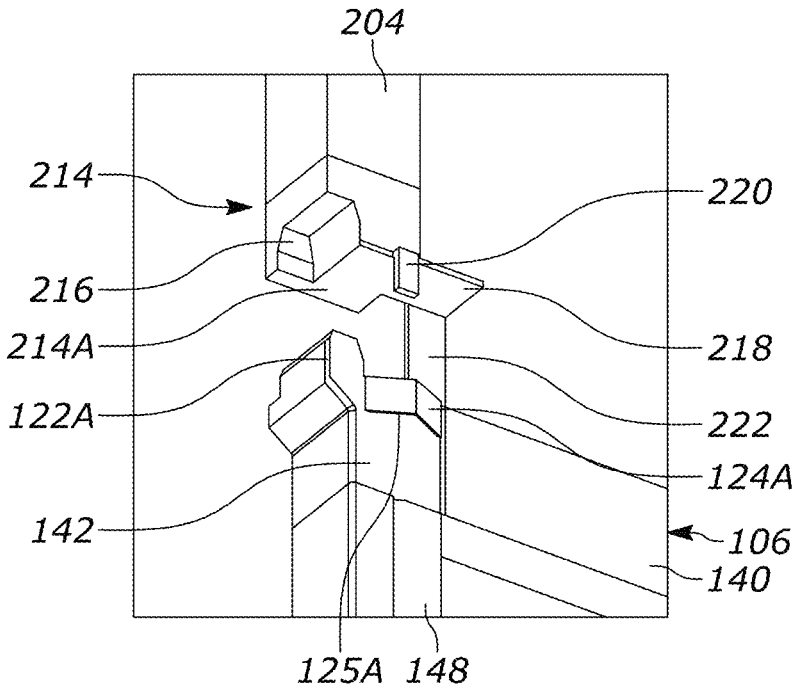
FIG. 24B is a closeup view of portion I of FIG. 24A illustrating a rear end of the height extension member aligned for connection with the rear side frame of the collapsible crate of FIG. 1.
Figure 24C:
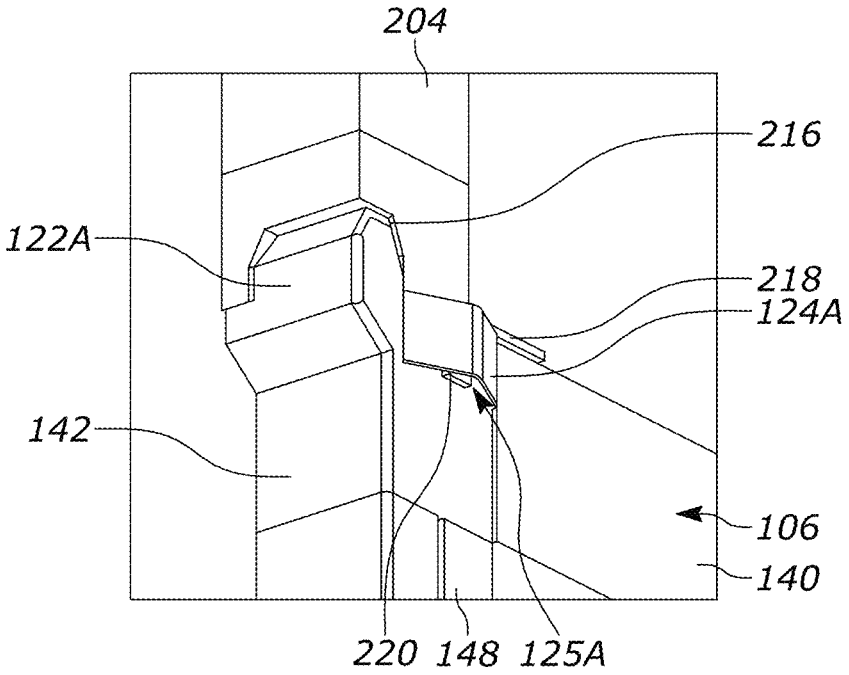
FIG. 24C is a closeup view similar to FIG. 24B illustrating the rear end of the height extension member connected to the rear side frame of the collapsible crate of FIG. 1.
Figure 24D:
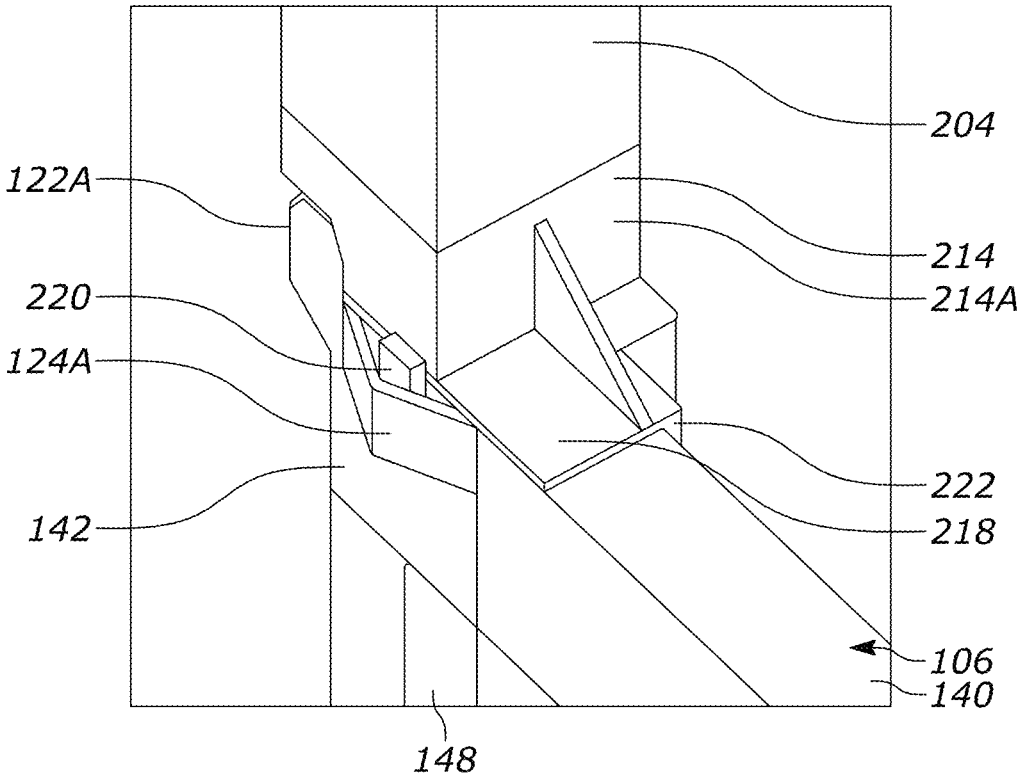
FIG. 24D is a top perspective view illustrating the rear end of the height extension member connected to the rear side frame of the collapsible crate as in FIG. 24C.

With respect to FIG. 24A, the upper portions of side frames 104, 106 of the crate 100 are shown with one extension member 200 aligned for connection to the crate and the other extension member 200 coupled to the side frames 104, 106 of the crate 100. The recesses 216 of the first and second connection portions 212, 214 may be aligned with the stacking protrusions 122A, 122B of the crate 100 and lowered onto the protrusions to couple the extension member 200 to the crate 100. With reference to FIG. 24B-24D, closeup views of portion I of FIG. 24A are shown illustrating how the second connection portion 214 is connected to the crate 100 to secure the extension member 200 to the crate 100. With reference to FIG. 24B, the inner pin 220 is aligned with the opening 125A of the nesting protrusion 124A on the inner side of the side frame 106. The support flange 218 is aligned with the crossmember 140 of the side frame 106 such that the outer locking pin 222 is aligned with the outer side of the coupler 142 and/or crossmember 140 of the side frame 106.

With reference to FIGS. 24C-24D, to connect the second connection portion 214 to the side frame 106, the extension member 200 is lowered onto the coupler 142 and/or crossmember 140 of the side frame 106 such that the inner pin 220 extends along an inner surface of the coupler 142 while the outer locking pin 222 extends along the outer surface of the coupler 142 and/or crossmember 140. The inner pin 220 is inserted into the opening 125A of the nesting protrusion 124A of the side frame 106 while the stacking protrusion 122A of the side frame is inserted into the recess 216 of the second connection portion 214. The extension member 200 may be lowered until the support flange 218 and/or body 214A rest on the coupler 142 and/or crossmember 140 of the side frame 106.

Figure 25A:
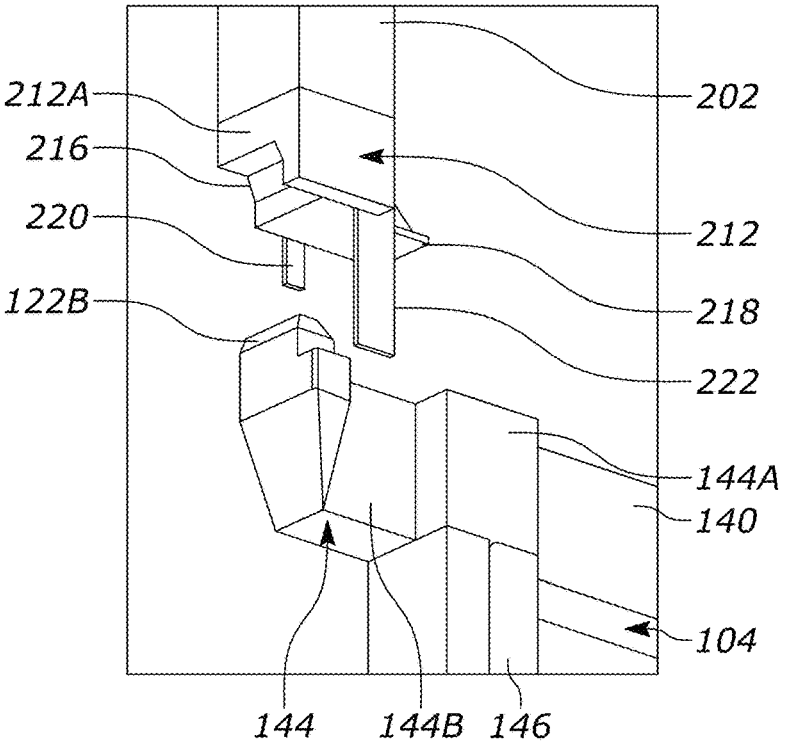
FIG. 25A is a closeup view of portion J of FIG. 24A illustrating a front end of the height extension member aligned for connection with the front side frame of the collapsible crate of FIG. 1.
Figure 25B:
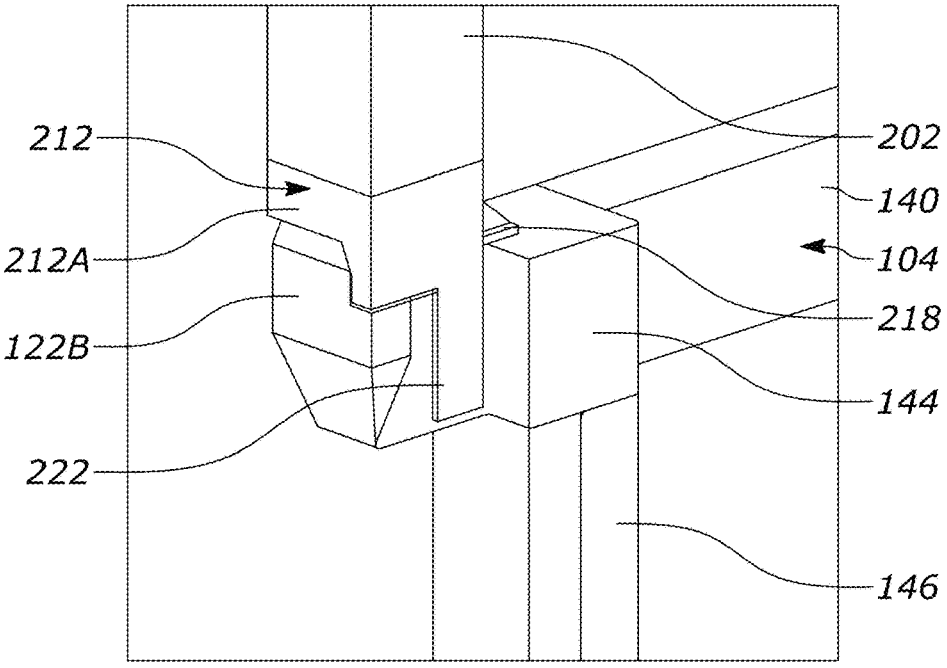
FIG. 25B is a closeup view similar to FIG. 25A illustrating the front end of the height extension member connected to the front side frame of the collapsible crate of FIG. 1.

With reference to FIG. 25A-25B, closeup views of portion J of FIG. 24A are shown illustrating how the first connection portion 212 is connected to the crate 100 to secure the extension member 200 to the crate 100. With reference to FIG. 25A, the inner pin 220 is aligned with an opening 125B formed by the nesting protrusion 124B on the inner side of the side frame 104. The support flange 218 is aligned with the crossmember 140 of the side frame 104 such that the outer locking pin 222 is aligned with the outer side of the extension coupler 144 of the side frame 104.

With reference to FIG. 25B, to connect the first connection portion 212 to the side frame 104, the extension member 200 is lowered onto the extension coupler 144 of the side frame 104 such that the inner pin 220 extends along an inner surface of the extension coupler 144 while the outer locking pin 222 extends along the outer surface of the extension coupler 144. The inner pin 220 is inserted into the opening 125B of the nesting protrusion 124B of the side frame 104 similar to the connection of the second connection portion 214 shown in FIGS. 24C-24D. The stacking protrusion 122B of the side frame 104 is inserted into the recess 216 of the first connection portion 212. The extension member 200 may be lowered until the support flange 218 and/or body 212A rest on the extension coupler 144 of the side frame 104.

The inner and outer pins 220, 222 of the first and second connection portion 212, 214 secure the extension member 200 to the side frame 104, 106. The inner and outer pins 220, 222 may be sized to tightly receive the coupler 142 and/or extension coupler 144 therebetween to inhibit the extension member 200 from pivoting relative to the side frame 104, 106. The nesting protrusions 124A, 124B may further limit the movement of the inner locking pins 222 of the first and second connection portion 212, 214. For example, the openings 125A, 125B of the nesting protrusions 124A, 124B may be sized to tightly receive the inner locking pins 22 to inhibit the extension member 200 from pivoting relative to the side frame 104, 106.

Figure 21:
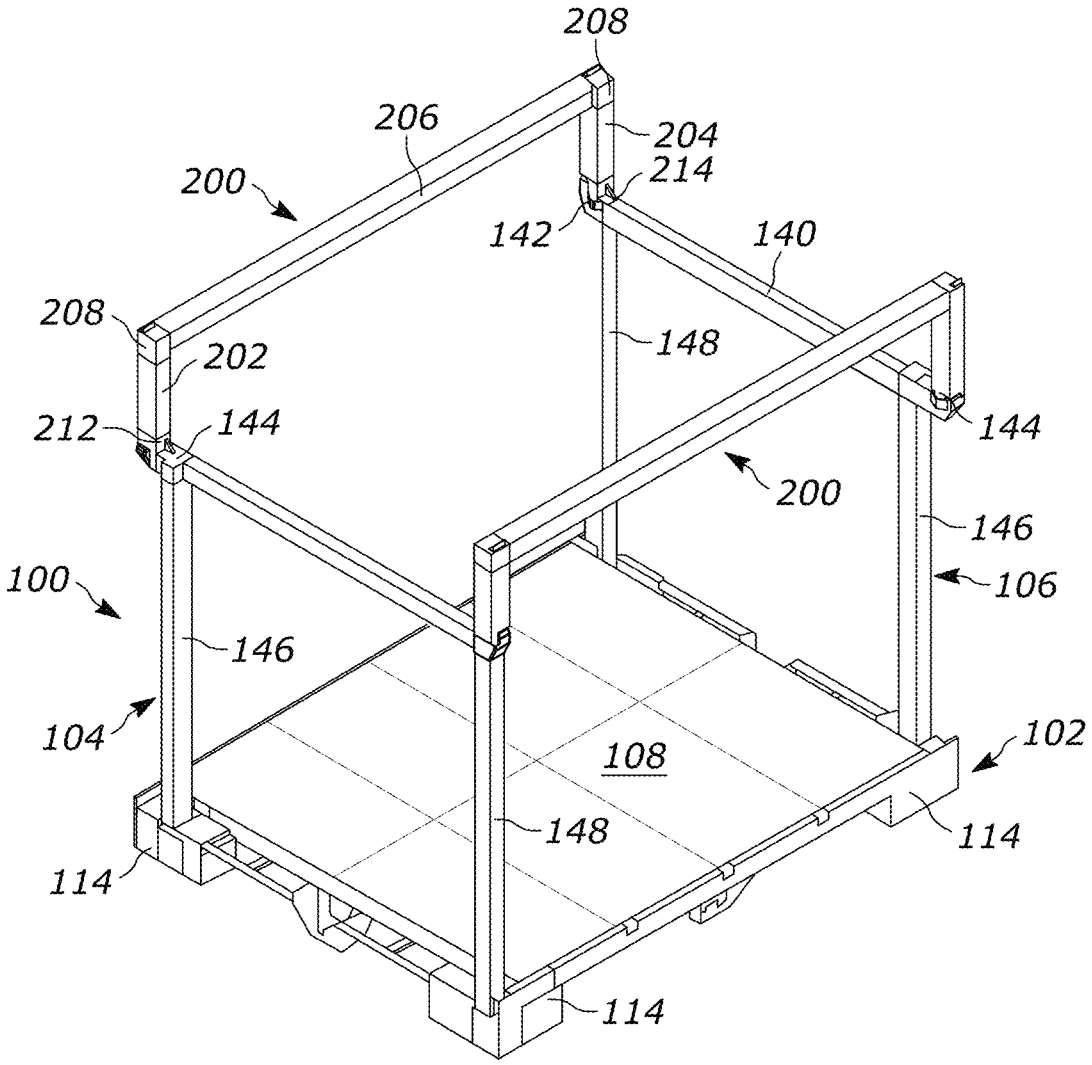
FIG. 21 is a top perspective view of the collapsible crate of FIG. 1 including height extension members of FIG. 20.

Once the extension members 200 are secured to the crate across the side frames 104, 106 as shown in FIG. 21, a crate 100 may be stacked on the extension members 200 of the crate 100. The side frames 104, 106 and extension members 200 space the base 102 of the upper crate 100 from the supporting surface 108 of the lower crate 100 providing clearance for one or more items positioned on the supporting surface 108 of the lower crate 100.

Figure 26A:
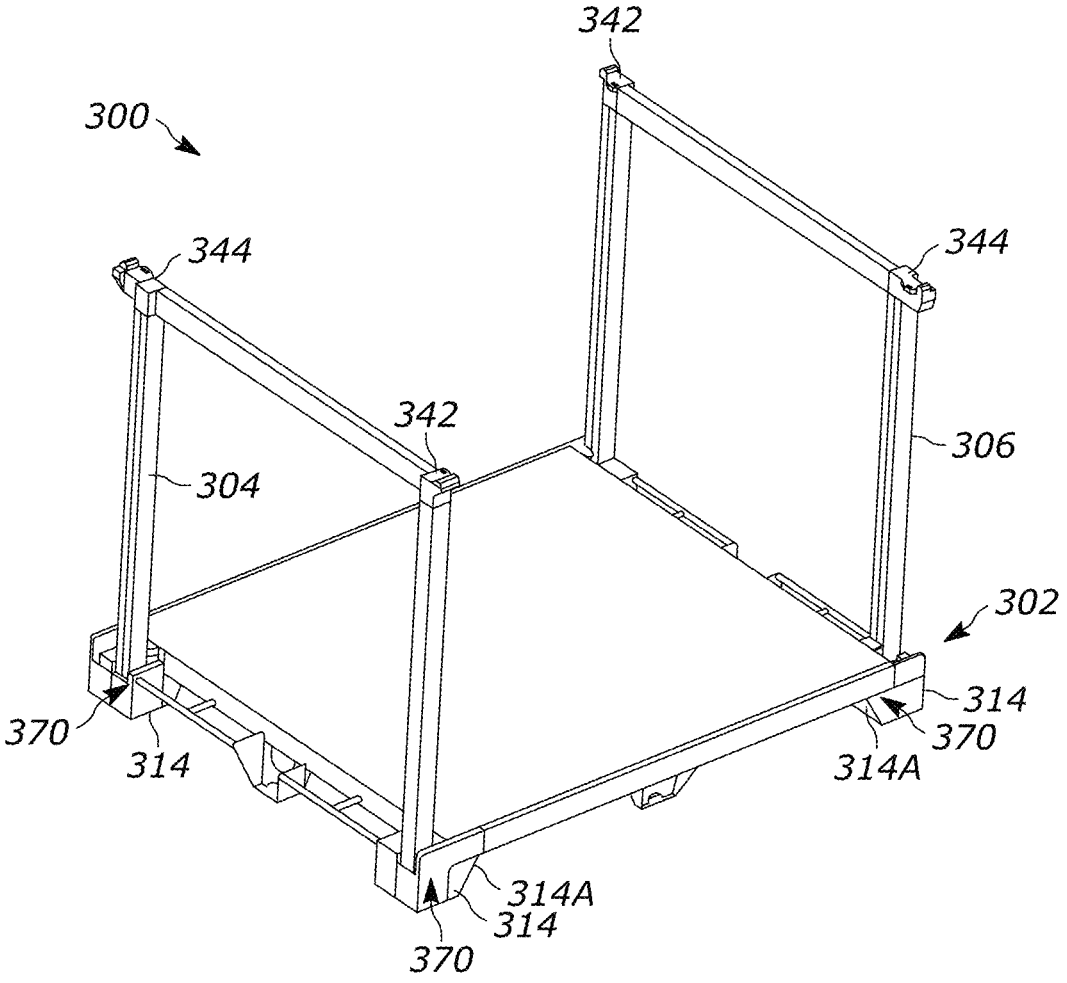
FIG. 26A is a top perspective view of a collapsible crate according to another embodiment.
Figure 26B:
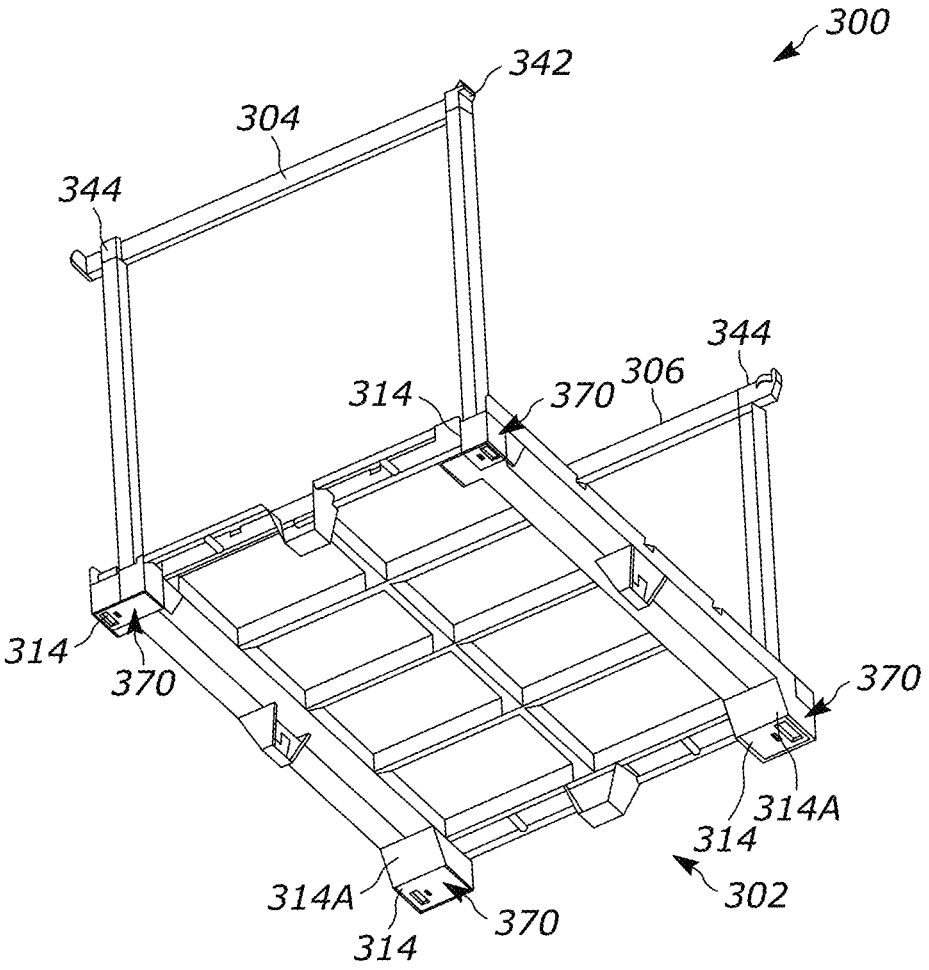
FIG. 26B is a bottom perspective view of the collapsible crate of FIG. 26A.

With respect to FIGS. 26A-26B, a stackable pallet or collapsible crate 300 is provided that is similar in many respects to the embodiments of the collapsible crate 100 discussed above such that the differences will be highlighted. The collapsible crate 300 has a base 302 and side frames 304, 306 extending upward from the base 302. The side frames 304, 306 may be stowed in the base 302 as described above. The base 302 includes corner portions 370 with foot members 314 for supporting a frame 312 of the base 302 above the surface on which the crate 300 rests. In this embodiment, the inner side 314A of the foot members 314 is angled to provide more clearance for forks of lifting equipment. This angled inner side 314A further reduces the material of the foot members 314 which reduces the overall weight of the crate 300.

Figure 27A:
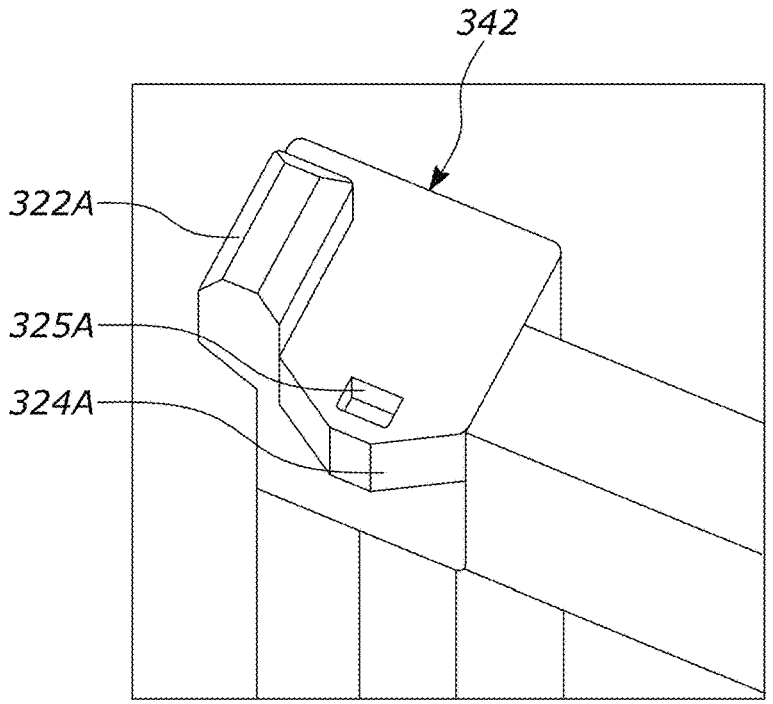
FIG. 27A is a top perspective view of a coupler of a side frame of the collapsible crate of FIG. 26A having a stacking protrusion and nesting protrusion.

The side frames 304, 306 each include a coupler 342 and an extension coupler 344. With respect to FIG. 27A, coupler 342 includes a stacking protrusion 322A and a nesting protrusion 324A. The coupler 342 is similar to the coupler 142 of the crate 100 discussed above such that the differences are highlighted. In this embodiment, the thickness of the body of the nesting protrusion 324A is increased relative to that of the coupler 142 to increase the strength and rigidity of the nesting protrusion 324A. The nesting protrusion 324A includes an opening 325A that is smaller that of the coupler 142 and corresponds to the size and shape of the lock pin of the extension member that is inserted therein. The opening 325A of the nesting protrusion 324A may aid in positioning and limiting movement of the extension member attached thereto.

Figure 27B:
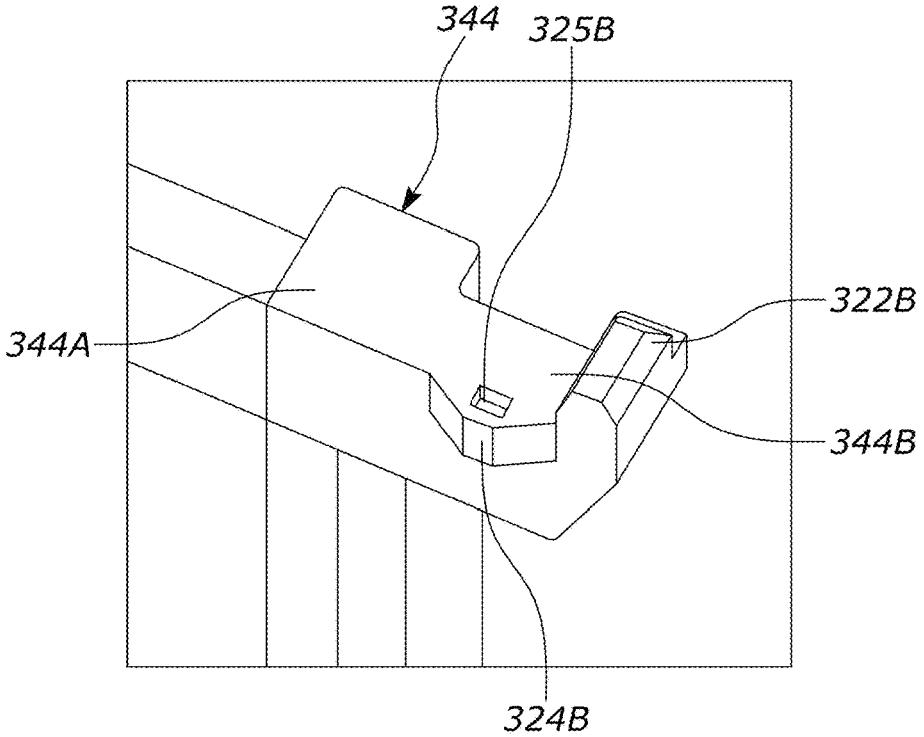
FIG. 27B is a top perspective view of an extension coupler of the side frame of the collapsible crate of FIG. 26A having a stacking protrusion and nesting protrusion supported by an extension.

With respect to FIG. 27B, extension coupler 344 includes a stacking protrusion 322B and a nesting protrusion 324B supported by and extension portion 344B. The extension coupler 344 is similar to the extension coupler 144 of the crate 100 discussed above such that the differences are highlighted. In this embodiment, the thickness of the body of the nesting protrusion 324B is increased relative to that of the extension coupler 144 to increase the strength and rigidity of the nesting protrusion 324B. The nesting protrusion 324B includes an opening 325B that is smaller that of the extension coupler 144 and corresponds to the size and shape of the lock pin of the extension member that is inserted therein. The opening 325B of the nesting protrusion 324B may aid in positioning and limiting movement of the extension member attached thereto.

Figure 28A:
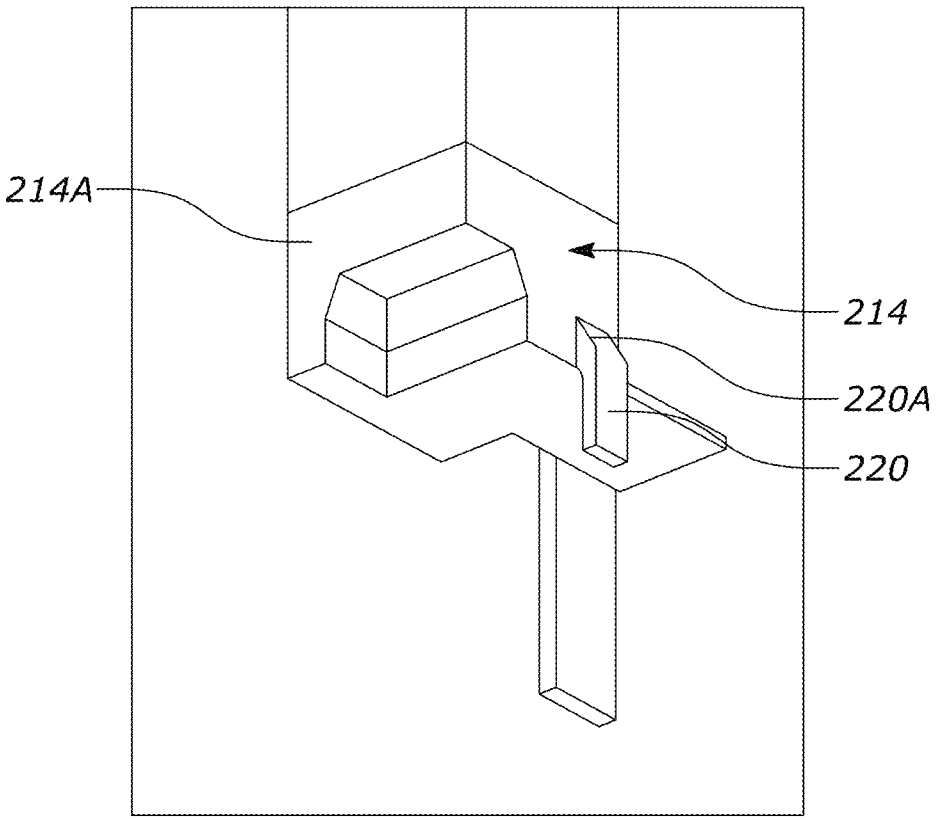
FIG. 28A is a closeup view of a connection portion of the height extension member of FIG. 20 according to another embodiment.
Figure 28B:
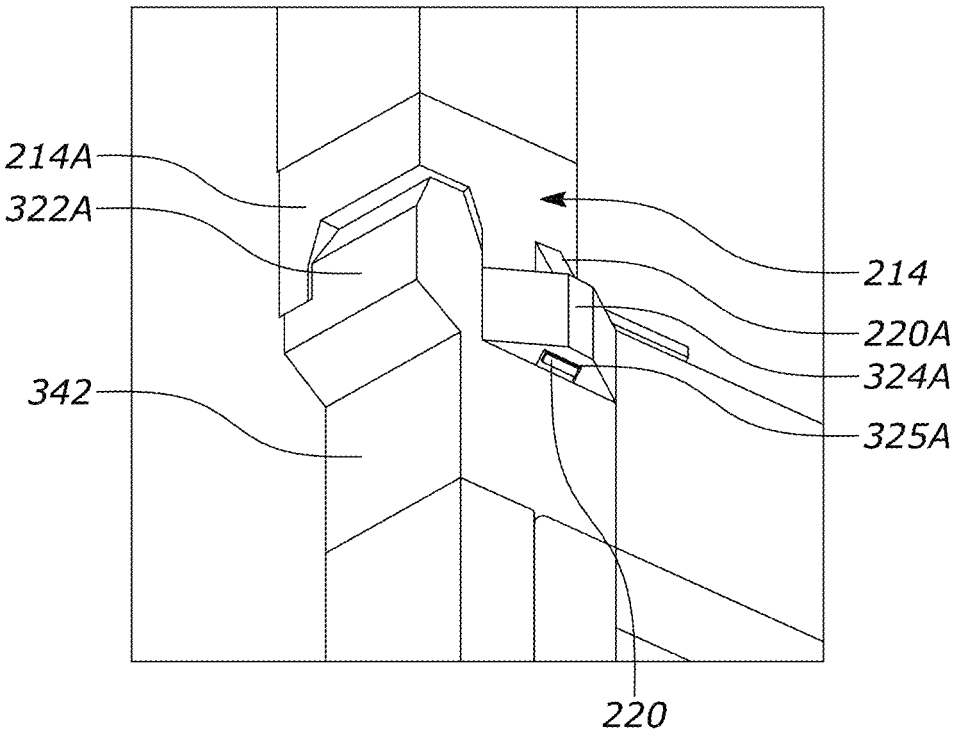
FIG. 28B is a bottom perspective view illustrating the connection portion of the height extension member of FIG. 28A connected to the coupler of a side frame of the collapsible crate of FIG. 26A.
Figure 28C:
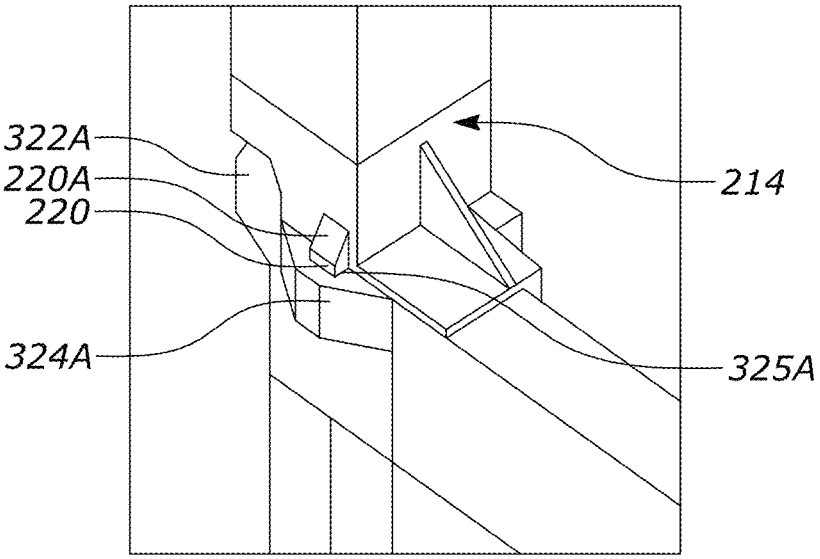
FIG. 28C is a top perspective view illustrating the connection portion of the height extension member of FIG. 28A connected to the coupler of a side frame of the collapsible crate of FIG. 26A.

With respect to FIG. 28A, the second connection portion 214 of the extension member 200 is shown with a locking pin 220 according to embodiment. In this embodiment, the locking pin 220 has an increased thickness and the length of the base 220A of the locking pin 220 that is attached to the body 214A of the second connection portion 214 is increased which increase the strength and rigidity of the locking pin 220. The locking pin 220 of the first connection portion 212 may similarly by modified. With respect to FIGS. 28B-28C, the second connection portion 214 of FIG. 28A, is shown connected to the coupler 342 of FIG. 27A. As shown, the cross-section of the lock pin 220 corresponds to the cross-section of the opening 325A of the nesting protrusion 324A which forms a tighter connection therebetween. The locking pin 220 of the first connection portion 212 similarly forms a tight connection with the extension coupler 344.

Figure 29A:
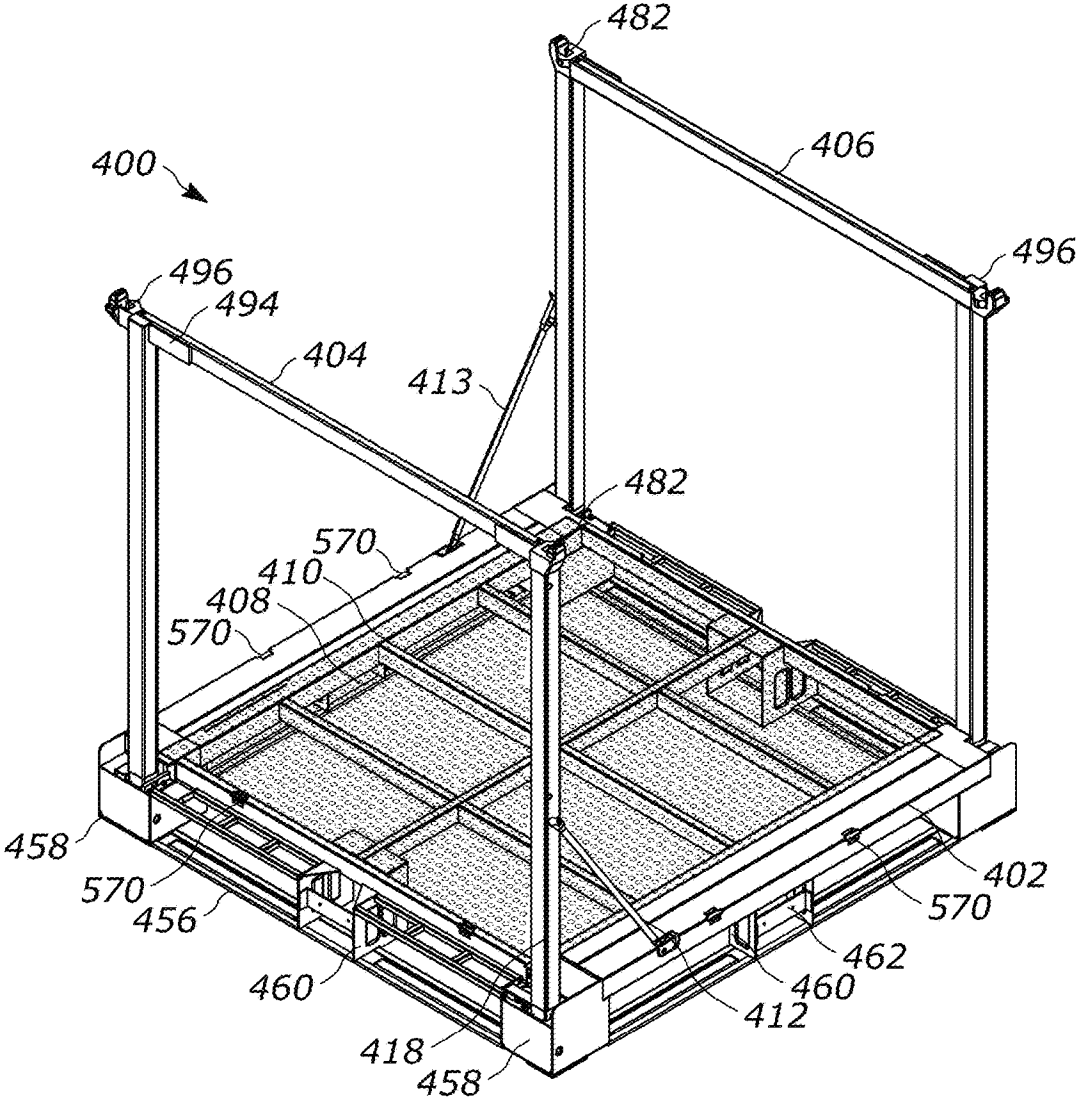
FIG. 29A is a top perspective view of a collapsible crate according to another embodiment.
Figure 29B:
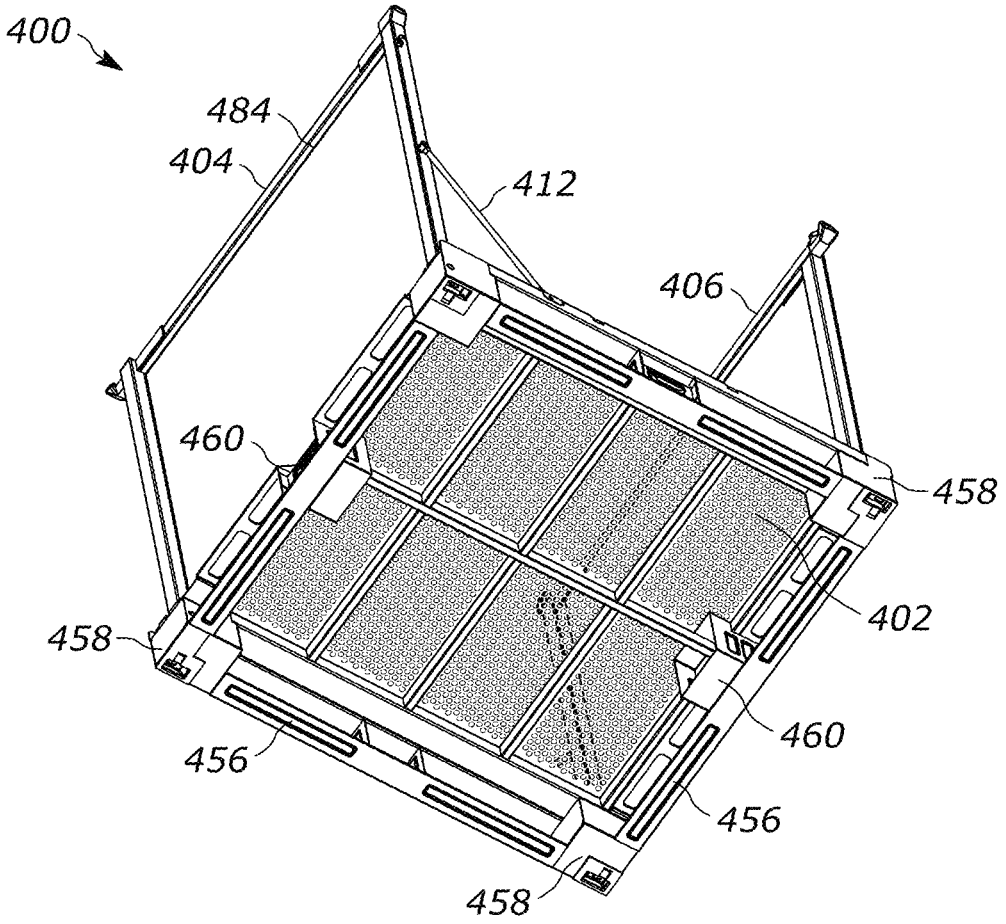
FIG. 29B is a bottom perspective view of the collapsible crate of FIG. 29A.
Figure 29C:
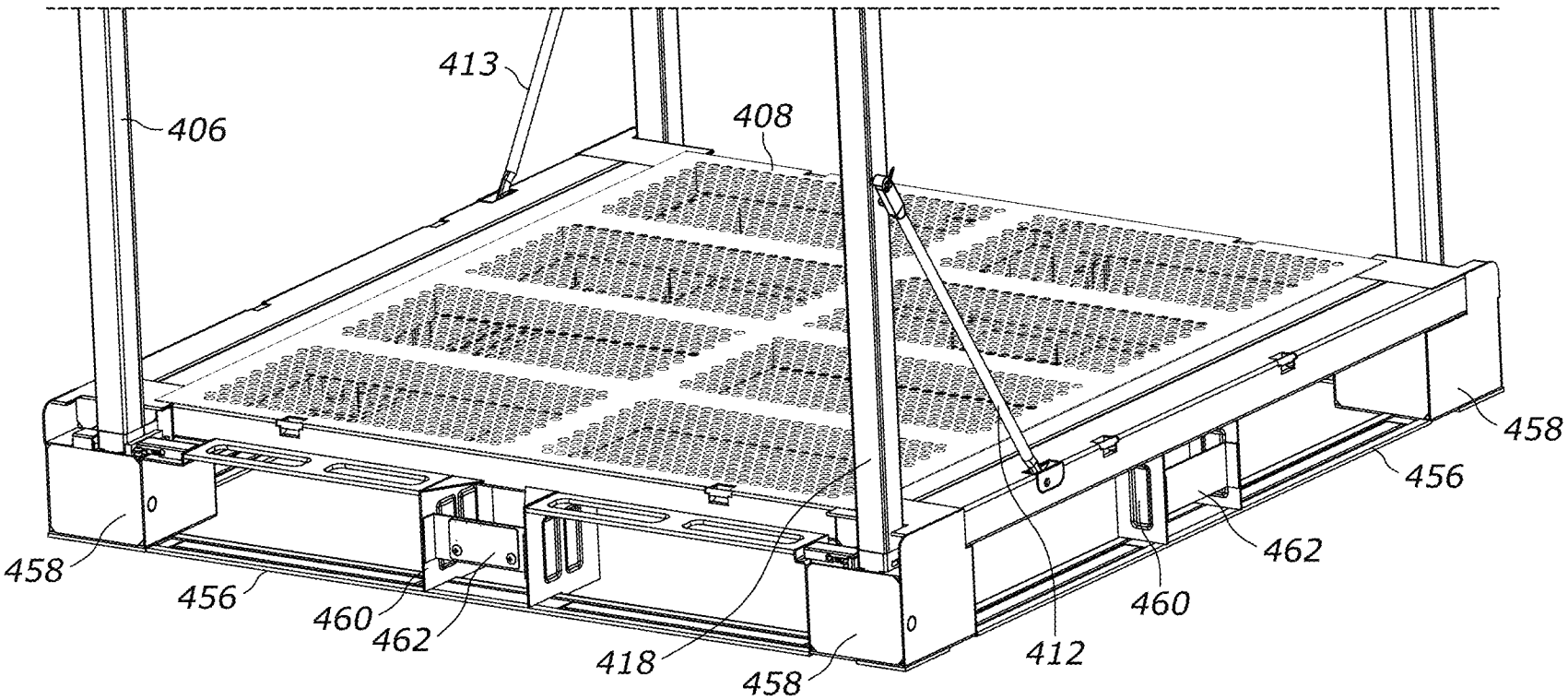
FIG. 29C is a perspective view of a lower portion of the collapsible crate of FIG. 29A.

With respect to FIGS. 29A-29C, a stackable pallet or collapsible crate 400 is shown according to another embodiment. The collapsible crate 400 is similar to the collapsible crate embodiments discussed above such that the differences will be highlighted. The collapsible crate 400 has a base 402 and side frames 404, 406. The side frames 404, 406 are movable between an assembled configuration and a collapsed configuration. In the assembled configuration shown in FIGS. 29A-29C, the side frames 404, 406 extend upward from the base 402. In the collapsed configuration (see FIG. 34), the side frames 404, 406 are stowed on tracks in the base 402 as discussed with respect to the other embodiments above. The collapsible crate 400 may be used similar to a conventional pallet when in the collapsed configuration, capable of supporting items on a support surface 408 of the base 402. In the embodiment shown, the support surface 408 is a mesh plate 410 that extends across an upper portion of the base 402. In other forms, the support surface 408 may be a plate providing a flat, solid surface. Items to be stored and/or transported may be placed on the support surface 408 of the collapsible crate 400. The side frames 404, 406 may be withdrawn from the base 402 to transition the collapsible crate 400 to the assembled configuration to stack another collapsible crate on the collapsible crate 400. The upper collapsible crate is able to rest on the side frames 404, 406 of the lower collapsible crate 400 rather than on any items on the base 102 of the lower crate 400. Stacking the collapsible crates 400 using these rigid side frames 404, 406 permits stacking of heavy crates without damaging items on the crates. Stacking the crates 400 also permits stacking of several crates (e.g., five) in a single stack which enables an efficient use of space because more crates may be stored on the footprint of a single crate, thus taking up less floor space on a vehicle (e.g., a ship) or in a warehouse.

With reference also to FIGS. 30A-30D, the collapsible crate 400 includes support bars 412, 413 that provide support to the side frames 404, 406 when the collapsible crate 400 is in the assembled configuration. The support bars 412, 413 extend from the side frames 404, 406 to the base 402 to brace the side frames 404, 406 from pivoting substantially relative to the base 402 when the side frames 404, 406 are in the assembled configuration. The support bars 412, 413 thus provide increased strength and rigidity to the side frames 404, 406 of the collapsible crate 400 which enables stacking of a greater number of crates 400 in a single stack. For conciseness, the following discussion is made with reference to the support bar 412 that extends from the side frame 404 to the base 102, however, the support bar 413 that extends from the side frame 406 to the base 102 is similar in structure and function. It should be appreciated that the support bars 412, 413 may be used with any of the collapsible crates described herein. The support bar 412 has a first end portion 414 connected to a leg 418 of the side frame 404 and an opposite second end portion 416 that connects to the base 102.

The second end portion 416 of the support bar 412 may be removably connectable to the base 102. The second end portion 416 of the support bar 412 may be connected to the base 102 when the collapsible crate 400 is in the assembled configuration to brace the side frame 404. For instance, the support bar 412 inhibits the side frame 404 from pivoting outward from the base 402. The second end portion 416 may be detached from the base 102 and pivoted upward in direction 420 about the first end portion 414 to a stowed configuration when the collapsible crate 400 is being transitioned to the collapsed configuration. In the stowed configuration, the support bar 412 may extend along the leg 418 of the side frame 404 to permit the side frame 404 to be inserted into the base 402 (see FIG. 30A).

Figure 30A:
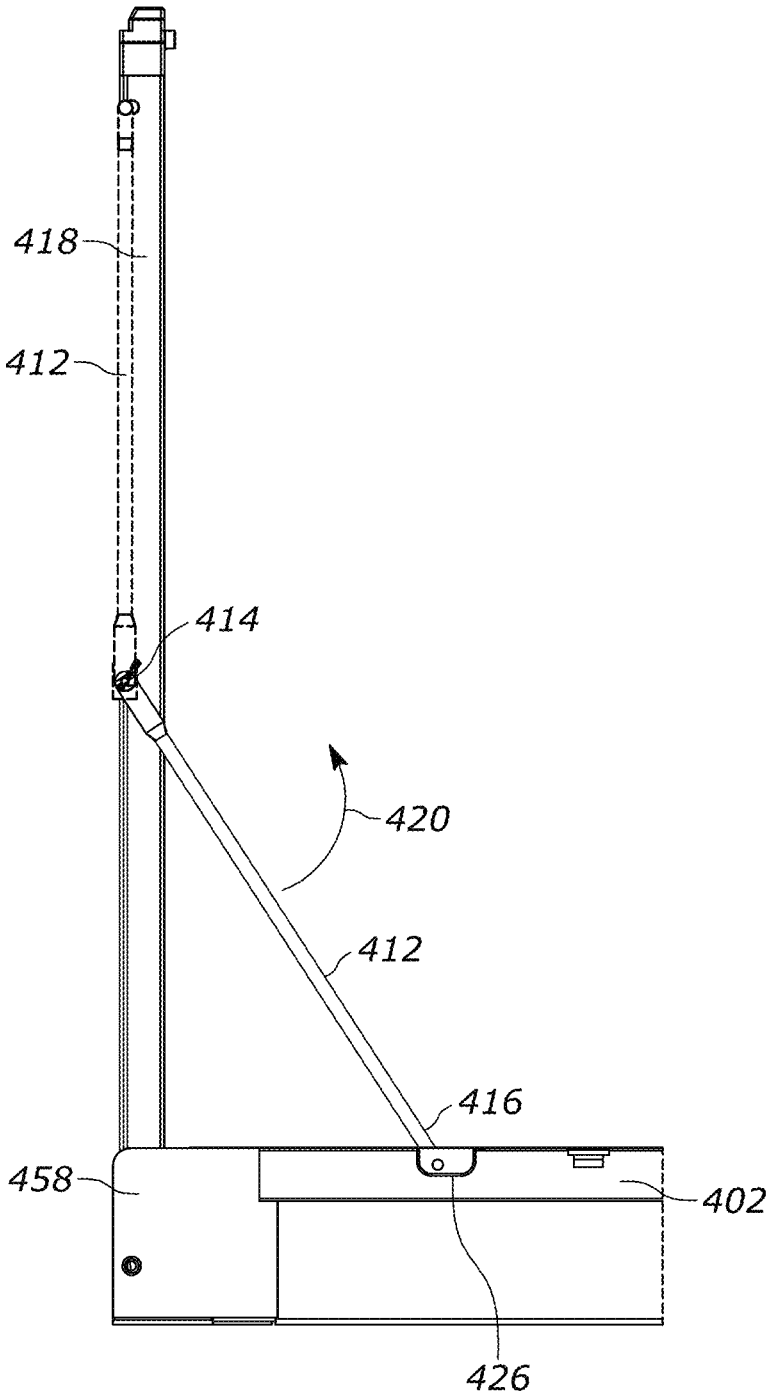
FIG. 30A is a side view of an end of the collapsible crate of FIG. 29A, FIG. 30A showing a support bar between a support wall and a base of the collapsible crate.
Figure 30B:
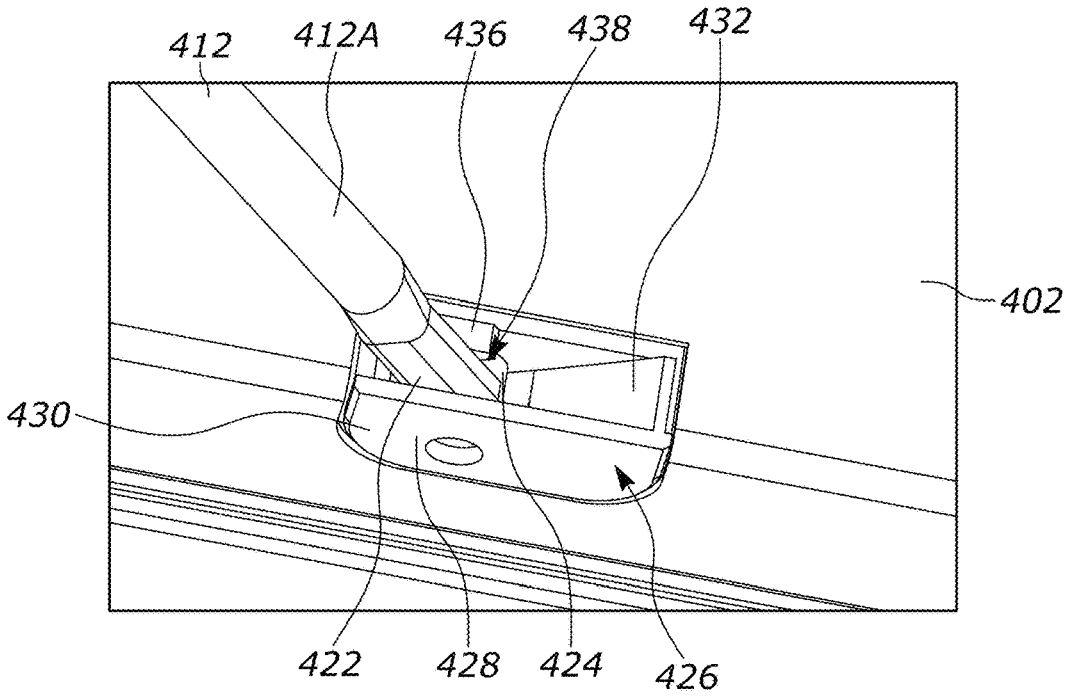
FIG. 30B is a closeup view of the connection between the support bar of FIG. 30A and the base.
Figure 35A:
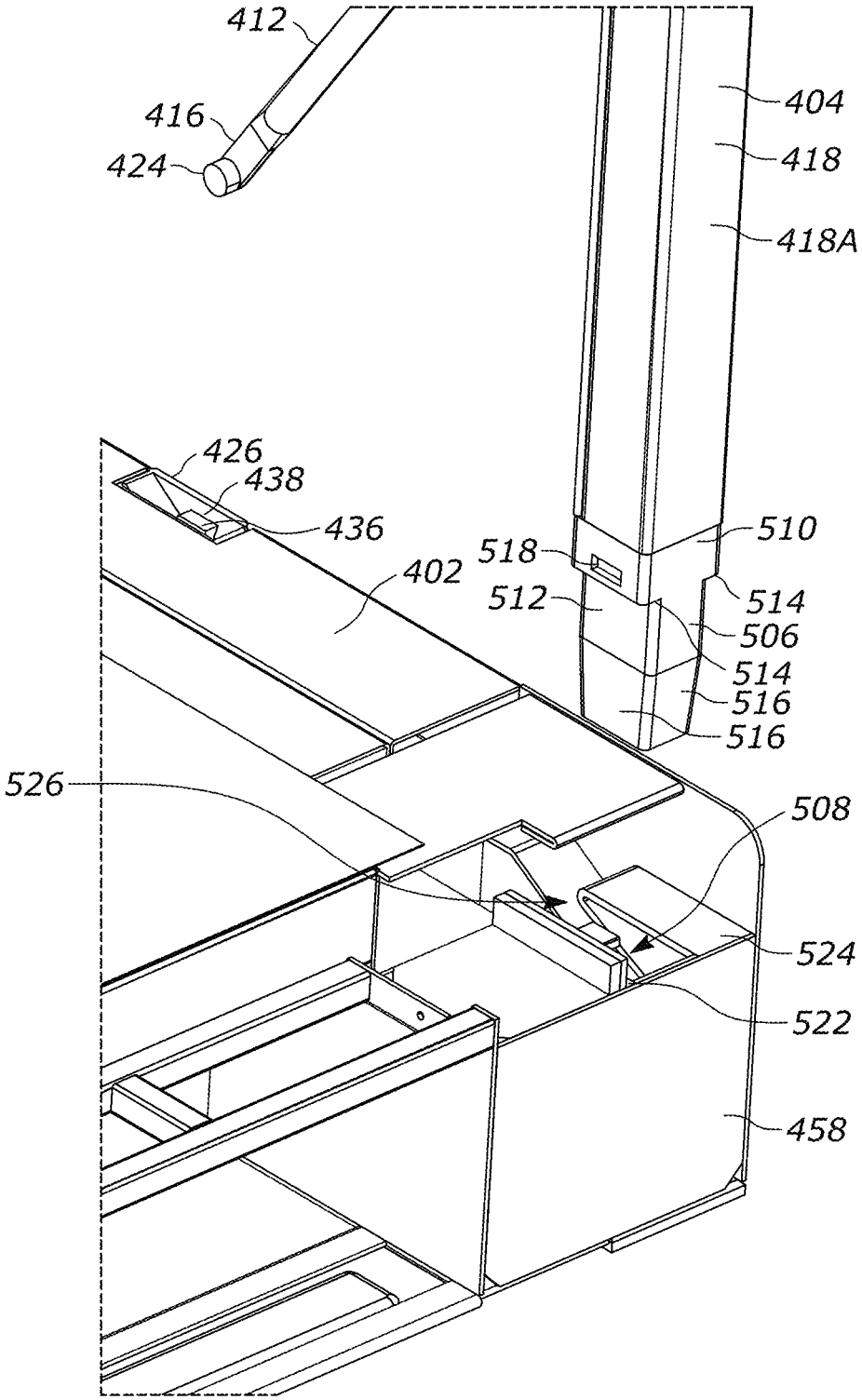
FIG. 35A illustrates an exploded view of a leg of the support wall and the support bar removed from the base of the collapsible crate of FIG. 29A.
Figure 35B:
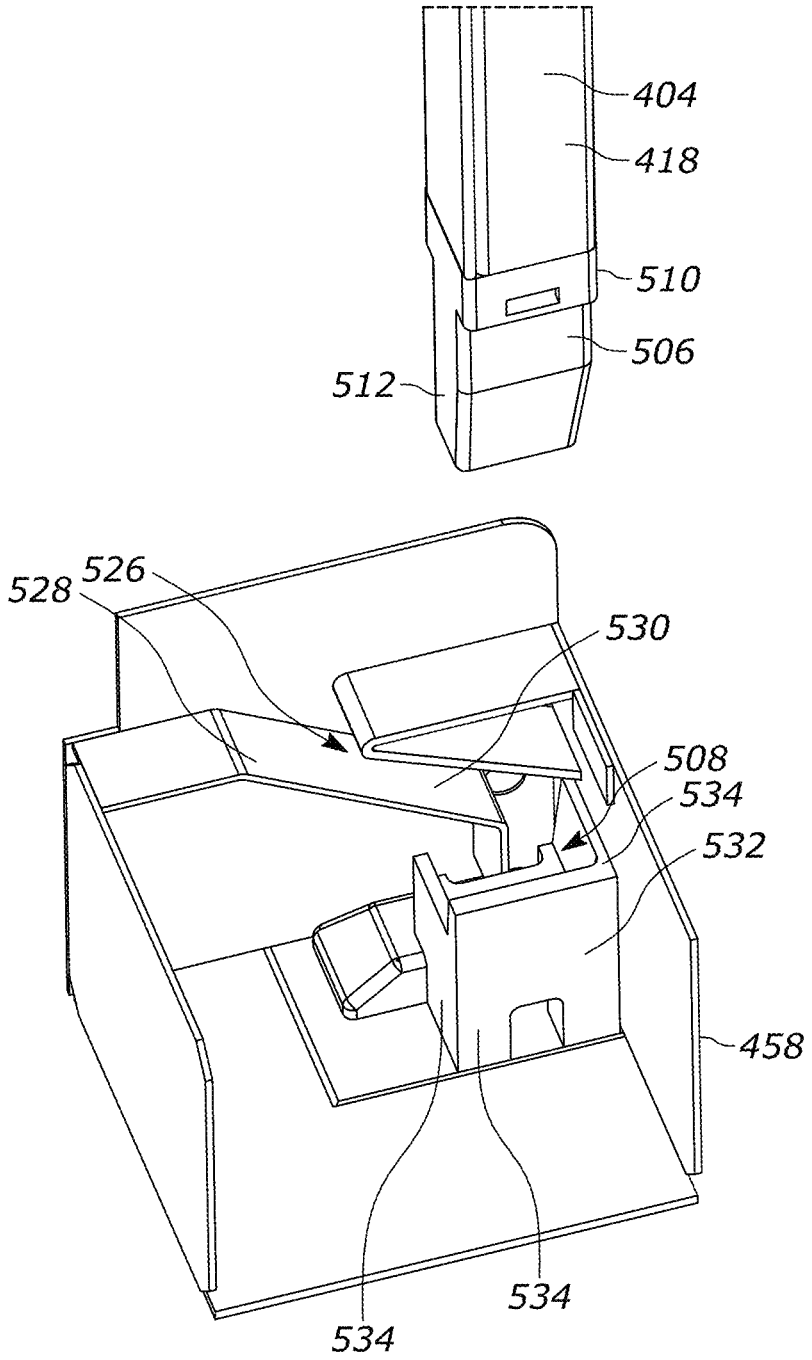
FIG. 35B is an exploded view of the leg of the support wall removed from a corner portion of the base of the collapsible crate of FIG. 29A, the corner portion having a locking recess and a guide slot extending from the locking recess to a track.
Figure 35C:
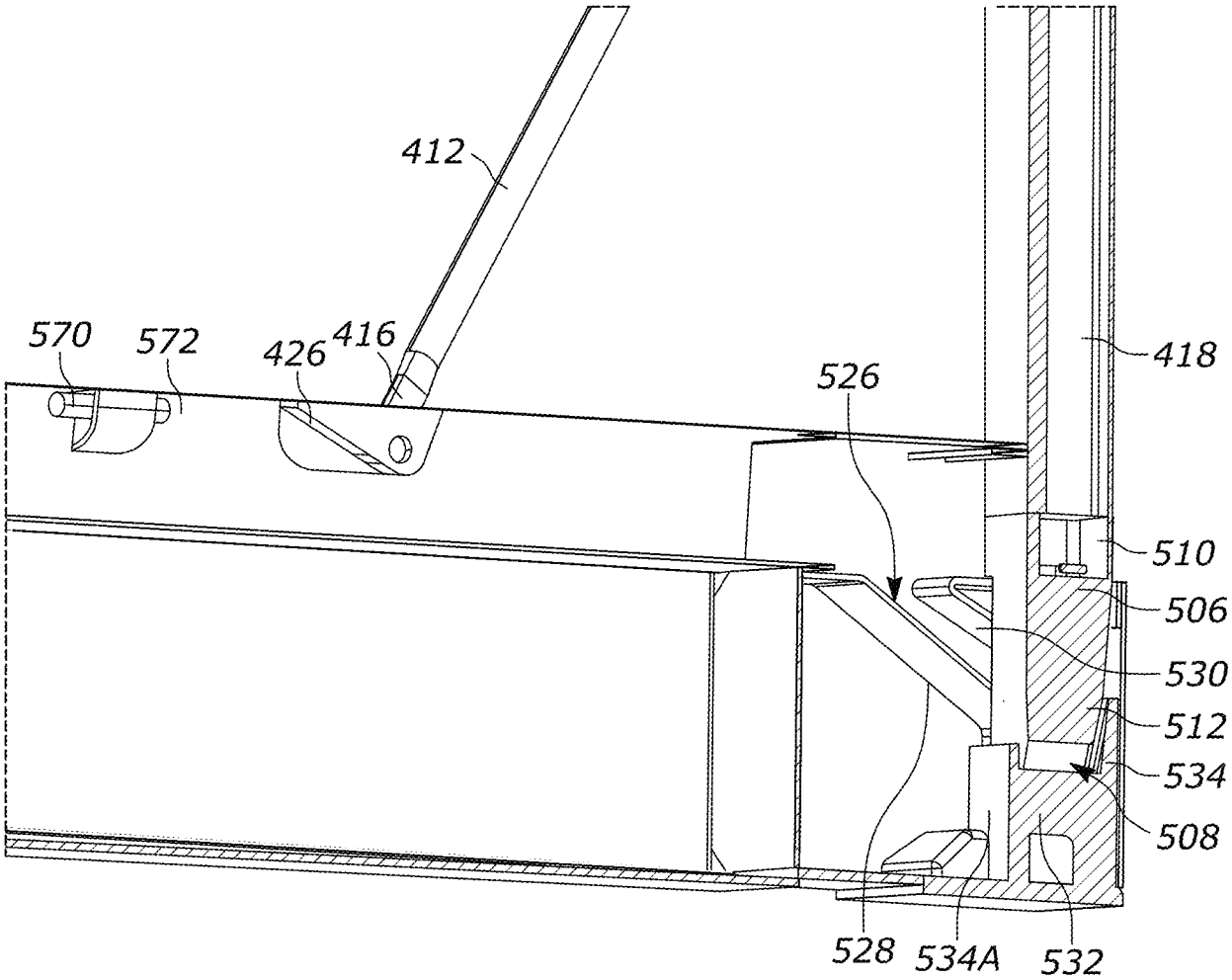
FIG. 35C is a cross-sectional view of a portion of the collapsible crate of FIG. 29A showing the leg of the support wall in the locking recess of the corner portion and the support bar attached to the base.

With reference to FIG. 30B, FIG. 35A and FIG. 35C, the second end portion 416 of the support bar 412 has a hook configuration. The second end portion 416 may have an extension portion 422 extending generally parallel to the length of the support bar 412 and a protrusion or pin portion 424 extending laterally from the extension portion 422. The base 402 of the crate 400 may have a connector 426 to which the second end portion 416 of the support bar 412 is removably attachable. The connector 426 may be inset in the frame 572 of the base 402 and below the support surface 408. The connector 426 includes a connector body 428 having side walls 430 and a guide surface 432 forming a recess 434 for receiving a portion of the second end portion 416 of the support bar 412. The connector 426 includes an upper wall 436 that extends in the recess 434 and forms an attachment slot 438. The pin portion 424 has a width greater than the attachment slot 438.

To attach the second end portion 416 to the base 402, the pin portion 424 is advanced into the recess 434 and slid along the guide surface 432 until the extension portion 422 is in the attachment slot 438 and the pin portion 424 is under the upper wall 436. The side walls 430 inhibit the second end portion 416 from moving laterally in the recess 434 to keep the pin portion 424 under the upper wall 436. The guide surface 432 may be sloped to bias or direct the pin portion 424 to be under the upper wall 436. With the pin portion 424 under the upper wall 436, the upper wall 436 limits upward movement of the pin portion 424 which limits movement of the side frame 404. The extension portion 422 may have a narrowed width relative to a main body 412A of the support bar 412 and the pin portion 424 that is sized to permit the extension portion 422 to slide in the attachment slot 438 of the base 402. The main body 412A of the support bar 412 and/or the pin portion 424 may have a width that is too large to pass through the attachment slot 438. To detach the second end portion 416 from the base 402, the pin portion 424 may be slid upward along the guide surface 432 until the pin portion 424 is no longer under the upper wall 436, at which point the second end portion 416 may be lifted out of the connector 426.

Figure 30C:
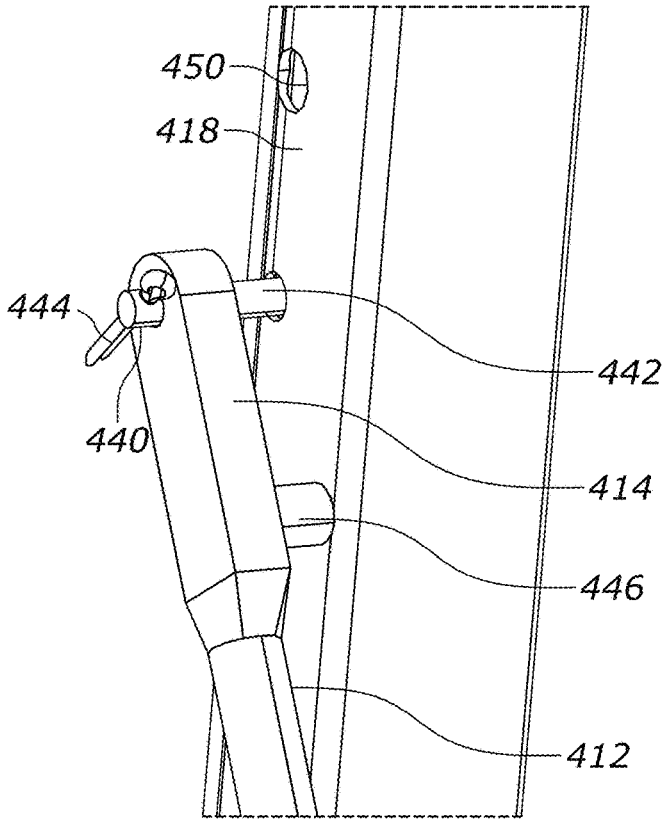
FIG. 30C is a closeup view of the connection between the support bar of FIG. 30A and the support wall, the support bar in a locked configuration.
Figure 30D:
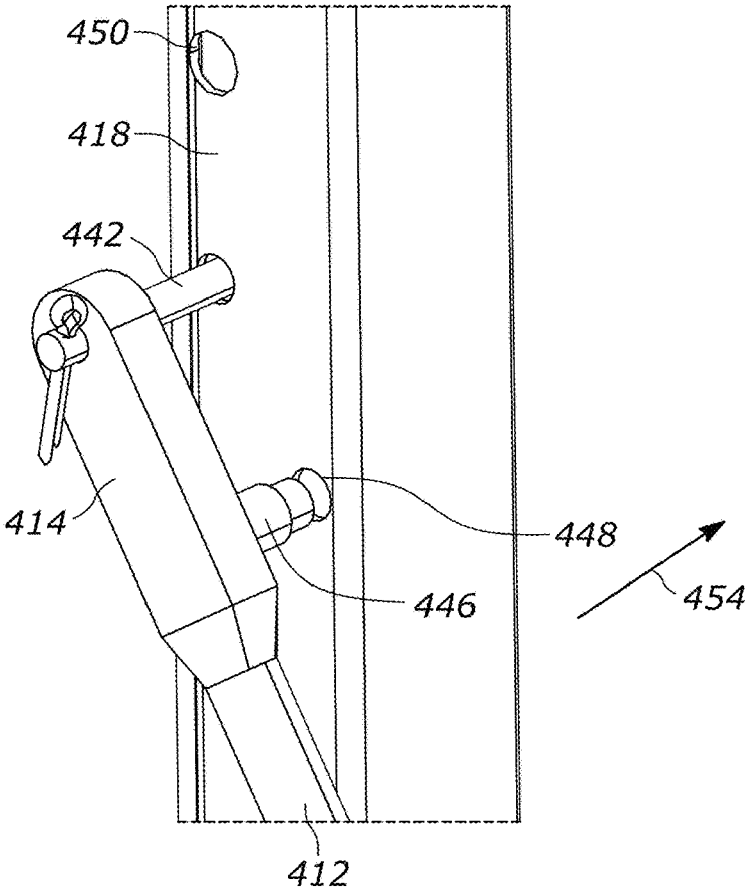
FIG. 30D is a closeup view similar to FIG. 30C, the support bar in a unlocked configuration.

With reference to FIG. 30C-30D, the first end portion 414 of the support bar 412 may be pivotally connected to the leg 418 of the side frame 404. The pivotal connection of the support bar 412 to the side frame 404 permits the support bar 412 to move to the stowed configuration without being detached from the collapsible crate 400. The first end portion 414 of the support bar 412 has an opening 440 through which a pin 442 of the side frame 404 extends. The pin 442 is secured to the leg 418 of the side frame 404 (e.g., by welding). A clip 444 may extend through an end of the pin 442 to secure the first end portion 414 of the support bar 412 to the pin 442 and limit movement of the first end portion 414 along the pin 442. The support bar 412 is rotatable about the connection with the pin 442 to permit the support bar 412 to be moved from the assembled configuration to the stowed configuration.

The first end portion 414 of the support bar 412 may also include a locking pin 446 to fix the support bar 412 in the assembled and stowed configurations. The leg 418 of the side frame 404 includes a first locking opening 448 and a second locking opening 450. The locking pin 446 may be inserted into the first locking opening 448 to fix the support bar 412 in the assembled configuration and inserted into the second locking opening 450 to fix the support bar 412 in the stowed configuration. The first end portion 414 of the support bar 412 may be shifted laterally relative to the leg 418 in direction 454 to insert the locking pin 446 into the first or second locking openings 448, 450. The first end portion 414 of the support bar 412 may be shifted laterally relative to the leg 418 in the direction opposite direction 454 to withdraw the locking pin 446 from the first or second locking openings 448, 450 to permit the support bar 412 to be transitioned between the stowed or assembled configurations.

With reference again to FIGS. 29A-29C, the base 402 of the collapsible crate 400 may include runners 456 that extend between corner portions 458 of the base 402. The runners 456 may extend along and rest on the surface on which the collapsible crate 400 rests (e.g., the ground or a floor). The runners 456 provide surfaces to support the collapsible crate 400 on a conveyor, such as a roller or chain conveyor. The conveyor may contact the runners 456 to move the collapsible crate 400 along the conveyor system. The runners 456 provide the base 402 with increased rigidity. The runners 456 also connect the corner portions 458 to support members 460 positioned along the sides of the base 402 between the corner portions 458. The support members 460 may include a mounting bracket 462 to which RFID tags may be mounted. The radio-frequency identification (RFID) tags may be used to track the collapsible crate 400 or the contents carried by the collapsible crate 400. For example, the RFID tags may store information pertaining to the items supported by the collapsible crate 400. During shipping, the RFID tags may be scanned at various points (e.g., when loaded onto a vehicle or stored in a warehouse) to enable tracking of the items and/or collapsible crate 400. The support members 460 may form walls about the mounting bracket 462 to protect the RFID tags and inhibit inadvertent contact with the RFID tags that could cause damage to the RFID tags.

Figure 31:
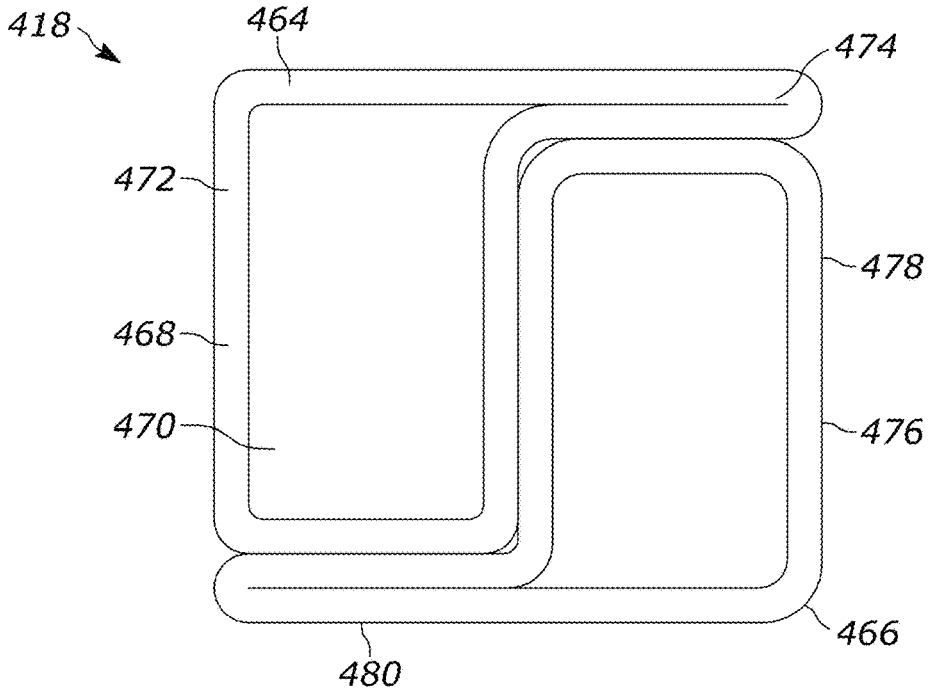
FIG. 31 is a cross-sectional view of a leg of the support wall of the collapsible crate of FIG. 29A.

With reference to FIG. 31, a cross-section of the leg 418 of the side frame 404 is shown. The other legs of the side frames 404, 406 may have a similar configuration. The leg 418 is formed of a first support column 464 and a second support column 466 welded together. The first support column 464 has a wall 468 that extends about an interior 470. The wall 468 has a rectangular portion 472 and a folded portion 474 extending from a corner of the rectangular portion 472 where the wall 468 is folded back on itself. The second support column 466 similarly has a wall 476 forming a rectangular portion 478 and a folded portion 480. The first support column 464 and second support column 466 are joined together in an opposite, but generally cooperating configuration with the folded portion 474 of the first support column 464 opposite the folded portion 480 of the second support column 466. The folded portion 474 of the first support column 464 extends along a portion of the rectangular portion 478 of the second support column and the folded portion 480 of the second support column 466 extends along the rectangular portion 472 of the first support column 464 to provide increased support and rigidity to the leg 418. The folded configurations of the first and second support columns 464, 466 provide for increased strength of the leg while minimizing the weight by having a hollow interior.

Figure 32:
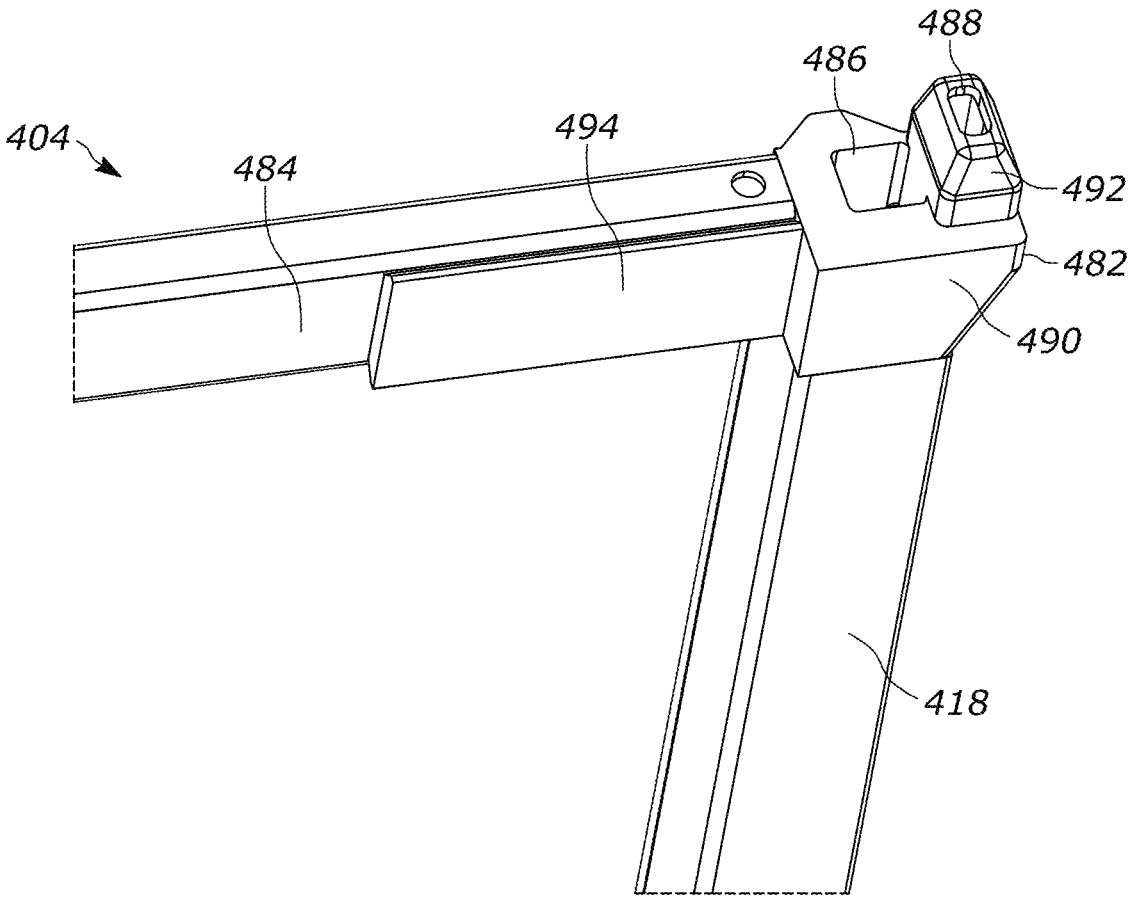
FIG. 32 is a top perspective view of a corner of the support wall of the collapsible crate of FIG. 29A.

With respect to FIG. 32, the side frame 404 has a coupler 482 at the corner of the leg 418 and an upper crossmember 484. The coupler 482 is similar to the couplers of the embodiment discussed above. The coupler 482 has an opening 486 extending into the main body 490 of the coupler 482 and an opening 488 in the attachment protrusion 492. The openings 486, 488 may reduce the material and the weight of the coupler 482 while maintaining sufficient strength to support another collapsible crate 400 thereon. The side frame 404 may also include a plate 494 attached to the upper crossmember 484 adjacent the coupler 482. The plate 494 contacts the base 402 when the side frame 404 is in the collapsed configuration. The plate 494 increases the strength of the crossmember 484 of the side frame 404. The extension coupler 496 (see FIG. 29A) may similarly include openings in the main body and attachment protrusion of the extension coupler 496. The side frame 404 may also include a plate 494 attached to the crossmember 484 adjacent to the extension coupler (see FIG. 29A).

Figure 33:
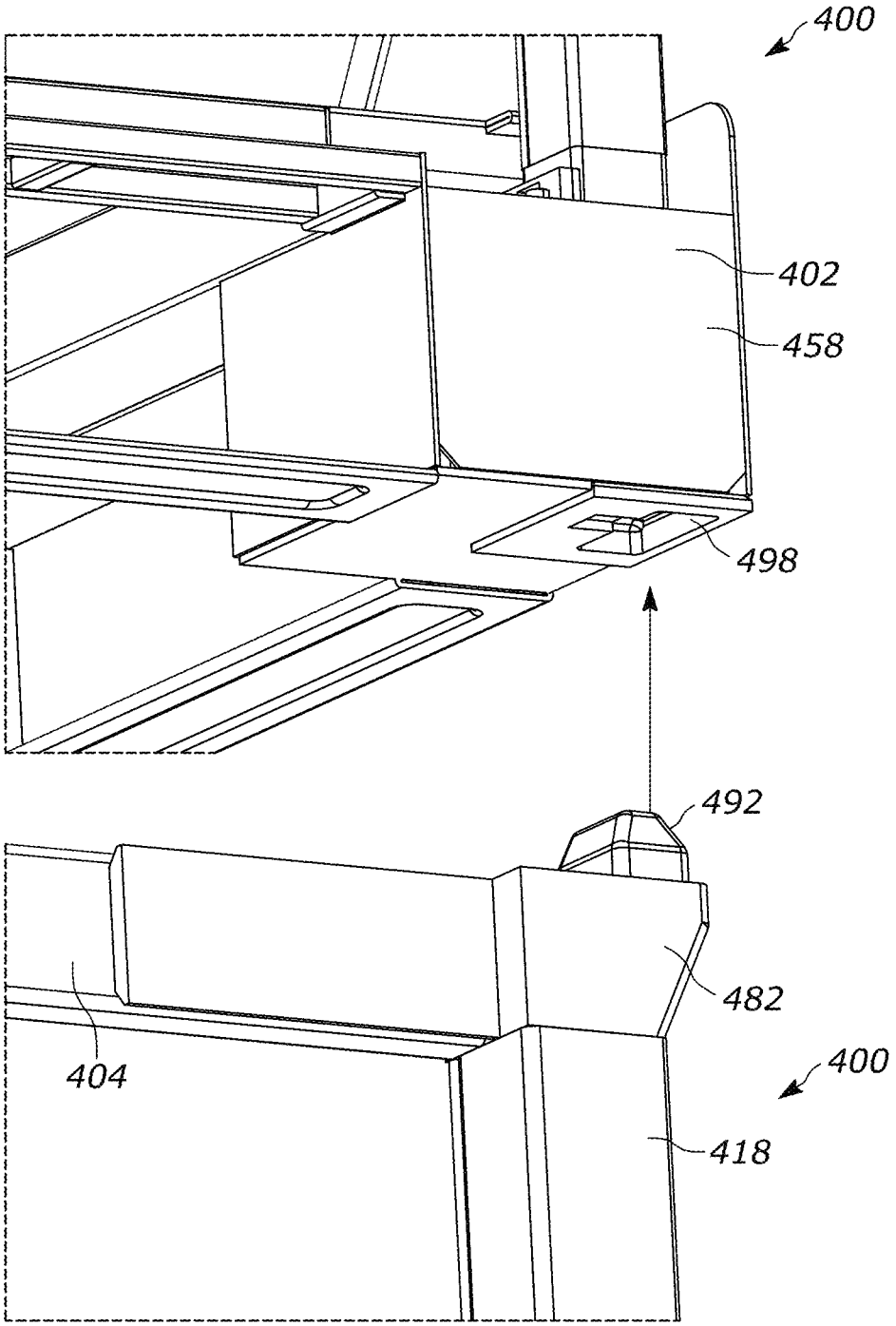
FIG. 33 illustrates the connection of collapsible crates of FIG. 29A when stacked with another collapsible crate in the assembled configuration.

With respect to FIG. 33, the connection between collapsible crates 400 is shown when stacking a crate 400 on an assembled crate 400. The corner portion 458 of the base 402 of the crate 400 has a recess 498 sized to receive the attachment protrusion 492 of the coupler 482. The attachment protrusion 492 is aligned with the corresponding recess 498 of the corner portion 458 of the base 402. The upper crate 400 may be lowered toward the lower crate 400 to insert the attachment protrusion 492 into the recess 498. The other corner portions 458 of the base 402 similarly have recesses that are aligned with and receive the attachment protrusions of the other coupler 482 and extension couplers 496 of the lower crate 400 as the upper crate 400 is lowered onto the lower crate 400. The upper crate 400 is lowered until the upper crate 400 rests on the side frames 404, 406 of the lower crate 400. The connection between the attachment protrusions of the lower crate 400 and the corner portions 458 of the upper crate 400 inhibit the crates from moving laterally relative to one another.

Figure 34:
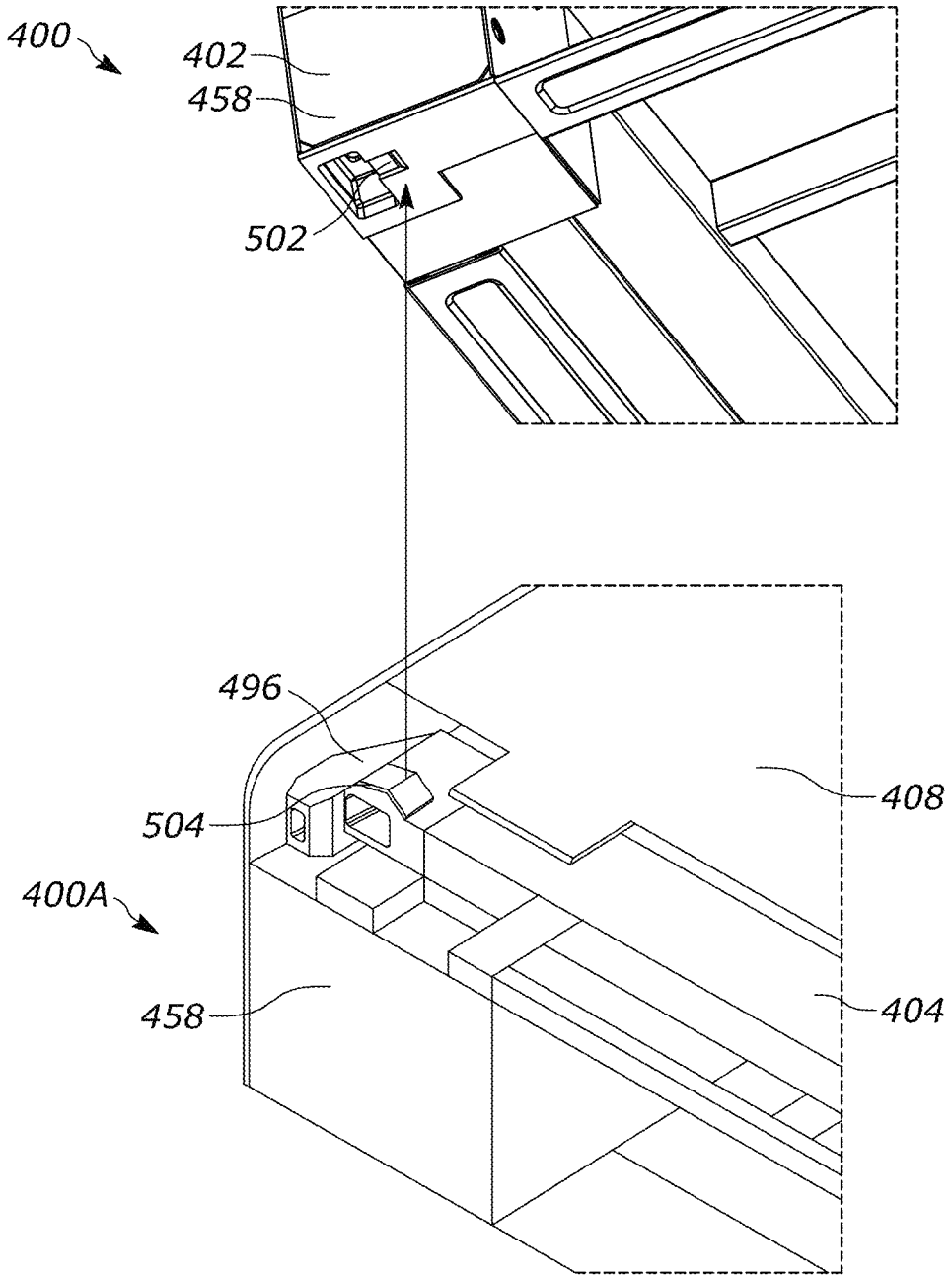
FIG. 34 illustrates the connection of collapsible crates similar to that of FIG. 29A when stacked with another collapsible crate in the collapsed configuration.

With respect to FIG. 34, the connection between collapsible crates 400 is shown when stacking a crate 400 on a collapsed crate 400A, which is similar to the collapsible crate 400 discussed above. The corner portion 458 of the base 402 of the crate 400 has a recess 502 sized to receive the nesting protrusion 504 of the extension coupler 496. The nesting protrusion 504 is aligned with the corresponding recess 502 of the corner portion 458 of the base 402. The upper crate 400 may be lowered toward the lower crate 400A to insert the nesting protrusion 504 into the recess 502. The other corner portions 458 of the base 402 similarly have recesses that are aligned with and receive the nesting protrusions of the couplers 482 and other extension coupler 496 of the lower crate 400A as the upper crate 400 is lowered onto the lower crate 400A. The upper crate 400 is lowered until the upper crate 400 rests on the lower crate 400A. The connection between the nesting protrusions of the lower crate 400A and the corner portions 458 of the upper crate 400 inhibit the crates from moving laterally relative to one another when stacking on a collapsed crate 400.

With respect to FIGS. 35A-35C, the side frame 404 may be connected to the base 402 of the collapsible crate 400 when in the assembled configuration and in the collapsed configuration. Further, a portion of the side frame 404 may remain connected to and/or within the base 402 when in and moving between the assembled and collapsed configurations. The leg 418 of the side frame 404 has an end portion 506 at the lower end of the leg 418. While the following discussion refers to the leg 418 and its corresponding corner portion 458 for conciseness, the other corner portions 458 and legs of the side frames 404, 406 of the collapsible crate 400 may have similar structure and function. The end portion 506 of the leg 418 is sized to connect to a locking recess 508 of the corner portion 458 of the base 402 to secure the leg 418 in an upright position. The end portion 506 has a base 510 and an insertion portion 512. The base 510 is coupled to the main member 418A of the leg 418. The base 510 may be secured to the main member 418A of the leg 418 by welding or a friction or snap fit connection therebetween. The base 510 may include a lock opening 518 to receive a lock pin 520 of the base 402 of the crate 400 to lock the leg 418 to the base 402 when in the assembled configuration as discussed in further detail below.

The insertion portion 512 extends from the base 510. The insertion portion 512 is sized to be inserted into the locking recess 508. The insertion portion 512 may have a narrowed width relative to the base 510 forming steps 514. The steps 514 may limit insertion of the end portion 506 into the locking recess 508 and rest on support surfaces 522, 524 of the base 402 about the locking recess when the end portion 506 is inserted in the locking recess 508. The insertion portion 512 may include tapered sides 516 to facilitate insertion into the locking recess 508 of the base 402. Including tapered sides 516 on the insertion portion 512 may also reduce the force required to withdraw the end portion 506 from the locking recess 508 (e.g., when transitioning to the collapsed configuration), because the surface area of the insertion portion 512 that is in frictional contact with the locking recess 508 is reduced as the side frame 404 is lifted from the base 402 of the crate 400.

The corner portion 458 of the base 402 has a guide slot 526 formed by a lower guide 528 and upper guide 530. The guide slot 526 directs movement of a guide pin 536 (see FIGS. 36A-36E) of the side frame 404 as the side frame 404 is transitioned between the assembled and collapsed configurations as discussed below. The guide slot 526 thus directs movement of the end portion 506 of the leg 418 between the locking recess 508 and a track 542 on which the leg 418 rests when in the collapsed configuration.

The corner portion 458 includes a receiver body 532 having sidewalls 534 that form the locking recess 508 to receive the insertion portion 512 of the leg 418 of the side frame 404. The inner surfaces of the sidewalls 534 may have a taper corresponding to the taper of the insertion portion 512 of the leg 418 to receive the insertion portion 512 therein (see FIG. 35C). The height of the inner sidewall 534A (see FIG. 35C) may be shorter than the other sidewalls 534 to permit the end portion 506 of the leg 418 to pivot when transitioning between the assembled and collapsed configurations as discussed below. The receiver body 532 is positioned adjacent to the guide slot 526. The receiver body 532 may open up to the guide slot 526 to permit the guide pin 536 of the side frame 104 to extend into the guide slot 526 when the leg 418 is inserted into the locking recess 508. For example, the receiver body 532 may not have a sidewall 534 on the side of the receiver body 532 adjacent the guide slot 526. As another example, the receiver body 532 may have a slot or opening in the sidewall 534 adjacent the guide slot 526 that the guide pin 536 extends through to the guide slot 526.

Figure 36A:
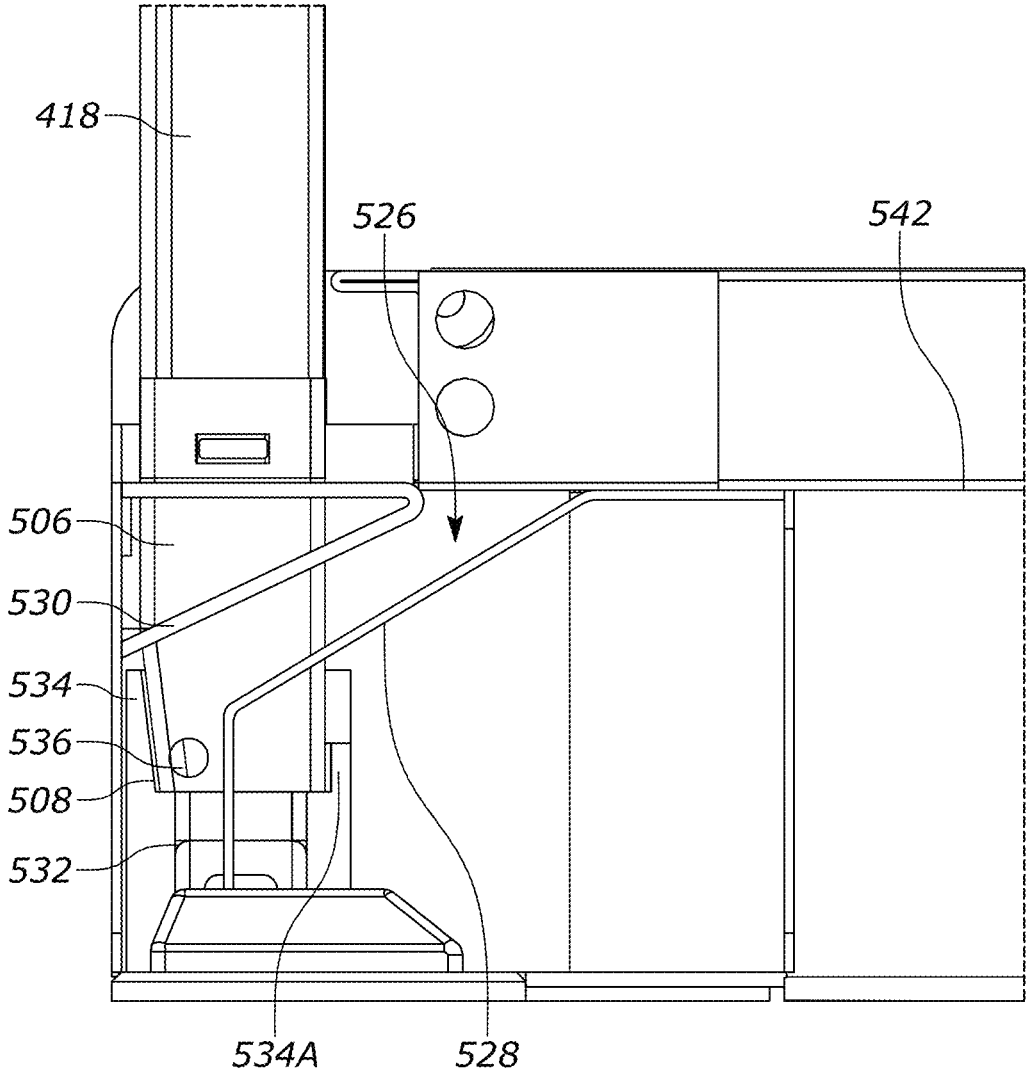
FIG. 36A is a side view of the corner portion of the collapsible crate of FIG. 29A with a cover panel removed to show the leg of the support wall in the locking recess.

With respect to FIGS. 36A-36E, the process for transitioning the crate 400 between the assembled and collapsed configurations is described. As shown in these figures, at least a portion of the leg can remain connected to and/or within a portion of the base 402 when moving between the assembled and collapsed configurations. FIG. 36A illustrates a side view of the crate 400 in the assembled configuration with panels on the side of the base 402 removed to show the end portion 506 of the leg 418 and the guide slot 526. While the following discussion refers to the leg 418 of the side frame 404, the other legs of the crate 400 may similarly transition between assembled and collapsed configurations. As shown in FIG. 36A, the side frame 404 extends upright relative to the support surface 408 of the base 402. The end portion 506 of the leg 418 is fully inserted into the locking recess 508 with the guide pin 536 extending into the guide slot 526. The sidewalls 534, 534A of the locking recess 508 inhibit the leg 418 of the side frame 404 from pivoting relative to the base 402.

Figure 36B:
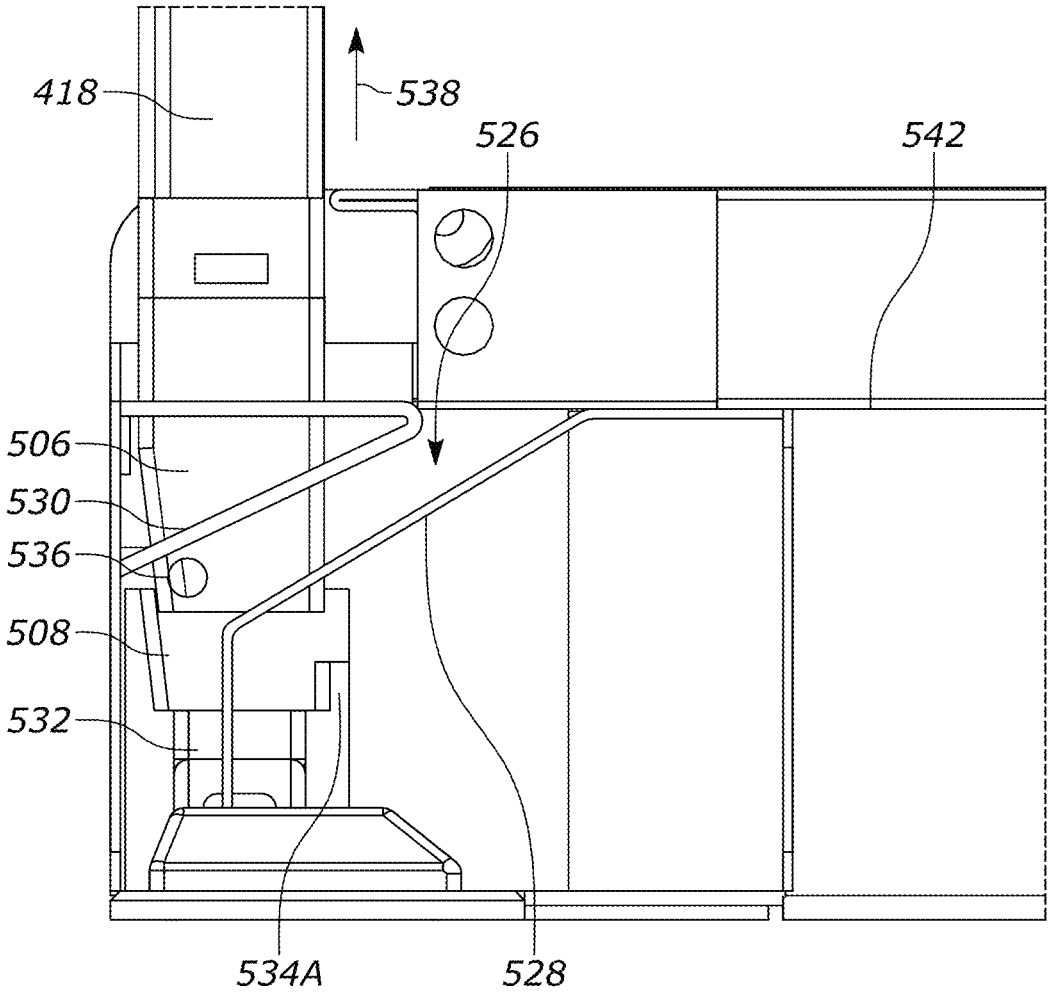
FIGS. 36B-36E are a side views similar to that of FIG. 36A illustrating the movement of the leg of the support wall as the support wall is moved from the assembled configuration to the collapsed configuration.
Figure 36C:
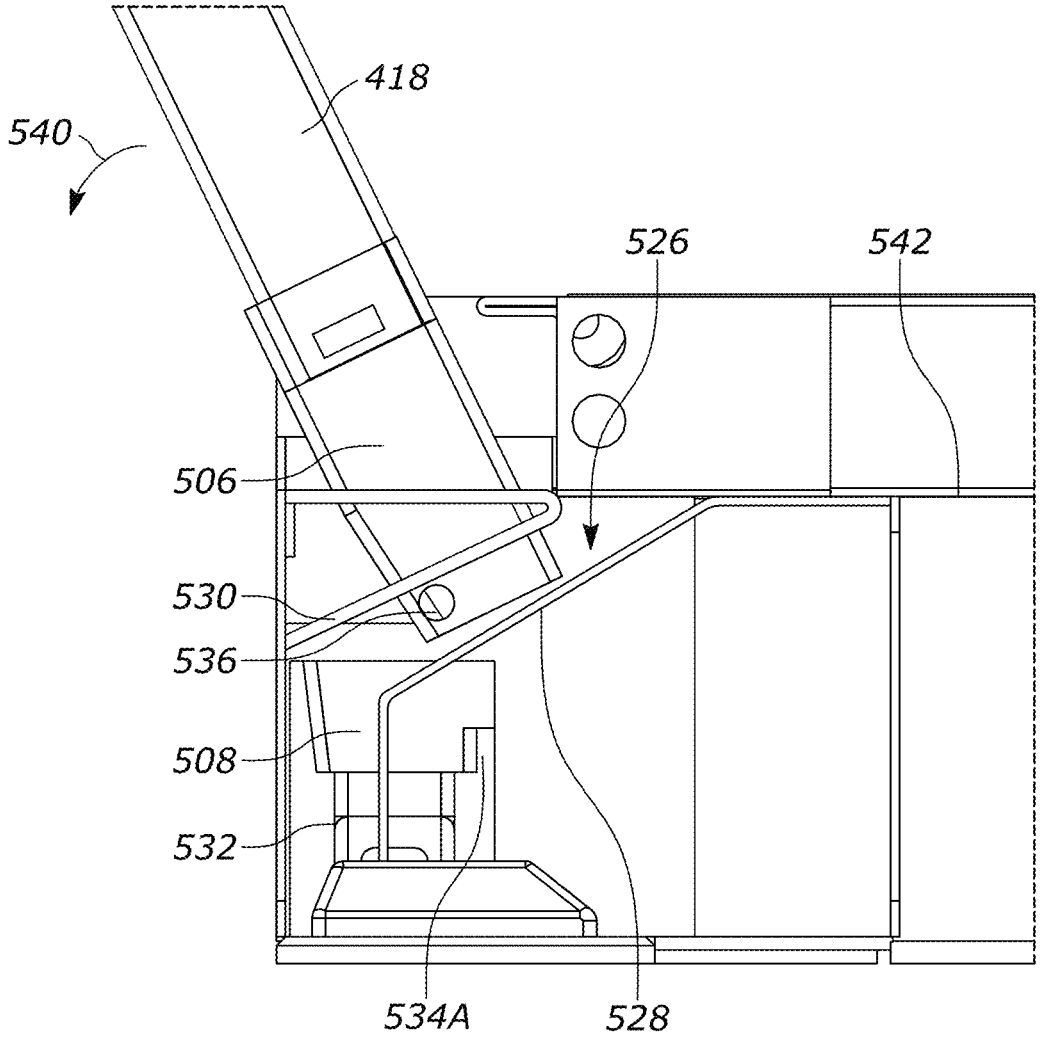
Figure 36D:
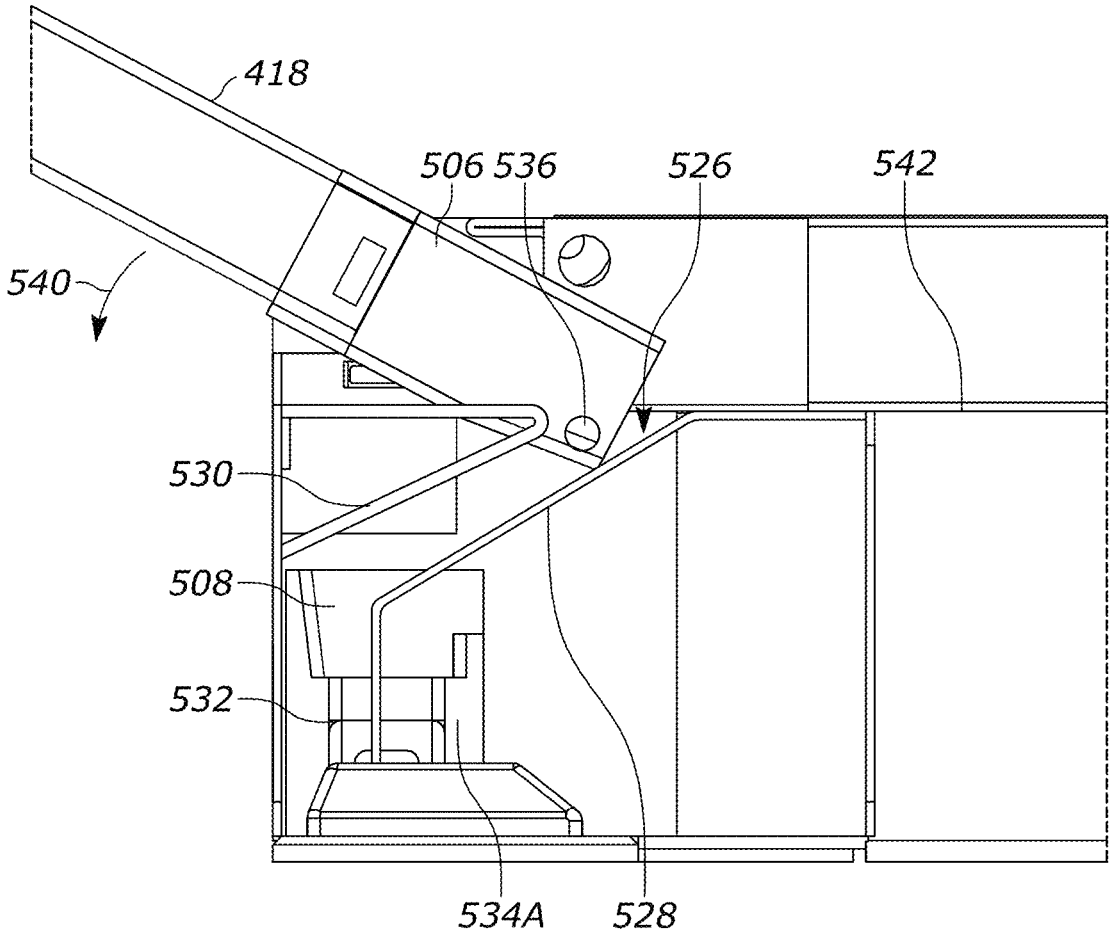

With reference to FIG. 36B, the side frame 404 may be lifted upward in direction 538 to lift the end portion 506 of the leg 418 of the side frame 404 upward relative to the receiver body 532 and above the inner sidewall 534A. For example, a user may grasp the side frame 404 and lift the side frame 404 in direction 538. As the side frame 404 is lifted, the guide pin 536 may be brought into contact with the upper guide 530 of the guide slot 526 to limit how far the side frame 404 is able to be moved in direction 538. The upper guide 530 may be sloped or angled such that when the guide pin 536 is brought into contact with the upper guide 530, the upper guide 530 directs the guide pin 536 at an angle along the guide slot 526. The lower guide 528 may also be angled or sloped to direct the guide pin 536 at an angle along the lower guide 528 when the guide pin 536 contacts the lower guide 528. With reference to FIG. 36C-

36D, once the side frame 404 is lifted from the locking recesses 508, the upper portion of the side frame 404 may be progressively pivoted outward and downward in direction 540 to align the leg 418 of the side frame 404 with the track 542 of the base 402. As shown, as the side frame 404 is pivoted, the guide pin 536 of the side frame 404 slides along the guide slot 526 from the locking recess 508 toward the track 542. The guide pin 154 may contact the upper guide 530 and/or lower guide 528 of the guide slot 526 as the side frame 404 is pivoted which direct the end portion 506 of the side frame 404 along the guide slot 526 toward the track 542.

Figure 36E:
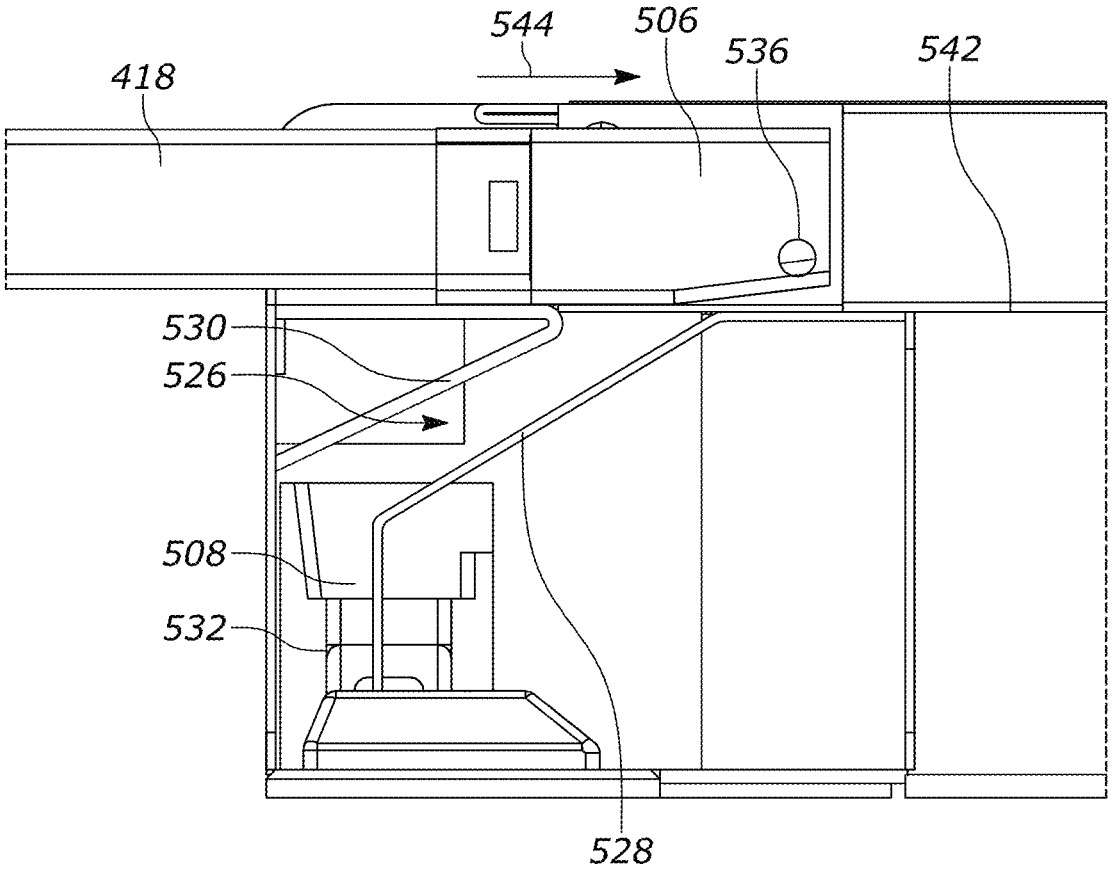

With respect to FIGS. 36E, once the side frame 404 has been pivoted outward until the leg 418 is substantially parallel with the track 542, the side frame 404 may be slid inward in direction 544 along the track 542 of the base 102 to stow the side frame 404 in the base 402. The second side frame 406 may be inserted into the base 402 similar to the first side frame 404 described above to place the crate 400 in the collapsed configuration.

The crate 400 may be moved from the collapsed configuration to the assembled configuration by reversing the steps described above with respect to FIGS. 36A-36E. The support frame 404 is transitioned between the collapsed and assembled configuration while at least a portion thereof (e.g., an end portion of the leg 418) remains in the base 402. For instance, with reference to FIG. 36E, to move the support frame 404 from the collapsed to the assembled configuration, the support frame 404 may be slid along the track 542 in the direction opposite direction 544 until the guide pin 536 is aligned with the guide slot 526. When the guide pin 536 is aligned with the guide slot 526, the weight of the side frame 404 may cause the pin 536 to drop into the guide slot 526 to slide along the lower guide 528 to the locking recess 508. The user may also lift upward on the crossmember 484 of the side frame 404 slightly as they withdraw the side frame 404 from the base 402. Lifting upward on the crossmember 484 may increase the weight of the side frame 404 supported on the pin 536, which causes the guide pin 536 to enter the guide slot 526 once aligned with the guide slot 526.

The side frame 404 may also be removed from the base 402, for example, to replace a damaged side frame 404. With respect to FIG. 36E, to remove the side frame 404, the support frame 404 is moved in the direction opposite direction 544. The side frame 404 is held substantially horizontal or inline with the track 542 such that the pin 536 does not enter the guide slot 526 and passes over the entrance to the guide slot 526. The side frame 404 may continue to be withdrawn from the base 402 until the side frame 404 is no longer in the base 402.

Figure 37A:
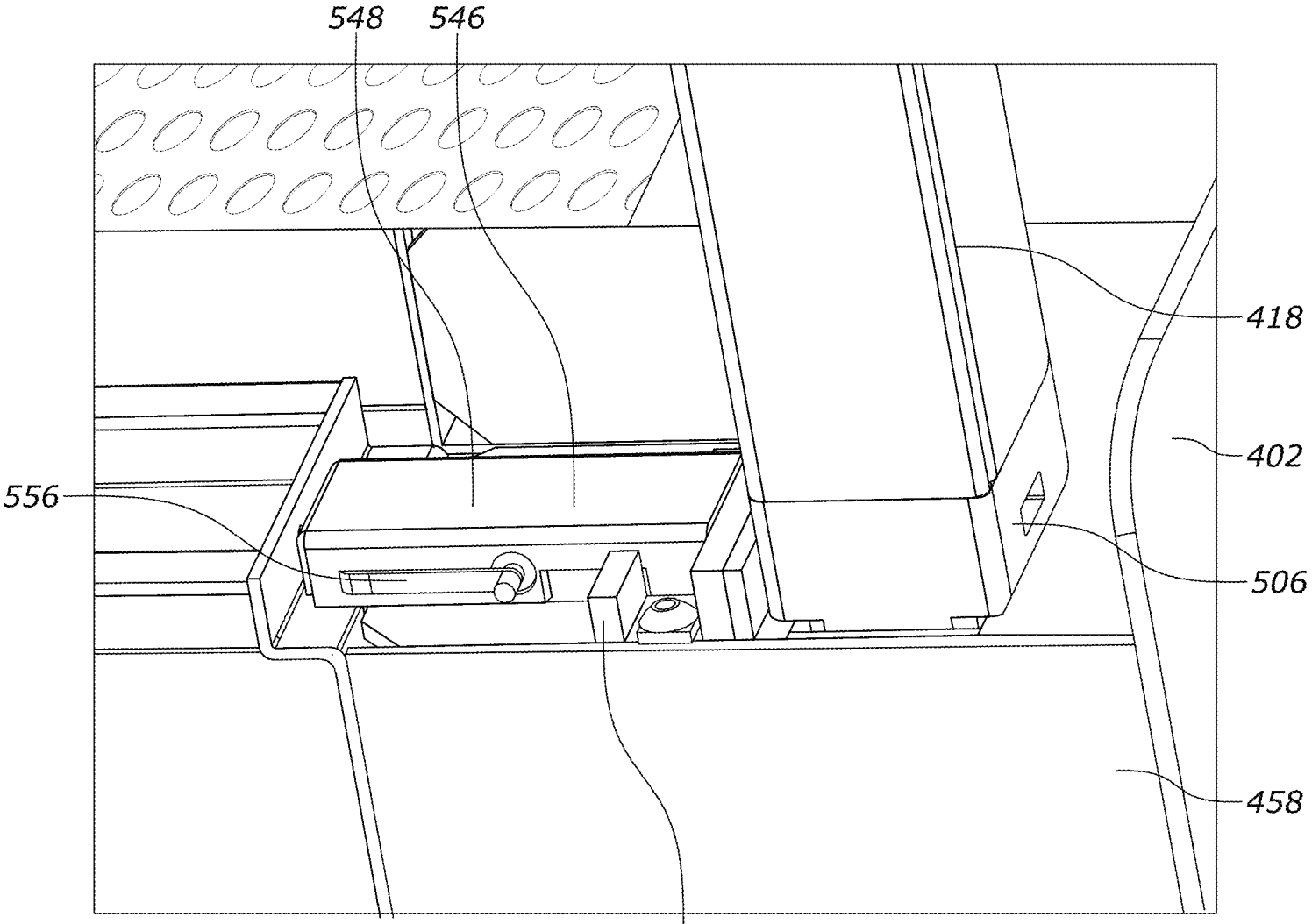
FIG. 37A is a perspective view of the corner portion of the collapsible crate of FIG. 29A showing a locking mechanism for securing the support wall in the assembled configuration.

With respect to FIG. 37A, the base 402 of the collapsible crate 400 may include a locking mechanism 546. The locking mechanism 546 may be mounted to the corner portion 458 of the base 402 proximate to the locking recess 508. The collapsible crate 400 may include a locking mechanism 546 on each corner portion 458 of the crate 400. In some forms, the collapsible crate 400 includes one locking mechanism 546 for each side frame 404, 406 The locking mechanism 546 is movable between a locked configuration and an unlocked configuration to selectively secure the side frame 404 to the base 402 when in the assembled configuration.

Figure 37B:
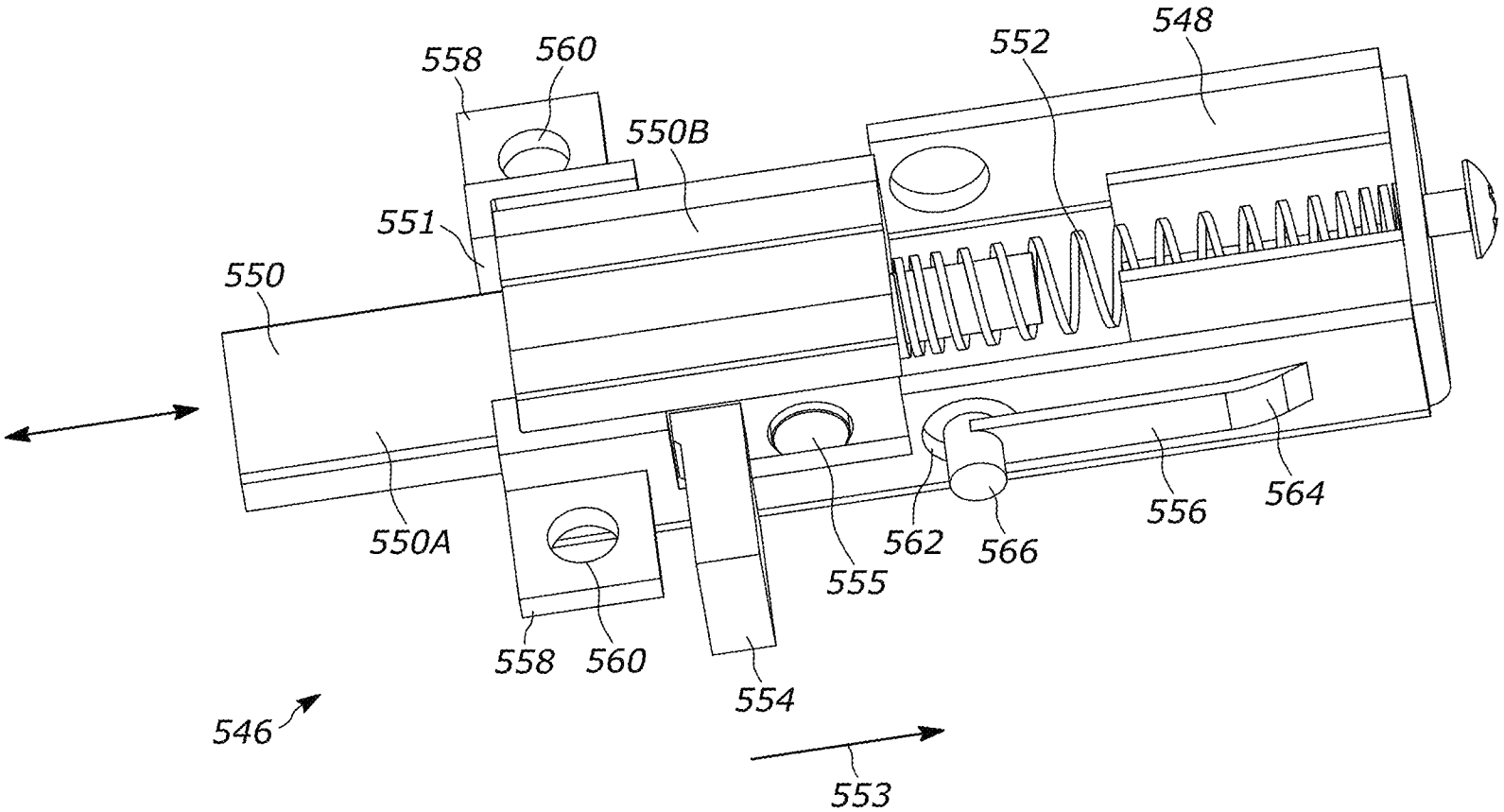
FIG. 37B is a bottom perspective view of the locking mechanism of FIG. 37A removed from the collapsible crate.

With reference also to FIG. 37B, the locking mechanism 546 includes a housing 548, a locking pin 550, a biasing member 552, a lever 554, and a locking actuator 556. The housing 548 may include attachment tabs 558 having attachment openings 560 to secure the locking mechanism 546 to the base 402 of the crate 400. The locking pin 550 is movable relative to the housing 548 between retracted position and an extended position. When the locking pin 550 is in the retracted position, the locking mechanism 546 is in the unlocked configuration. When the locking pin 550 is in the extended position, the locking mechanism 546 is in the locked configuration. The biasing member 552 is connected to the housing 548 and the locking pin 550 and urges the locking pin 550 toward the extended position.

The lever 554 is coupled to the locking pin 550 and accessible to the user. The locking pin 550 may include a pin portion 550A and a slide portion 550B. The pin portion 550A is rigidly coupled to the slide portion 550B and extends from the housing 548 when the locking pin 550 is in the extended position. The slide portion 550B may have a greater width than the pin portion 550A and an opening 551 in the housing 548 through which the pin portion 550A extends. The slide portion 550B is thus not able to pass through the opening 551 which limits outward movement of the locking pin 550. The slide portion 550B may slide on the base 502 of the crate 400 between the extended and retracted positions.

Figure 37C:
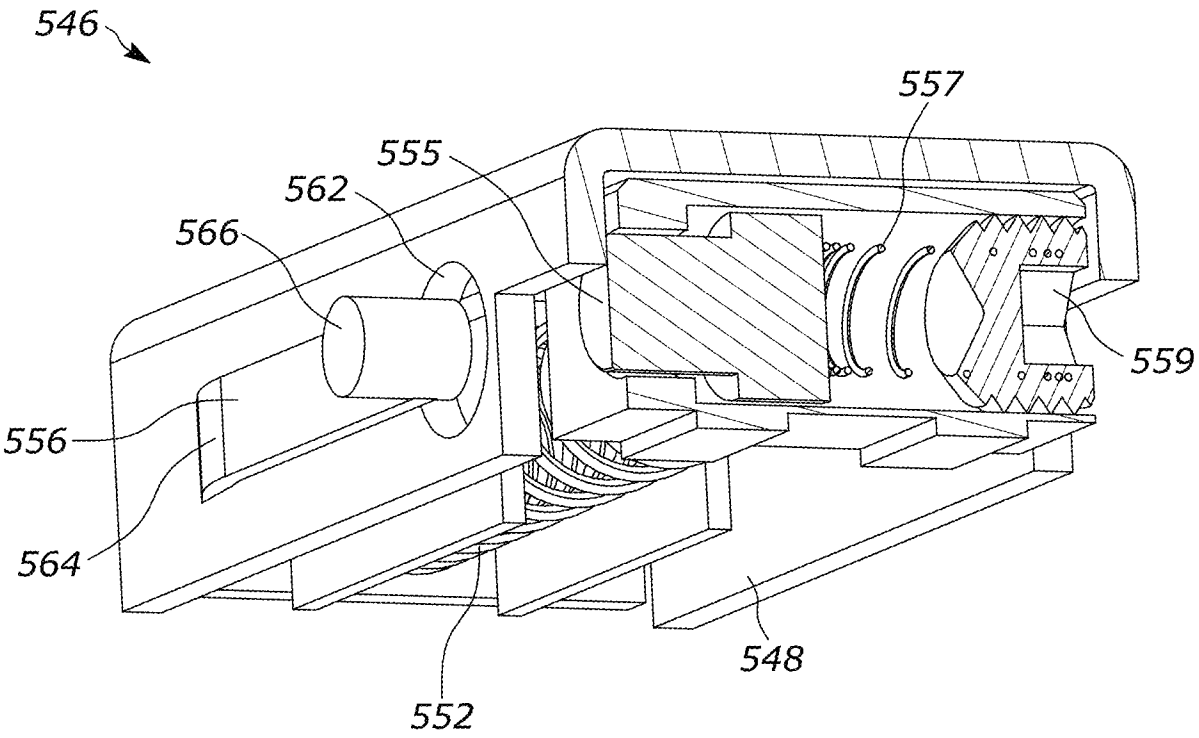
FIG. 37C is a perspective cross-sectional view of the locking mechanism of FIG. 37A, FIG. 37C showing the locking mechanism in an extended configuration.
Figure 37D:
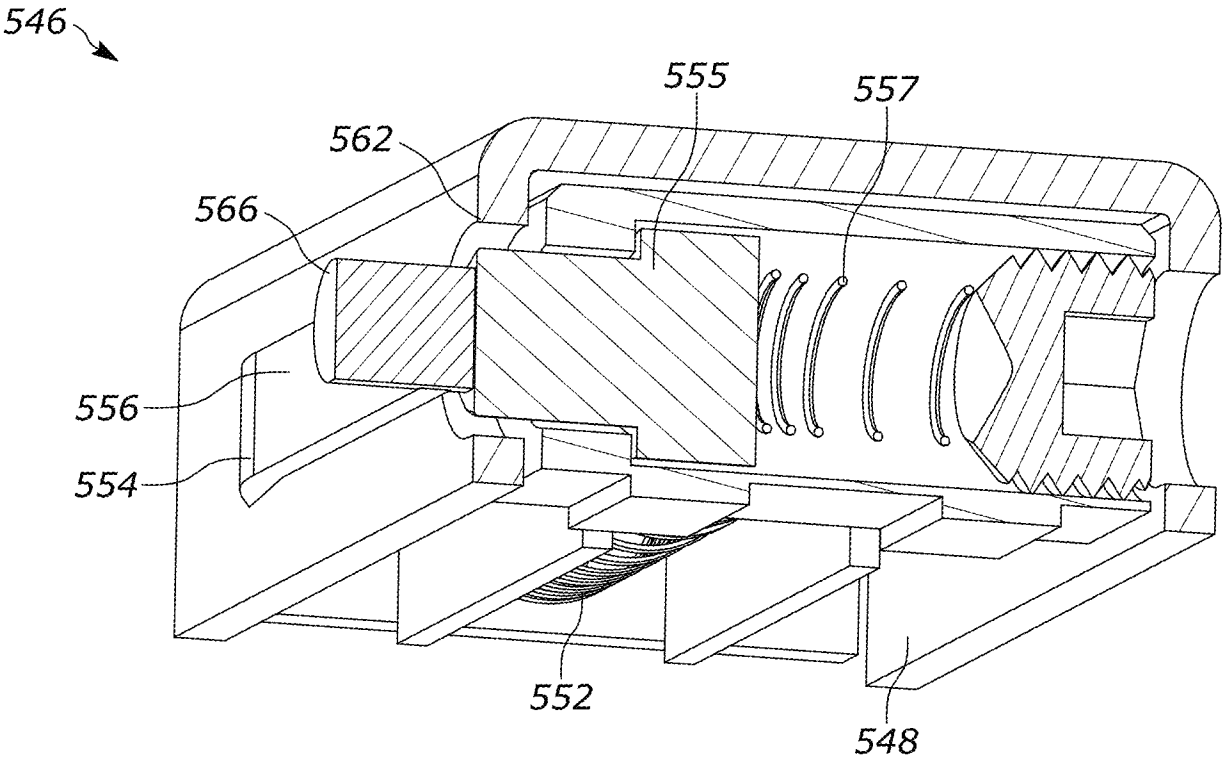
FIG. 37D is a perspective cross-sectional view of the locking mechanism of FIG. 37A, FIG. 37D showing the locking mechanism in a retracted configuration.

The user may move the lever 554 in direction 553 to overcome the biasing force of the biasing member 552 to move the locking pin 550 toward the retracted position. The locking pin 550 may include a protrusion 555 that is coupled to and moves with the locking pin 550. With respect to FIGS. 37C-37D, the protrusion 555 may be disposed in the slide portion 550B. The protrusion 555 is biased outward by a biasing member, such as spring 557. The spring 557 may extend between an adjustment base 559 and the protrusion 555. The adjustment base 559 may be threadingly secured to the slide portion 550B to permit adjustment of the biasing force of the spring 557 on the protrusion 555 (e.g., by threading the adjustment base 559 to move the adjustment base 559 toward or away from the protrusion 555). With reference to FIG. 37C, when the locking pin 550 is in the extended position, the protrusion 555 is biased against the housing 548 which holds the protrusion 555 in a withdrawn configuration. With reference to FIG. 37D, when the locking pin 550 is moved to the retracted position, the protrusion 555 is brought into alignment with an opening 562 in the housing 548, at which point the spring 557 urges the protrusion 555 to extend into the opening 562. With the protrusion 555 extending at least partially into the opening 562 of the housing 548, the locking pin 550 is held in the retracted position, maintaining the locking mechanism 546 in the unlocked configuration.

The locking actuator 556 has an arm 564 having a first end attached to the housing 548 and a second end supporting a head 566. The head 566 is positioned at the opening 562 of the housing 548. Force may be applied to the head 566 to flex the arm 564 and urge the head 566 from its resting position and into the opening 562. The arm 564 may be elastically deflectable such that when force is removed from the head 566 the head 566 returns to its resting position. When the protrusion 555 of the locking pin 550 is in the opening 562, the head 566 may contact the protrusion 555 to push the protrusion 555 out of the opening 562 against the biasing force of the spring 557. With the protrusion 555 no longer in the opening 562 and holding the locking pin 550 at the retracted position, the biasing member 552 urges the locking pin 550 to the extended position, causing the locking mechanism 546 to be in the locked configuration. While the locking actuator 556 and lever 554 are shown as being on the side of the housing 548 facing outward from the crate 400, in other forms, such as that shown in FIGS. 40-41B, the locking actuator 556 and lever 554 may be on the side of the of the housing 548 facing inward. Positioning the locking actuator 556 and lever 554 on the inward facing side of the housing 548 may inhibit damage to the locking mechanism due to inadvertent contact and inhibit unintentional movement of the locking actuator 556 and/or lever 554.

In some forms, the locking mechanism 546 includes a locking actuator 556 on both sides of the housing 548. The locking pin 550 may include two protrusions 555 extending away from one other to extend into corresponding openings 562 when the locking pin 550 is in the retracted position. The locking actuator 556 may be pinched or squeezed from both sides of the housing 548 to simultaneously actuate both locking actuators 556 and to cause the locking pin 550 to move toward the extended position.

In use, the locking mechanism 546 is in the unlocked configuration while the side frame 104 is transitioned to the assembled configuration. The user may press the head 566 of the locking actuator 556 to cause the locking mechanism 546 move to the locked configuration. Pressing the head 566 of the locking actuator 556 causes the locking pin 550 to move to the extended position and into the lock opening 518 of the leg 418 (see FIG. 35A) of the side frame 404. In some forms, the locking mechanism 546 is not in the unlocked configuration, but instead the biasing member 552 urges the locking pin 550 against the leg 418 of the side frame 404 as the side frame 404 is transitioned to the assembled configuration. When the locking pin 550 is aligned with the lock opening 518 of the leg 418, the biasing member 552 forces the locking pin 550 into the lock opening 518. With the locking pin 550 in the lock opening 518, the leg 418 is not able to be lifted out of the locking recess 508, thereby securing the side frame 404 to the base 402.

To transition the side frame 404 to the collapsed configuration, the user may apply force to the lever 554 to move the locking mechanism 546 to the unlocked configuration. Moving the lever 554 causes the locking pin 550 to retract into the housing 548 and be withdrawn from the lock opening 518 of the leg 418 of the side frame 404. The side frame 404 may then be moved to the collapsed configuration as discussed above with respect to FIGS. 36A-36E. The side frame 406 on the opposite side of the base 402 may similarly include a locking mechanism 546 to lock side frame 406 in the assembled configuration.

Figure 38:
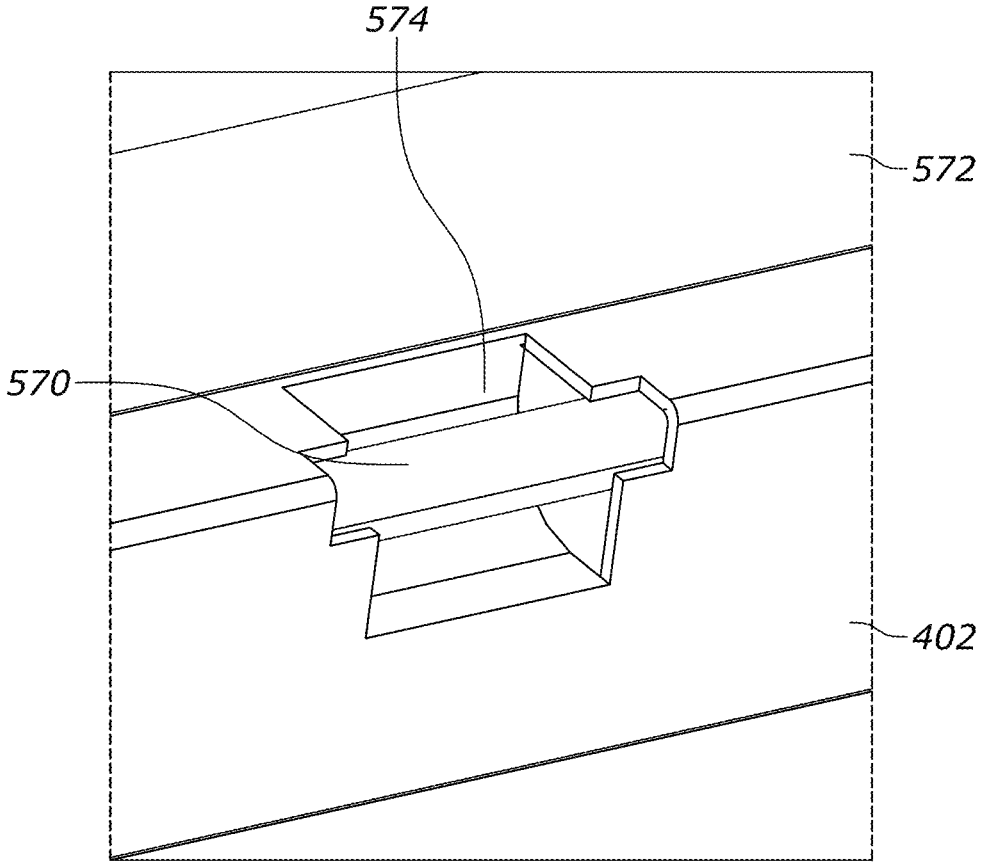
FIG. 38 is a closeup view of a strap loop of the collapsible crate of FIG. 29A.

With respect to FIGS. 29A, 35C, and 38, the collapsible crate 400 may include connector bars 570 to which hooks or straps may be attached. For example, straps may be used to secure items on the support surface 408 of the crate 400. The straps may be attached to the connector bars 570 to secure the items to the crate 400. The base 402 of the crate 400 may include recesses 574 in the frame 572 of the base 402 of the crate 400. A connector bar 570 spans the recess 574. As shown in FIG. 35C, the connector bar 570 may be longer than the recess 574, with ends of the connector bar 570 in contact with the inside surface of the frame 572. The connector bar 570 may be secured to the frame 572 of the base, for example, by welding ends of the connector bar 570 to the frame 572.

Figure 39:
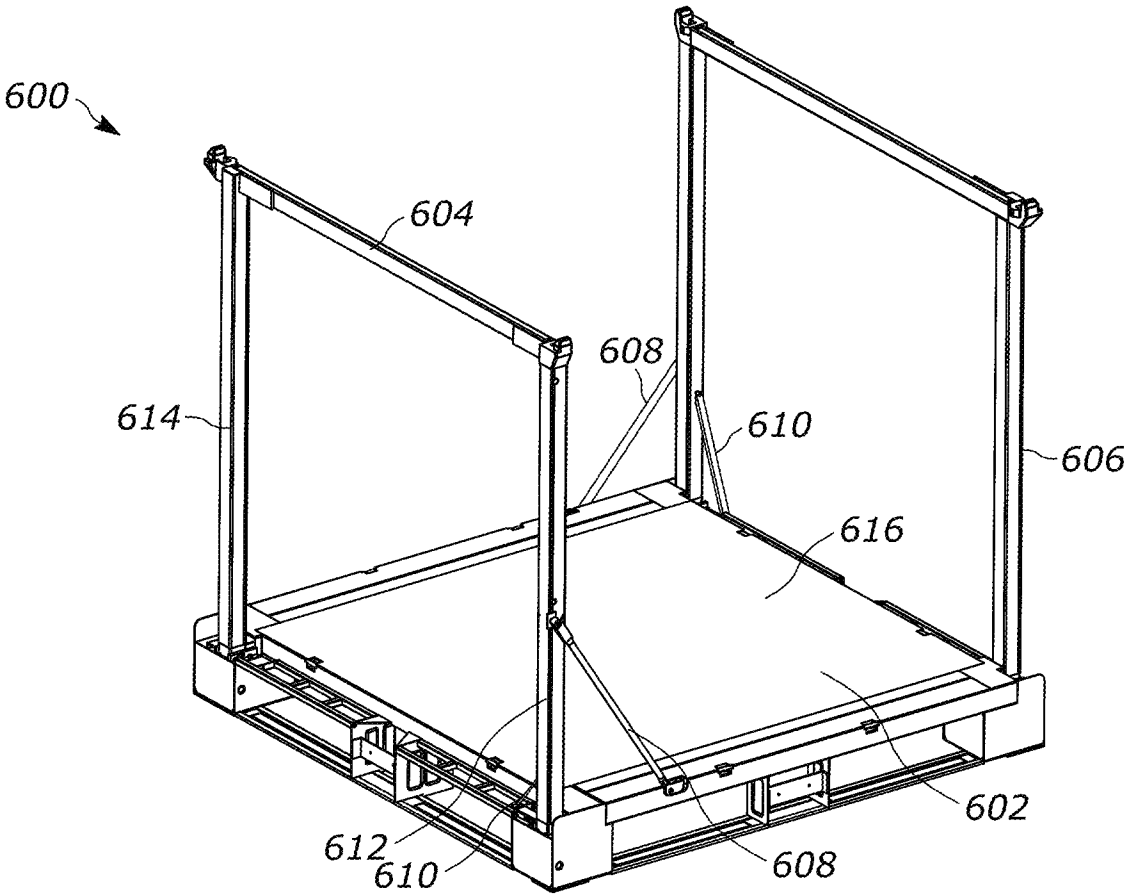
FIG. 39 is a perspective view of a collapsible crate according to another embodiment.

With respect to FIG. 39, a collapsible crate 600 is shown according to another embodiment. The collapsible crate 600 is similar to the embodiment discussed above such that the differences are highlighted. The collapsible crate 600 includes a base 602, a first support frame 604 and a second support frame 606. The collapsible crate 600 further includes a first support bar 608 and a second support bar 610 that extend from a leg 612 of the first support frame 604 to the base 602. The first support bar 608 and second support bar 610 extend from the leg 612 in different directions to brace the support frame 604 when the first support frame 604 is in the assembled configuration. Specifically, the first support bar 608 extends from the leg 612 toward the second support frame 606 and the second support bar 610 extends from the leg 612 toward the other leg 614 of the first support frame 604. When transitioning the support frame 604 to the collapsed configuration, the first support bar 608 may be detached from the base 602 and pivoted about the connection to the leg 612 to extend substantially parallel to the leg 612 and the second support bar 610 may be detached from the leg 612 and pivoted about the connection to the base 602 to extend substantially parallel to the support surface 616 of the base 602. The structure of the second support frame 606 is similar to the first support frame.

Figure 40:
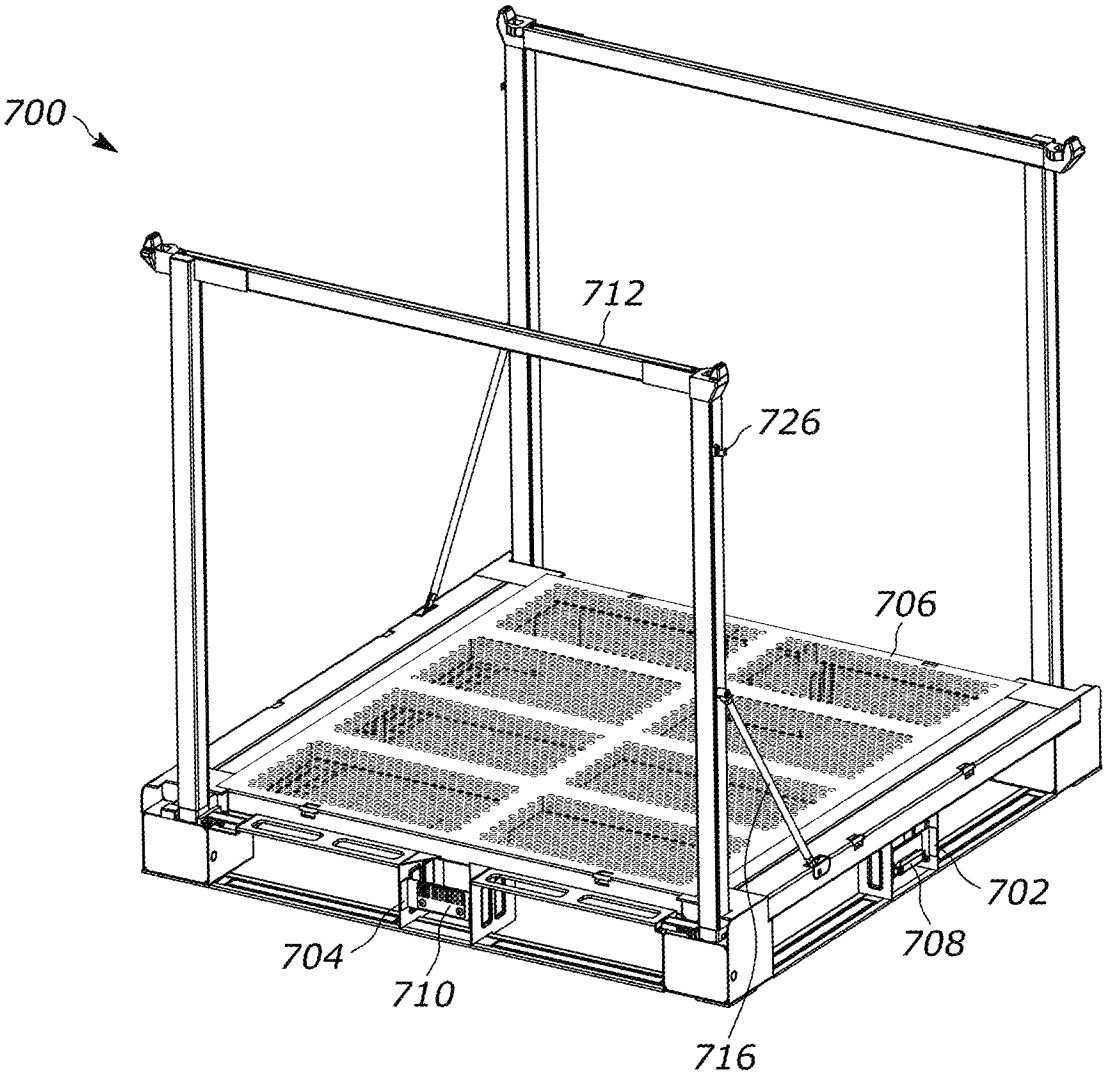
FIG. 40 is a perspective view of a collapsible crate according to another embodiment.

With respect to FIG. 40, a collapsible crate 700 is shown according to another embodiment. The collapsible crate 700 is similar in many respects to the embodiments discussed above such that the differences will be highlighted. The collapsible crate 700 includes mounting brackets 702, 704 on a base 706 of the crate 700. An RFID tag 708 is mounted to the mounting bracket 702. The RFID tag 708 may store information pertaining to the collapsible crate 700 and/or the contents supported by the collapsible crate 700 that may be read by an RFID reader to enable the collapsible crate 700 and/or the contents thereof to be tracked during shipping or storage and/or to facilitate automated sorting of the collapsible crates 700, for example, on a conveyor system. A scannable code 708 may be mounted to the mounting brackets 704. The scannable code 708 may be a bar code, QR code, or the like that may be scanned by a code reader (e.g., a bar code scanner) to retrieve information associated with the scannable code 708. For example, the scannable code 708 may include information identifying the crate 700. Upon scanning the scannable code 708 of the crate 700, the information retrieved may be used to search a database to retrieve additional information associated with the crate 700, e.g., a destination and/or contents of the crate 700.

Figure 41A:
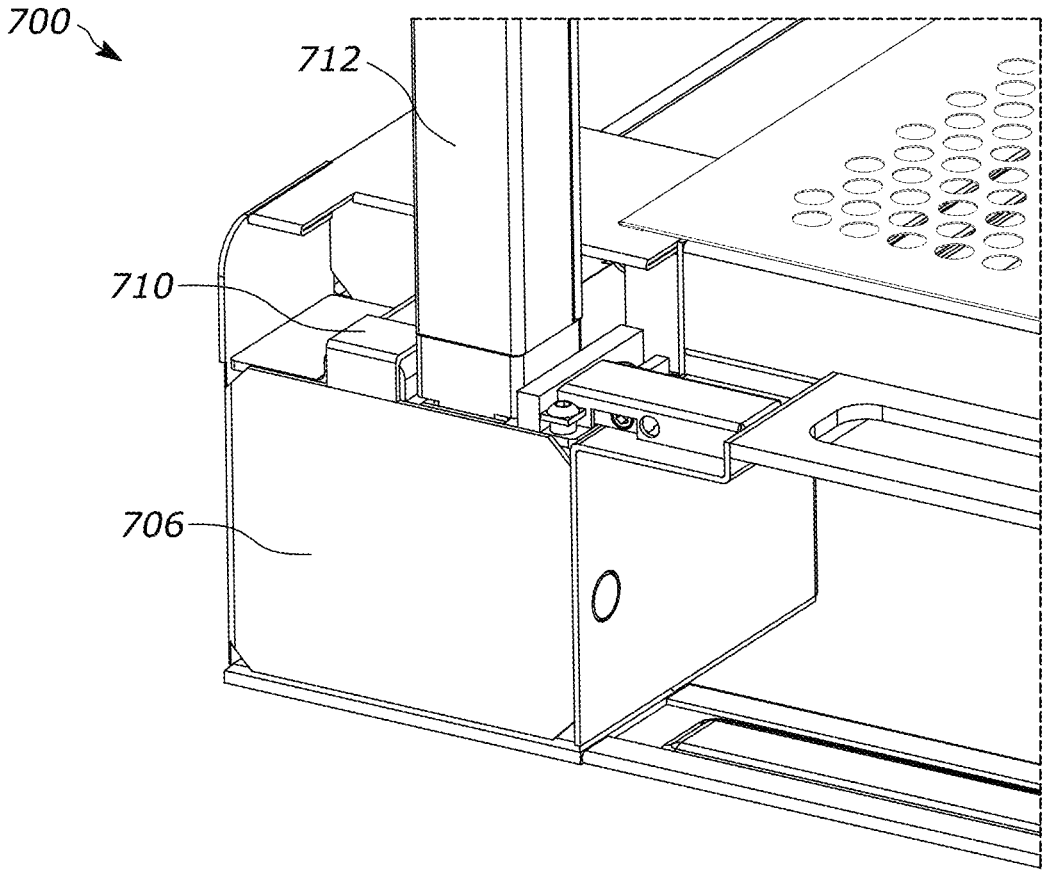
FIG. 41A is a perspective view of a corner of the base of the collapsible crate of FIG. 40 in an assembled configuration.
Figure 41B:
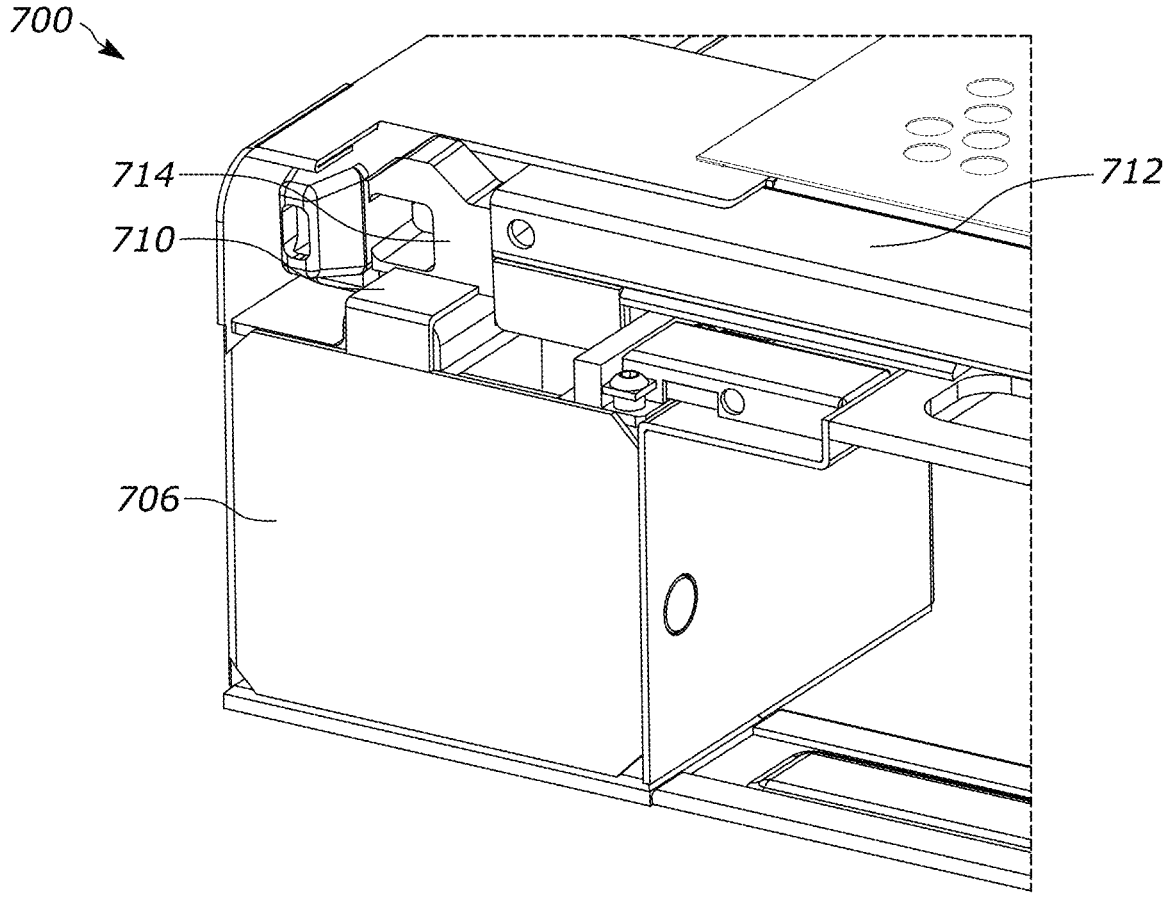
FIG. 41B is a perspective view of the corner of the base of the collapsible crate of FIG. 40 in a collapsed configuration.

With respect to FIGS. 41A-41B, the collapsible crate 700 may include a stop 710 to inhibit a side frame 712 of the collapsible crate 700 from sliding out of the base 706 when in the collapsed configuration. As shown in FIG. 41B, when the collapsible crate 700 is in the collapsed configuration, the stop 710 may contact a portion of the side frame 712, such as a coupler 714 of the side frame 712, to inhibit the side frame 712 from sliding out of the base 706. To withdraw the side frame 712 from the base 706, the side frame 712 may be lifted slightly above the stop 710 and then pulled outward to pass the side frame 712 over the stop 710.

Figure 42A:
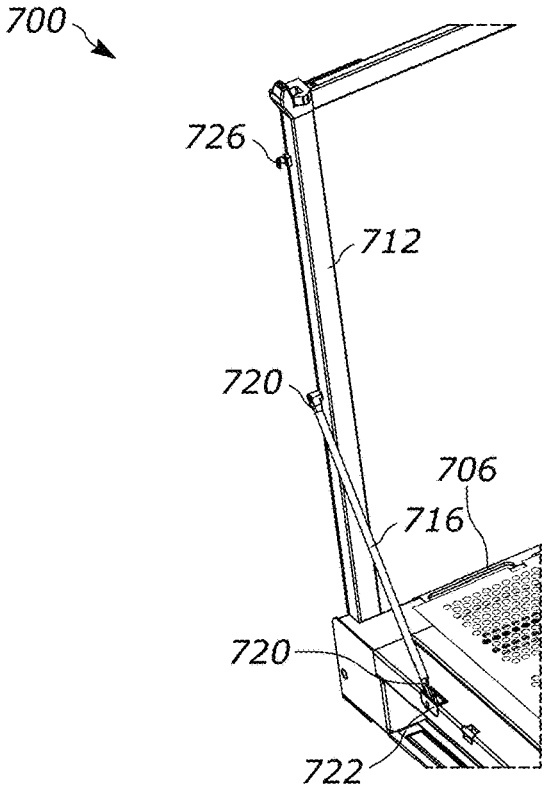
FIG. 42A is a perspective view of a portion of a side frame of the collapsible crate of FIG. 40 showing a support bar in an assembled configuration.
Figure 42B:
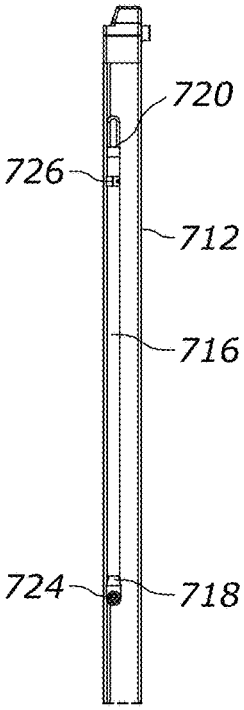
FIG. 42B is a side view of the side frame of FIG. 42A showing the support bar rotated to a stowed configuration.

With respect to FIGS. 42A-42B, the collapsible crate 700 includes a support bar 716 that may be positioned to extend from the side frame 712 to the base 706 to support the side frame 712 in the upright, assembled configuration. The support bar 716 includes a first end 718 pivotably attached to the side frame 712 and a second end 720 releasably attached to a connector 722 of the base 706 of the crate 700 as discussed with respect to the embodiments above. The support bar 716 may be pivoted about the first end 718 from an assembled configuration (FIG. 42A) to a stowed configuration (FIG. 42B). In the embodiment shown, the first end 718 of the support bar 716 is pivotably secured to the side frame 712 by a bolt 724. The side frame 712 includes a clip 726 (e.g., a C-clip) that releasably secures the support bar 716 in the stowed configuration. For example, the support bar 716 may be pivoted to extend generally parallel with the side frame 712 and force applied to urge the support bar 716 into the clip 726 to secure the support bar 716 in the stowed configuration. With the support bar 716 in the stowed configuration, the side frame 712 may be moved to the collapsed configuration and stored in the base 706 of the crate 700. To move the support bar 716 from the stowed configuration to the assembled configuration, force may be applied to withdraw the support bar 716 from the clip 726 and the support bar 716 pivoted down and into the connector 722 of the base 706 as discussed with respect to the embodiment above.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, those skilled in the art will recognize that a wide variety of modifications, alterations, and combinations can be made with respect to the above-described embodiments without departing from the scope of the invention, and that such modifications, alterations, and combinations are to be viewed as being within the ambit of the inventive concept.

What is claimed is:

1. A collapsible crate comprising:

a supporting surface;

a receptacle comprising a first track and a second track below the supporting surface, the first and second tracks each including locking recesses and a first track surface and second track surface extending from the locking recesses; and a first side frame having a first leg slidable along the first track surface of the first track and a second leg slidable along the second track surface of the second track to removably stow the first side frame on the first and second track surfaces of the receptacle, wherein the first leg and second leg include end portions that are removably insertable into the locking recesses of the first and second tracks to secure the first side frame in an upright position relative to the supporting surface when removed from the first and second track surfaces of the first and second tracks, wherein the locking recesses of the first and second tracks include support walls that engage the end portions of the first leg and second leg when inserted into the locking recesses to inhibit the first side frame from pivoting, and wherein the first and second tracks include ramped surfaces extending from the locking recesses to the first and second track surfaces of the receptacle to guide the end portions of the first and second legs between the locking recesses and the first and second track surfaces.

2. The collapsible crate of claim 1 wherein the end portions of the first leg and second leg remain below the supporting surface when transitioning between the locking recesses and the first and second tracks.

3. The collapsible crate of claim 1 further comprising:

a base including the supporting surface and the receptacle; and a support bar to support the first side frame in the upright position, the support bar having a first end attached to the first side frame and a second end removably attachable to the base.

4. The collapsible crate of claim 1 further comprising a locking mechanism operable to reversibly secure the first side frame in the upright position and/or when stowed on the first and second track surfaces of the receptacle.

5. The collapsible crate of claim 4 wherein the locking mechanism includes a retractable locking pin to be inserted into a lock opening of the first side frame to secure the end portion of the first side frame in the locking recesses.

6. The collapsible crate of claim 4 wherein the locking mechanism includes a retractable locking pin that is able to be extended into a path of the first side frame to inhibit movement of the first leg and second leg along the first track surface and second track surface.

7. A collapsible crate comprising:

a supporting surface;

a receptacle comprising a first track and a second track below the supporting surface, the first and second tracks each including locking recesses and a first track surface and second track surface extending from the locking recesses; and a first side frame having a first leg slidable along the first track surface of the first track and a second leg slidable along the second track surface of the second track to removably stow the first side frame on the first and second track surfaces of the receptacle, wherein the first leg and second leg include end portions that are removably insertable into the locking recesses of the first and second tracks to secure the first side frame in an upright position relative to the supporting surface when removed from the first and second track surfaces of the first and second tracks, wherein the end portions of the first side frame include guide pins and the first track and second track includes guide slots receiving the guide pins, the guide slots directing movement of the end portions of the first side frame between the locking recesses and the first and second track surface, and wherein the guide slots include a cam surface positioned above the guide pins when the end portions of the first and second legs are received in the locking recesses to limit vertical movement of the first side frame when the end portions of the first and second legs are withdrawn from the locking recesses and to direct the end portions of the first and second legs toward the first and second track surfaces.

8. A collapsible crate comprising:

a base having a supporting surface and defining a receptacle below the supporting surface, the supporting surface having an outer edge;

a first side frame having a first leg and a second leg removably insertable along tracks of the receptacle on a first end portion of the base; and a second side frame having a third leg and a fourth leg removably insertable along tracks of the receptacle on a second end portion of the base, the outer edge of the support surface extending from the first end portion to the second end portion, each leg of the first side frame and second side frame being a different distance from the outer edge than the other legs of the first side frame and second side frame, wherein the first side frame includes a first protrusion and a second protrusion and the second side frame includes a third protrusion and a fourth protrusion, the first protrusion and third protrusion positioned the same distance from the outer edge and the second protrusion and the fourth protrusion positioned the same distance from the outer edge, and wherein the first and second protrusions extend upward from the first side frame beyond the supporting surface when the first side frame is inserted into the receptacle, and the third and fourth protrusions extend upward from the second side frame beyond the supporting surface when the second side frame is inserted into the receptacle.

9. The collapsible crate of claim 8 wherein the third leg is further from the outer edge than the first leg and the fourth leg is further from the outer edge than the second leg, wherein the second leg is further from the outer edge than the first leg.

10. The collapsible crate of claim 8 wherein the receptacle of the base includes four tracks along which the legs of the first side frame and second frame are inserted into the base.

11. The collapsible crate of claim 10 wherein each of the four tracks extend parallel to one another along the same plane.

12. The collapsible crate of claim 8 wherein the first side frame includes an upper member extending between the first leg and second leg, the upper member extending beyond the second leg to support the second protrusion in alignment with the fourth protrusion.

13. The collapsible crate of claim 12 wherein the second side frame includes an upper member extending between the third leg and fourth leg, the upper member of the second side frame extending beyond the third leg to support the third protrusion in alignment with the first protrusion.

14. The collapsible crate of claim 8 wherein the first side frame and second side frame are able to be withdrawn from the receptacle of the base and secured in an upright position relative to the supporting surface, the first and second protrusions extending upward from the first side frame when the first side frame is secured in the upright position, and the third and fourth protrusions extending upward from the second side frame when the second side frame is secured in the upright position.

* * * * *